US010953654B2

(12) United States Patent
Miyasaka et al.

(10) Patent No.: US 10,953,654 B2
(45) Date of Patent: Mar. 23, 2021

(54) INK ABSORBER, INK ABSORBING MEMBER ACCOMMODATION CONTAINER, AND INK ABSORBING STRUCTURE

(71) Applicant: Seiko Epson Corporation, Tokyo (JP)

(72) Inventors: Yoichi Miyasaka, Suwa (JP); Kaneo Yoda, Okaya (JP); Nobutaka Urano, Matsumoto (JP); Seiichi Taniguchi, Asahi (JP); Akio Ito, Matsumoto (JP); Shunichi Seki, Suwa (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/364,259

(22) Filed: Mar. 26, 2019

(65) Prior Publication Data

US 2019/0299607 A1 Oct. 3, 2019

(30) Foreign Application Priority Data

Mar. 27, 2018 (JP) ..... JP2018-059711
Mar. 27, 2018 (JP) ..... JP2018-059713
Mar. 27, 2018 (JP) ..... JP2018-059714

(51) Int. Cl.
*B41J 2/055* (2006.01)

(52) U.S. Cl.
CPC ..... *B41J 2/055* (2013.01)

(58) Field of Classification Search
CPC .... B41J 2/055; B41J 2/16508; B41J 2/16523; B41J 2002/1856; B41J 2/185; B41J 2/175
See application file for complete search history.

(56) References Cited

U.S. PATENT DOCUMENTS

| | | | | |
|---|---|---|---|---|
| 5,940,102 | A | 8/1999 | Watanabe et al. | |
| 6,203,149 | B1 | 3/2001 | Watanabe et al. | |
| 6,790,798 | B1 | 9/2004 | Suzuki et al. | |
| 2009/0219337 | A1 * | 9/2009 | Harada | B41J 2/17596 347/36 |

FOREIGN PATENT DOCUMENTS

| | | | |
|---|---|---|---|
| JP | S60-217159 | A | 10/1985 |
| JP | S60-240456 | A | 11/1985 |
| JP | S61-054942 | A | 3/1986 |
| JP | S61-074847 | A | 4/1986 |
| JP | S61-158460 | A | 7/1986 |
| JP | H07-195705 | A | 8/1995 |
| JP | H08-216428 | A | 8/1996 |
| JP | H11-157099 | A | 6/1999 |
| JP | 2000-014170 | A | 1/2000 |
| JP | 2000-024033 | A | 1/2000 |

(Continued)

*Primary Examiner* — Sharon Polk
(74) *Attorney, Agent, or Firm* — Harness, Dickey & Pierce, P.L.C.

(57) ABSTRACT

An ink absorber includes: an ink absorbing member that is capable of absorbing ink; an accommodation section that accommodates the ink absorbing member; and a detachment structure section that detaches the ink absorbing member from the accommodation section. In the ink absorber, it is preferable that the accommodation section have a bottom section and side wall sections standing up from the bottom section, that inclined surfaces inclined relative to the bottom section be formed inside the side wall sections, and that the detachment structure section be configured with the inclined surfaces.

10 Claims, 25 Drawing Sheets

(56) References Cited

FOREIGN PATENT DOCUMENTS

| | | | |
|---|---|---|---|
| JP | 2000-141678 | A | 5/2000 |
| JP | 2001-180757 | A | 7/2001 |
| JP | 3196933 | B2 | 8/2001 |
| JP | 3536870 | B2 | 6/2004 |
| JP | 2005-131904 | A | 5/2005 |
| JP | 2006-123405 | A | 5/2006 |
| JP | 2007-253471 | A | 10/2007 |
| JP | 2015-142909 | A | 8/2015 |
| JP | 2016-172803 | A | 9/2016 |
| WO | WO-08-108295 | A1 | 9/2008 |
| WO | WO-2018-008758 | A1 | 1/2018 |

* cited by examiner

INK ABSORBER, INK ABSORBING MEMBER ACCOMMODATION CONTAINER, AND INK ABSORBING STRUCTURE

BACKGROUND

1. Technical Field

The present invention relates to an ink absorber (ink absorbing member accommodation container) and an ink absorbing structure.

2. Related Art

An ink jet printer, waste ink is typically generated when a head cleaning operation that is performed to prevent degradation of print quality due to clogging of ink and an ink filling operation after replacement of an ink cartridge are performed. Thus, a liquid absorbing member (ink absorbing member) that absorbs the waste ink is provided in order to prevent unintended adhesion of such waste ink to devices or the like inside the printer.

In the related art, a liquid absorbing member (ink absorbing member) that includes natural cellulose fiber and/or synthesized fiber and a thermal-bonding substance has been used (see Japanese Patent No. 3536870, for example). The liquid absorbing member includes highly water-absorbable resin, and this enhances absorbability of the liquid absorbing member. Such a liquid absorbing member is typically mounted on an ink jet printer in a state in which the liquid absorbing member is accommodated in a hard container.

The liquid absorbing member is typically mounted on the ink jet printer in which the liquid absorbing member is accommodated in a hard container. The liquid absorbing member accommodated in the container in this manner is preferably replaced with a new unused liquid absorbing member when an ink absorption limit is achieved. In addition, the liquid absorbing member that is accommodated in the container in this manner is temporally dried after the ink is absorbed, and only the dried portion contracts. At this time, the liquid absorbing member tends to contract from a portion in contact with the container, that is, from the side of the side wall section. The contracting liquid absorbing member may tend to move in the container, that is, easily cause positional deviation due to oscillation or the like during printing, for example, and the liquid absorbing member may not be located at ink dropping locations in the container in some cases. In such cases, problems that the liquid absorbing member cannot quickly absorb the ink, that the ink cannot be sufficiently absorbed, and the like occur. If the liquid absorbing member is irradiated with ultraviolet rays, there is a concern that the highly water-absorbable resin is degraded due to cutting at a portion of a common bond of molecular structures in the highly water-absorbable resin, for example. That is, there is a concern that water absorption performance and water retention performance of the liquid absorbing member are degraded.

However, if it is actually attempted to replace the liquid absorbing member, it is difficult to perform the replacement operation, and for example, it is difficult to open the container that accommodates the liquid absorbing member or to remove the liquid absorbing member from the container.

SUMMARY

An advantage of some aspects of the invention is to provide an ink absorber capable of facilitating a replacement operation performed when it is desired to replace an ink absorbing member after use with a new unused ink absorbing member, for example. Another advantage of some aspects of the invention is to provide an ink absorbing member accommodation container and an ink absorbing structure capable of quickly and sufficiently absorbing ink with an ink absorbing member. Yet another advantage of some aspects of the invention is to provide an ink absorbing member accommodation container and an ink absorbing structure capable of preventing an ink absorbing member in the ink absorbing member accommodation container from deteriorating due to irradiation with ultraviolet rays.

The invention can be realized as follows.

According to an aspect of the invention, there is provided an ink absorber including: an ink absorbing member that is capable of absorbing ink; an accommodation section that accommodates the ink absorbing member; and a detachment structure section that detaches the ink absorbing member from the accommodation section.

In this configuration, the ink absorbing member after use can be easily detached and collected from the accommodation section with the detachment structure section when it is desired to replace the ink absorbing member after use in the ink absorber that has reached an ink absorption limit with a new unused ink absorbing member. Then, it is possible to accommodate the unused ink absorbing member in the vacant accommodation section and to reuse the ink absorber. In this manner, the ink absorber is configured such that it is possible to easily perform the replacement operation of the ink absorbing member and thereby to improve operability thereof.

In the ink absorber, it is preferable that the accommodation section have a bottom section and side wall sections standing up from the bottom section, that inclined surfaces inclined relative to the bottom section be formed inside the side wall sections, and that the detachment structure section be configured with the inclined surfaces.

In this configuration, it is possible to easily perform the replacement operation when it is desired to replace the ink absorbing member after use that has reached the ink absorption limit, for example, with a new unused ink absorbing member, and thereby to improve operability thereof.

In the ink absorber, it is preferable that the accommodation section have a bottom section and side wall sections standing up from the bottom section, and that the detachment structure section be configured with a low friction layer that is provided inside the side wall sections and that reduces friction against the ink absorbing member when the ink absorbing member is detached from the accommodation section.

In this configuration, detachment of the ink absorbing member from the accommodation section is easily performed, and it is thus possible to easily perform the replacement with the new ink absorbing member after then.

In the ink absorber, it is preferable that the detachment structure section be configured to detach and collect the absorbing member from the accommodation section.

In this configuration, detachment and collection of the ink absorbing member from the accommodation section are performed, and it is thus possible to easily perform the replacement with the new ink absorbing member after then.

In the ink absorber, it is preferable that the detachment structure section have a placement section on which the ink absorbing member is placed and a gripping section that is coupled to the placement section and that is gripped when the ink absorbing member is detached from the accommodation section, and that the detachment structure section be detached from the accommodation section along with the ink absorbing member when the ink absorbing member is detached from the accommodation section.

In this configuration, it is possible to detach the detachment structure section from the accommodation section along with the ink absorbing member if the gripping section is gripped and pulled out upward as it is when the ink absorbing member is detached from the accommodation section. In this manner, it is possible to easily perform replacement of the ink absorbing member.

In the ink absorber, it is preferable that the ink absorbing member contract with a decrease in water content, and that the gripping section be brought into contact with the ink absorbing member by being inserted into the ink absorbing member and have a function of curbing movement in the accommodation section with the contraction of the ink absorbing member in a state before the ink absorbing member is detached from the accommodation section.

In this configuration, the ink absorbing member can be continuously located at the ink dropping locations even if the ink absorbing member contracts and can thus quickly and sufficiently absorb the ink.

In the ink absorber, it is preferable that the gripping section be brought into contact with the ink absorbing member by being inserted into the ink absorbing member and have a liquid guiding function of guiding the ink to the ink absorbing member in a state before the ink absorbing member is detached from the accommodation section.

In this configuration, it is possible to sufficiently absorb the ink up to the furthest side of the ink absorbing member and thereby to exhibit ink absorbing function of the ink absorbing member with neither excess nor deficiency in a long term.

In the ink absorber, it is preferable that the accommodation section have an ink supply port supplying the ink to an inside, and that the gripping section have a tubular shape and serves as a liquid guiding pipe that is located in the accommodation space and that forms a liquid guiding space guiding the ink supplied into the accommodation space to the bottom section of the accommodation section in a state before the ink absorbing member is detached from the accommodation section.

In this configuration, the ink supplied to the inside of the accommodation section passes through the inside of the liquid guiding pipe, that is, through the liquid guiding space and is then quickly and smoothly guided to the furthest side of the accommodation section.

In the ink absorber, it is preferable that a communication section that communicates the liquid guiding space with the accommodation space be formed at a pipe wall of the liquid guiding pipe.

In this configuration, the ink temporarily remaining in the liquid guiding space is absorbed by the ink absorbing member via the communication section when the ink remains, for example. In this manner, it is possible to curb remaining of the ink in the liquid guiding space and thereby to quickly and sufficiently absorb the ink.

In the ink absorber, it is preferable that the detachment structure section have an inner accommodation section that is accommodated in the accommodation section along with the ink absorbing member in a state in which the ink absorbing member is accommodated, and the inner accommodation section be detached from the accommodation section along with the ink absorbing member when the ink absorbing member is detached from the accommodation section.

In this configuration, it is possible to detach the inner accommodation section from the accommodation section along with the ink absorbing member if the inner accommodation section is gripped and pulled out upward as it is when the ink absorbing member is detached from the accommodation section. In this manner, it is possible to easily perform the replacement of the ink absorbing member.

According to another aspect of the invention, there is provided an ink absorber including: an ink absorbing member that is capable of absorbing ink; an accommodation section that accommodates the ink absorbing member; and an assist structure section that assists removal of the ink absorbing member when the ink absorbing member is removed from the accommodation section.

In this configuration, it is possible to easily remove the ink absorbing member after use from the accommodation section with the assist structure section when it is desired to replace the ink absorbing member after use in the ink absorber that has reached the ink absorption limit with a new unused ink absorbing member. In addition, it is possible to accommodate the unused ink absorbing member in a vacant accommodation section and to reuse the ink absorber. In this manner, the ink absorber is configured such that it is possible to easily perform the replacement operation of the ink absorbing member and thereby to improve operability thereof.

In the ink absorber, it is preferable that the ink absorbing member include water-absorbable resin.

In this configuration, it is possible to sufficiently absorb the ink.

According to yet another aspect of the invention, there is provided an ink absorbing member accommodation container including: a container main body that has an accommodation space for accommodating an ink absorbing member including water-absorbable resin capable of absorbing ink; and insertion members that are inserted into the ink absorbing member and that are brought into contact with the ink absorbing member.

In this configuration, the insertion members are inserted into the ink absorbing member and are brought into a state in which the insertion members are engaged and in contact with the ink absorbing member. In such a state, movement of the ink absorbing member in the container main body (accommodation space) is curbed even is the ink absorbing member is dried and contracts after absorbing the ink. In this manner, the ink absorbing member can be continuously located at the ink dropping locations and can thus quickly and sufficiently absorb the ink.

In the ink absorbing member accommodation container, it is preferable that the ink absorbing member contract with a decrease in water content, and that the insertion members have a function of curbing movement in the accommodation space with the contraction of the ink absorbing member.

In this configuration, the ink absorbing member can be continuously located at the ink dropping locations even if the ink absorbing member contracts and can thus quickly and sufficiently absorb the ink.

In the ink absorbing member accommodation container, it is preferable that the insertion members have a liquid guiding function of guiding the ink to the ink absorbing member.

In this configuration, it is possible to sufficiently absorb the ink up to the furthest side of the ink absorbing member and thereby to exhibit the ink absorption function of the ink absorbing member with neither excess nor deficiency in a long term.

In the ink absorbing member accommodation container, it is preferable that the container main body have a bottom section and side wall sections standing up from the bottom section, and that the insertion members be configured with at least one protrusion protruding from the bottom section.

In this configuration, the protrusion is inserted into the ink absorbing member from the side of the bottom section and is brought into a state in which the protrusion is engaged and in contact with the ink absorbing member.

It is preferable that the ink absorbing member accommodation container include a cover member that is attached to the container main body and that has an ink supply port supplying the ink to an inside of the accommodation space, and that the at least one protrusion be located on an extension of a supply direction in which the ink is supplied from the ink supply port.

In this configuration, the ink is delivered along the outer peripheral section of the protrusion and is then guided to the furthest side of the ink absorbing member when the ink is supplied.

In the ink absorbing member accommodation container, it is preferable that a top of the at least one protrusion be exposed from the ink absorbing member.

In this configuration, the ink is delivered along the outer peripheral section of the protrusion and is then guided to the furthest side of the ink absorbing member when the ink is supplied.

In the ink absorbing member accommodation container, it is preferable that a top of the at least one protrusion be buried in the ink absorbing member.

In this configuration, engagement force on the furthest side of the ink absorbing member increases, and the function of curbing the movement of the ink absorbing member in the container main body is enhanced.

In the ink absorbing member accommodation container, it is preferable that the at least one protrusion have a columnar shape with a cross sectional shape reduced toward a side of the ink supply port.

In this configuration, the protrusion is brought into a state in which the protrusion sticks into the ink absorbing member from the side of the bottom section, engagement force against the ink absorbing member increases, and the ink absorbing member is thus positioned in the container main body regardless of expansion and contraction.

It is preferable that the ink absorbing member accommodation container further include a cover member that is attached to the container main body and that has an ink supply port supplying the ink to an inside of the accommodation space, and that the plurality of insertion members be radially disposed around the ink supply port when seen from the side of the ink supply port.

In this configuration, it is possible to curb movement of the ink absorbing member even if the ink absorbing member is likely to move in any direction in the container main body.

In the ink absorbing member accommodation container, it is preferable that the container main body have a bottom section and side wall sections standing up from the bottom section, and that the insertion members be configured with protrusions protruding from the side wall sections.

In this configuration, it is possible to curb movement of the ink absorbing member even if the ink absorbing member is likely to move in any direction in the container main body.

In the ink absorbing member accommodation container, it is preferable that the insertion members be provided at midpoints of the container main body in a depth direction and have a net shape or a frame shape.

In this configuration, it is possible to curb movement of the ink absorbing member even if the ink absorbing member is likely to move in any direction in the container main body.

According to yet another aspect of the invention, there is provided an ink absorbing structure including: the ink absorbing member accommodation container according to the invention and an ink absorbing member that is accommodated in the accommodation space and that includes water-absorbable resin capable of absorbing ink.

In this configuration, the insertion members are inserted into the ink absorbing member and are brought into a state in which the insertion members are engaged and in contact with the ink absorbing member. In such a state, movement of the ink absorbing member in the container main body (accommodation space) is curbed even if the ink absorbing member is dried and contracts after absorbing the ink. In this manner, the ink absorbing member can be continuously located at the ink dropping locations and can thus quickly and sufficiently absorb the ink.

According to yet another aspect of the invention, there is provided an ink absorbing member accommodation container accommodating an ink absorbing member including water-absorbable resin capable of absorbing ink, and at least a part of the ink absorbing member accommodation container has ultraviolet screening properties.

In this configuration, it is possible to prevent or curb irradiation of the ink absorbing member accommodated in the ink absorbing member accommodation container with ultraviolet rays. Therefore, it is possible to prevent the ink absorbing member in the ink absorbing member accommodation container from deteriorating due to irradiation with ultraviolet rays. As a result, it is possible to maintain excellent water absorption performance and water retention performance of the ink absorbing member.

It is preferable that the ink absorbing member accommodation container further include: a container main body having an accommodation space for accommodating the ink absorbing member; and a cover member screening the accommodation space, and at least either the container main body or the cover member has ultraviolet screening properties.

In this configuration, it is possible to prevent or curb irradiation of the ink absorbing member accommodated in the ink absorbing member accommodation container with ultraviolet rays.

It is preferable that the ink absorbing member accommodation container further include an ultraviolet screening layer that is provided on a surface of at least either the container main body or the cover member and that includes an ultraviolet screener absorbing or reflecting and screening ultraviolet rays.

In this configuration, it is possible to prevent or curb irradiation of the ink absorbing member accommodated in the ink absorbing member accommodation container with ultraviolet rays.

In the ink absorbing member accommodation container, it is preferable that the ultraviolet screening layer be exposed to an outside of the ink absorbing member accommodation container.

In this configuration, it is possible to appropriately select the location at which the ultraviolet screening layer is provided in accordance with the configuration of the device on which the ink absorbing member accommodation container is mounted.

In the ink absorbing member accommodation container, it is preferable that at least either the container main body or the cover member be a molded article obtained by molding a material including an ultraviolet screener absorbing or reflecting and screening ultraviolet rays.

In this configuration, it is possible to omit an operation of laminating the ultraviolet screening layer on the surface of the container.

In the ink absorbing member accommodation container, it is preferable that the ultraviolet screener be an ultraviolet absorbing agent.

In this configuration, it is easy to sufficiently secure visible light permeability of the ink absorbing member accommodation container.

In the ink absorbing member accommodation container, it is preferable that the container main body have an inner container with flexibility and a hard outer container located outside the inner container, and that the inner container have ultraviolet screening properties.

In this configuration, it is possible to prevent irradiation of the ink absorbing member with ultraviolet rays during an operation of throwing out the ink absorbing member along with the inner container.

In the ink absorbing member accommodation container, it is preferable that the cover member have water vapor permeability.

In this configuration, it is possible to cause moisture of the ink absorbed by the ink absorbing member to permeate. As a result, it is possible to increase the amount of ink that the ink absorbing member can absorb.

According to a yet another aspect of the invention, there is provided an ink absorbing structure including: the ink absorbing member accommodation container according to the invention; and an ink absorbing member that is accommodated in the ink absorbing member accommodation container and that includes a water-absorbable resin capable of absorbing ink.

In this configuration, it is possible to prevent or curb irradiation of the ink absorbing member accommodated in the ink absorbing member accommodation container with ultraviolet rays. Therefore, it is possible to prevent the ink absorbing member in the ink absorbing member accommodation container from deteriorating due to irradiation with ultraviolet rays. As a result, it is possible to maintain excellent water absorption performance and water retention performance of the ink absorbing member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink absorber according to the embodiment will be described in detail based on preferred embodiments illustrated in the accompanying drawings.

First Embodiment

Figure 1:
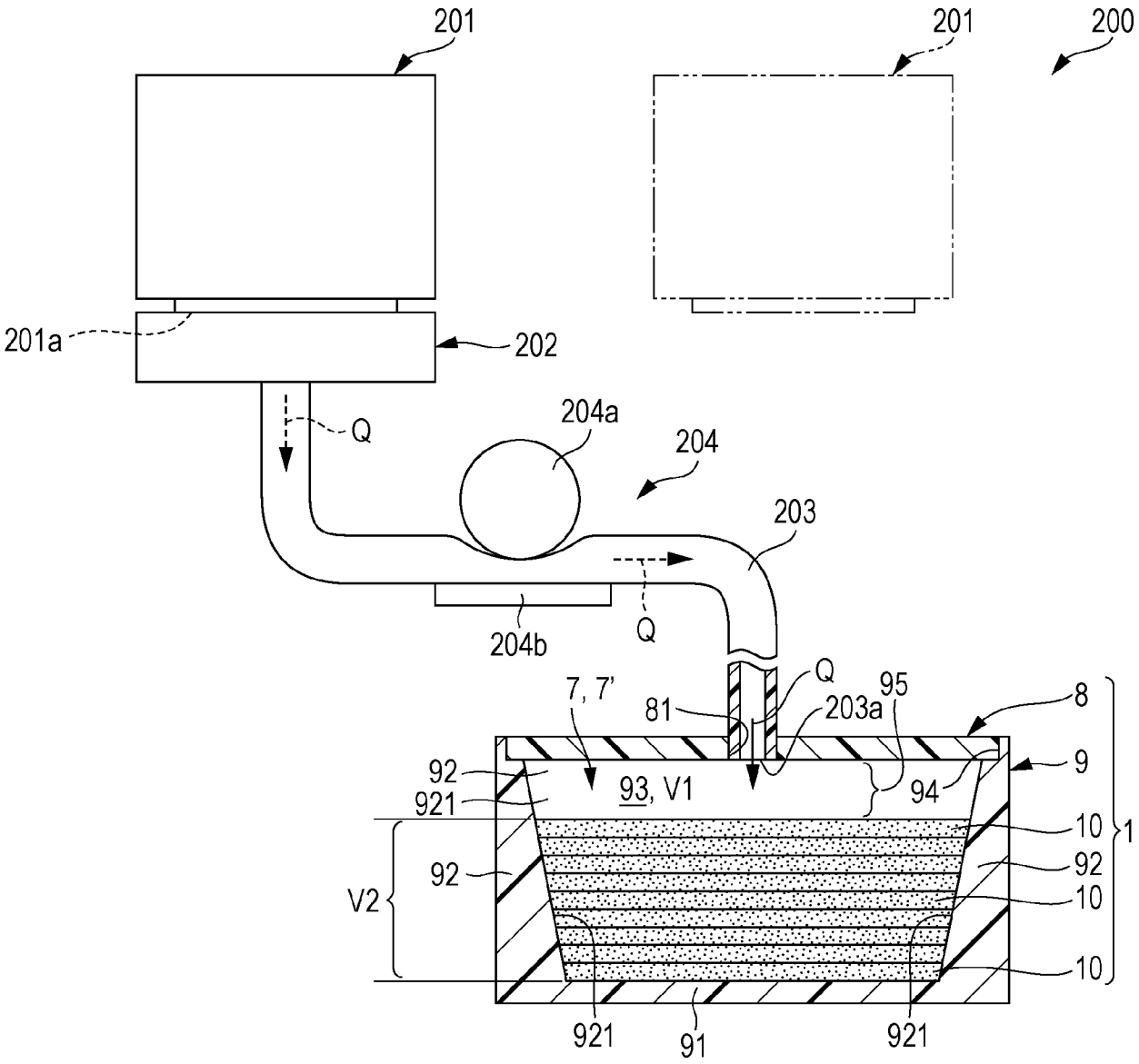
FIG. 1 is a partial vertical sectional view illustrating a state (example) in which an ink absorber (first embodiment) according to the invention is used.

FIG. 1 is a partial vertical sectional view illustrating a state (example) in which an ink absorber (first embodiment) of the invention is used. FIGS. 2 to 5 are vertical sectional views that each illustrate a process of replacing an ink absorbing member in the ink absorber illustrated in FIG. 1. FIG. 6 is an enlarged detailed vertical sectional view of the ink absorbing member included in the ink absorber illustrated in FIG. 1. Note that the upper side in FIGS. 1 to 6 (the same also applies to FIGS. 7 to 20) will be referred to as "upward (or above)" and the lower side will be referred to as "downward (or below)" in the following description for convenience of explanation.

As illustrated in FIG. 1, an ink absorber 1 according to the embodiment includes ink absorbing members 10 that are capable of absorbing ink Q, a container main body 9 that serves as an accommodation section accommodating the ink absorbing members 10, and a detachment structure section 7 that detaches the ink absorbing members 10 from the container main body 9 (accommodation section).

The ink absorber 1 according to the invention includes the ink absorbing members 10 that are capable of absorbing the ink Q, the container main body 9 that serves as the accommodation section accommodating the ink absorbing members 10, and an assist structure section 7' that assists removal of the ink absorbing members 10 when the ink absorbing members 10 are removed (detached) from the container main body 9 (accommodation section).

According to the invention, the ink absorber 1 is configured such that the ink absorbing members 10 after use that have reached an absorption limit of the ink Q can be easily detached from the container main body 9 with a detachment structure section 7 (assist structure section 7') when it is desired to replace the ink absorbing members 10 with new unused ink absorbing members 10 as will be described later. Then, it is possible to accommodate the unused ink absorbing members 10 in the vacant container main body 9 and to reuse the ink absorber 1. In this manner, the ink absorber 1 is configured such that it is possible to easily perform a replacement operation of the ink absorbing members 10 and thereby to improve operability thereof.

Note that "water absorption" described in the specification means that water-based ink obtained by dissolving a coloring material in a water-based solvent is absorbed of course, and it also means that general ink such as solvent-based ink obtained by dissolving a binder in a solvent, UV-curable ink obtained by dissolving a binder in a monomer in the form of liquid that is cured by UV irradiation, and latex ink obtained by dissolving a binder in a dispersing medium is absorbed.

A print apparatus 200 illustrated in FIG. 1 is an ink jet-type color printer, for example. The print apparatus 200 includes an ink ejection head 201 that ejects the ink Q, a capping unit 202 that prevents clogging of nozzles 201*a* of the ink ejection head 201, a tube 203 that couples the capping unit 202 to the ink absorber 1, and a roller pump 204 that feeds the ink Q from the capping unit 202 to the ink absorber 1.

The ink ejection head 201 has a plurality of nozzles 201*a* that eject the ink Q downwardly. The ink ejection head 201 can perform printing (see the ink ejection head 201 illustrated by the two-dotted chain line in FIG. 1) by ejecting the ink Q while moving relative to a recording medium (not illustrated) such as a PPC sheet.

The capping unit 202 prevents clogging of the nozzles 201*a* by collectively suctioning the respective nozzles 201*a* through an operation of the roller pump 204 when the ink ejection head 201 is at a stand-by location.

The tube 203 is configured such that the ink Q suctioned via the capping unit 202 passes therethrough toward the ink absorber 1. The tube 203 has flexibility.

The roller pump 204 is disposed in a midpoint of the tube 203 and has a roller section 204*a* and a pinching section 204*b* that pinches the midpoint of the tube 203 with the roller section 204*a*. Suctioning force is generated in the capping unit 202 via the tube 203 by the roller section 204*a* rotating. The ink Q adhering to the nozzles 201*a* can be fed to the ink absorber 1 by the roller section 204*a* continuously rotating. Then, the ink Q is absorbed by the ink absorber 1 as waste liquid. Note that ink with various colors is included in the ink Q.

As illustrated in FIG. 1, the ink absorber 1 includes the ink absorbing members 10 that are accommodated in the container main body 9. The ink absorber 1 is detachably attached to the print apparatus 200 and is used to absorb the waste liquid of the ink Q as described above in the attached state. In this manner, it is possible to use the ink absorber 1 as a so-called "waste liquid tank (waste ink tank)". If the amount of the ink Q absorbed by the ink absorbing members 10 reaches a limit, it is possible to replace the ink absorbing members 10 with new (unused) ink absorbing members 10. Note that whether or not the amount of the ink Q absorbed by the ink absorbing members 10 has reached the limit is detected by a detection unit (not illustrated) in the print apparatus 200. If the amount of the ink Q absorbed by the ink absorbing members 10 has reached the limit, a notification section such as a monitor that is incorporated in the print apparatus 200 provides a notification of the fact, for example.

The ink absorbing members 10 are used to absorb the ink Q in the container main body 9. As illustrated in FIG. 1, the ink absorbing members 10 are formed into a sheet shape and are accommodated in an accommodation space 93 of the container main body 9 in a state in which a plurality of ink absorbing members 10 are laminated. In this manner, absorption performance of the ink absorber 1 absorbing the ink Q increases as the number of ink absorbing members 10 increases.

As illustrated in FIG. 6, the ink absorbing members 10 include a fiber base material 230 that is formed into a sheet shape with fiber 20 and a water-absorbable resin 30 adhering to (retained by) the fiber base material 230. In this manner, it is possible to sufficiently absorb the ink Q.

The water-absorbable resin 30 adheres to at least one surface side (a front surface 210 and the rear surface 220 in the configuration illustrated in FIG. 6) of the fiber base material 230. In this manner, even if the ink Q reaches either the side of the front surface 210 or the side of the rear surface 220 of each ink absorbing member 10, it is possible to absorb the ink Q with the water-absorbable resin 30. Since the water-absorbable resin 30 is brought into a state in which the water-absorbable resin 30 is exposed to the fiber base material 230, it is possible to quickly absorb the ink Q with the water-absorbable resin 30.

Note that although the amounts of the adhering water-absorbable resin 30 are preferably equal to each other on the side of the front surface 210 and on the side of the rear surface 220, the amounts of the adhering water-absorbable resin 30 may differ from each other.

In addition, although the water-absorbable resin 30 is preferably uniformly arranged and dispersed on both the side of the front surface 210 and the side of the rear surface 220, the dispersion may be sparse or dense.

Although the degree of dispersion of the water-absorbable resin 30 on the side of the front surface 210 is more preferably the same as the degree of dispersion of the water-absorbable resin 30 on the side of the rear surface 220, the degrees may differ from each other.

When the ink Q is applied to the ink absorbing members 10 by the fiber 20, the fiber 20 can once hold the ink Q, the water-absorbable resin 30 can then efficiently feed the ink Q, and ink Q absorbability of the entire ink absorbing members 10 can be improved. Also, fiber such as cellulose fiber (particularly, fiber derived from old paper) is typically more reasonable as compared with the water-absorbable resin 30 and is advantageous in terms of reduction of manufacturing cost of the ink absorbing members 10. Since fiber derived from old paper can suitably be used as the fiber 20, the fiber 20 is also advantageous in terms of reduction of waste, effective utilization of resources, and the like.

Examples of the fiber 20 include: synthesis resin fiber such as polyester fiber and polyamide fiber; natural resin fiber such as cellulose fiber, keratin fiber, and fibroin fiber and chemically modified products thereof, and the fiber can be used alone or can appropriately be mixed and used. However, the resin preferably contains cellulose fiber as a main constituent, and it is more preferable that substantially entire fiber be cellulose fiber.

Since cellulose is a material that has suitable hydrophilicity, the ink absorbing members 10 can suitably take the ink Q when the ink Q is applied to the ink absorbing members 10, can quickly get out from a state in which liquidity is particularly high (a state in which viscosity is equal to or less than 10 mPa·s, for example), and can suitably feed the ink Q that the ink absorbing members 10 have once taken to the water-absorbable resin 30. As a result, it is possible to obtain particularly excellent properties of absorbing and holding the ink Q of all the ink absorbing members 10. Since cellulose typically has high affinity with the water-absorbable resin 30, it is possible to cause the surface of the fiber 20 to more suitably retain the water-absorbable resin 30. Since cellulose fiber is a reproducible natural material and is available at low cost from among various kinds of fiver, the cellulose fiber is advantageous in terms of reduction of production cost of the ink absorbing members 10, stable production, reduction of an environmental burden, and the like.

Note that in the specification, the cellulose fiber may be any fiber that contains cellulose in the form of a compound (cellulose in a narrow sense) as a main constituent and that has a fiber shape, and fiber that contains hemicellulose or lignin in addition to cellulose (cellulose in a narrow sense) may be employed.

The fiber 20 may be included in the ink absorbing members 10 in a cotton shape or may be formed into a sheet shape, a strip shape, a small piece, or a mixed shape thereof, or a plurality of types of fiber may be disposed in separate regions in the ink absorbing member 10.

As a raw material of the fiber 20, old paper may be used, for example. This leads to the aforementioned advantages and is preferable in terms of saving of resources. When old paper is used as a raw material of the fiber 20, the old paper may be used as it is, a crushed product obtained by performing crushing processing or a fiber-separated product obtained by fiber separation processing may be used.

Although an average length of the fiber 20 is not particularly limited, the average length is preferably equal to or greater than 0.1 mm and equal to or less than 7 mm, is more preferably equal to or greater than 0.1 mm and equal to or less than 5 mm, and is further preferably equal to or greater than 0.1 mm and equal to or less than 3 mm.

Although an average width (diameter) of the fiber 20 is not particularly limited, the average width is preferably equal to or greater than 0.5 μm and equal to or less than 200

μm and is more preferably equal to or greater than 1.0 μm and equal to or less than 100 μm.

Although an average aspect ratio (a ratio of the average length with respect to the average width) of the fiber 20 is not particularly limited, the average aspect ratio is preferably equal to or greater than 10 and equal to or less than 1000 and is more preferably equal to or greater than 15 and equal to or less than 500.

If the numerical range as described above is satisfied, it is possible to more suitably perform retention of the water-absorbable resin 30, holding of the ink Q with the fiber 20, and feeding of the ink Q to the water-absorbable resin 30 and thereby to achieve more excellent ink absorbability of the entire ink absorbing members 10.

Although the water-absorbable resin 30 may be any resin with water absorbability and is not particularly limited, examples thereof include carboxymethyl cellulose, polyacrylic acid, polyacrylamide, a starch-acrylic acid graft copolymer, a hydrolysate of a starch-acrylonitrile graft copolymer, vinyl acetate-acrylic acid ester copolymer, a copolymer or the like of isobutylene and maleic acid, a hydrolysate of an acrylonitrile copolymer or an acrylamide copolymer, a polyethylene oxide, a polysulfone acid-based compound, a polyglutamic acid, salts (neutralized product) thereof, and crosslinked products. Here, the water absorbability means a function of holding moisture with hydrophilicity. Many kinds of water-absorbable resin 30 experience gelation if the water-absorbable resin 30 absorbs water.

Among them, resin that has a functional group in a side chain is preferably used as the water-absorbable resin 30. Examples of the functional group include an acid group, a hydroxyl group, an epoxy group, and an amino group.

In particular, the water-absorbable resin 30 is preferably resin that has an acid group in a side chain and is more preferably resin that has a carboxyl group in a side chain.

Examples of a unit containing a carboxyl group that forms the water-absorbable resin 30 include an acrylic acid, a methacrylic acid, an itaconic acid, a maleic acid, a crotonic acid, a fumaric acid, a sorbic acid, a cinnamic acid, and derivatives from monomers thereof such as anhydrides and salts.

When the water-absorbable resin 30 that has an acid group in a side chain is included, a proportion of a substance that is neutralized and forms a salt in the acid group included in the water-absorbable resin 30 is preferably equal to or greater than 30 mol % and equal to or less than 100 mol %, is more preferably equal to or greater than 50 mol % and equal to or less than 95 mol %, is further preferably equal to or greater than 60 mol % and equal to or less than 90 mol %, and is most preferably equal to or greater than 70 mol % and equal to or less than 80 mol %. In this manner, it is possible to achieve more excellent ink Q absorbability of the water-absorbable resin 30 (ink absorbing members 10).

Although the type of the neutralized salt is not particularly limited, and examples thereof include alkali metal salts such as a sodium salt, a potassium salt, and a lithium salt, and salts of nitrogen-containing basic products such as ammonia, a sodium salt is preferably used. In this manner, it is possible to achieve more excellent ink Q absorbability of the water-absorbable resin 30 (ink absorbing members 10).

The water-absorbable resin 30 that has an acid group in a side chain is preferably used since electrostatic repulsion occurs between acid groups during absorption of the ink and the absorption speed increases. Also, if the acid group is neutralized, the ink Q is easily absorbed into the water-absorbable resin 30 due to an osmotic pressure.

The water-absorbable resin 30 has a configuration unit that does not contain an acid group, and examples of such a configuration unit include a hydrophilic configuration unit, a hydrophobic configuration unit, and a configuration unit that serves as a polymerizable crosslinking agent.

Examples of the hydrophilic configuration unit includes configuration units derived from nonionic compounds such as acrylamide, methacrylamide, N-ethyl(meth)acrylamide, N-n-propyl(meth)acrylamide, N-isopropyl(meth)acrylamide, N,N-dimethyl(meth)acrylamide, 2-hydroxyethyl (meth) acrylate, 2-hydroxypropyl (meth)acrylate, methoxypolyethylene glycol (meth)acrylate, polyethylene glycol mono (meth)acrylate, N-vinylpyrrolidone, N-acryloylpiperidine, and N-acryloylpyrrolidine.

Examples of the hydrophobic configuration unit include configuration units derived from compounds such as (meth) acrylonitrile, styrene, vinyl chloride, butadiene, isobutene, ethylene, propylene, stearyl (meth)acrylate, and lauryl (meth) acrylate.

Examples of the configuration unit that serves as the polymerizable crosslinking agent include configuration units derived from diethylene glycol diacrylate, N,N'-methylene bis acrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanuric acid diacrylate, tetraallyloxyethane, a diallyloxyacetic salt.

The water-absorbable resin 30 preferably contains a polyacrylic acid salt copolymer or a polyacrylic acid polymerization crosslinked body. This is advantageous in terms of an improvement of ink Q absorption performance, manufacturing cost reduction, and the like.

A proportion of a configuration unit that has a carboxyl group with respect to all the configuration units that form a molecular chain in the polyacrylic acid polymerization crosslinked body is preferably equal to or greater than 50 mol %, is more preferably equal to or greater than 80 mol %, and is further preferably equal to or greater than 90 mol %.

If the proportion of the configuration unit containing the carboxyl group is excessively low, there is a probability that it becomes difficult to achieve sufficiently excellent ink Q absorption performance.

A part of the carboxyl group in the polyacrylic acid polymerization crosslinked body is preferably neutralized (partially neutralized) and forms a salt.

A proportion of a neutralized product with respect to the entire carboxyl group in the polyacrylic acid polymerization crosslinked body is preferably equal to or greater than 30 mol % and equal to or less than 99 mol %, is more preferably equal to or greater than 50 mol % and equal to or less than 99 mol %, and is further preferably equal to or greater than 70 mol % and equal to or less than 99 mol %.

In addition, the water-absorbable resin 30 may have a structure crosslinked with a crosslinking agent other than the aforementioned polymerizable crosslinking agent.

When the water-absorbable resin 30 is resin that has an acid group, a compound that has a plurality of functional groups that react with the acid group, for example, can preferably be used as the crosslinking agent.

When the water-absorbable resin 30 is resin that has a functional group that reacts with the acid group, a compound that has a plurality of functional groups that react with the acid group in a molecule can preferably be used as the crosslinking agent.

Examples of the compound (crosslinking agent) that has a plurality of functional groups that react with an acid group include: glycidyl ether compounds such as ethylene glycol diglycidyl ether, trimethylolpropane triglycidyl ether, (poly) glycerine polyglycidyl ether, diglycerine polyglycidyl ether, and propylene glycol diglycidyl ether; polyvalent alcohols such as (poly)clycerine, (poly)ethylene glycol, propylene glycol, 1,3-propanediol, polyoxyethylene glycol, triethylene glycol, tetraethylene glycol, diethanolamine, and triethanolamine; and polyvalent amines such as ethtylenediamine, diethylenediamine, polyethyleneimine, and hexamethylenediamine. In addition, polyvalent ions such as zinc, calcium, magnesium, and aluminum can also suitably be used since they react with the acid group that the water-absorbable resin 30 has and function and crosslinking agents.

Although the water-absorbable resin 30 may have any shape such as a scale shape, a needle shape, a fiber shape, or a particle shape, the water-absorbable resin 30 preferably has a particle shape. In a case in which the water-absorbable resin 30 has a particle shape, it is possible to easily secure ink Q permeability. Also, it is possible to cause the fiber base material 230 (fiber 20) to suitably retain the water-absorbable resin 30. Note that the average particle diameter of the particles is preferably equal to or greater than 15 μm and equal to or less than 800 μm, and is more preferably equal to or greater than 15 μm and equal to or less than 400 μm, and is further preferably equal to or greater than 15 μm and equal to or less than 50 μm.

Note that as the average particle diameter of the particles, a volume average grain size mean volume diameter (MVD) measured by a laser diffraction-type grain size distribution measurement apparatus, for example, can be used. The grain size distribution measurement apparatus that employs a laser diffraction and scattering method as a measurement principle, that is, a laser diffraction-type grain size distribution measurement apparatus can measure grain size distribution on the basis of the volume.

In addition, the content of the water-absorbable resin 3 with respect to the fiber base material 2 is preferably greater than 5% by weight and equal to or less than 90% by weight, is more preferably equal to or greater than 20% by weight and equal to or less than 70% by weight, and is further preferably equal to or greater than 40% by weight and equal to or less than 55% by weight.

In addition, when the average particle diameter of the water-absorbable resin 3 is assumed to D [μm] and the average length of the fiber is assumed to L [μm], the relationship of $0.15 \leq L/D \leq 467$ is preferably satisfied, the relationship of $0.25 \leq L/D \leq 333$ is more preferably satisfied, and the relationship of $2 \leq L/D \leq 200$ is further preferably satisfied.

In addition, the ink absorbing members 10 may include constituents other than those described above (other constituents). Examples of such constituents include a surfactant, a lubricant, an antifoaming agent, a filler, an antiblocking agent, an ultraviolet absorbing agent, a coloring agent such as a pigment or a dye, a flame retardant, and a fluidity improver.

Although the shape of each ink absorbing member 10 with the aforementioned configuration in a plan view is preferably a square (for example, a rectangular) shape in the embodiment, the shape is not limited thereto.

In addition, each ink absorbing member 10 may include an intermediate layer provided between the fiber base material 230 and the water-absorbable resin 30.

As illustrated in FIG. 6, a plurality of through-holes 240 that penetrate through the ink absorbing members 10 in the thickness direction are formed in the ink absorbing members 10. Each through-hole 240 can allow the ink Q to pass therethrough, that is, each through-hole 240 can secure liquid permeability of the ink Q. In this manner, the ink flowing downwardly in the container main body 9 is prevented from being held back by the ink absorbing members 10 in the course thereof, and it is thus possible to soak into a deep portion (bottom section 91) of the container main body 9. In this manner, it is possible to absorb the ink Q with each ink absorbing member 10 with neither excess nor deficiency and to hold the ink Q for a long term.

Note that the diameter of each through-hole 240 is not particularly limited, is preferably equal to or greater than 0.5 mm and equal to or less than 5 mm, and is more preferably equal to or greater than 1 mm and equal to or less than 3 mm, for example.

Also, the disposition density of the through-holes 240 may be uniform or vary in the plane direction of the ink absorbing members 10. Also, the through-holes 240 may be omitted.

As illustrated in FIG. 1, the ink absorber 1 includes the container main body 9 that has an accommodation space 93 for accommodating the ink absorbing members 10, a cover member 8 that is detachably attached to the container main body 9, and a detachment structure section 7 that detaches the ink absorbing members 10 from the container main body 9 (accommodation section).

The container main body 9 has a box shape that has a bottom section (bottom plate) 91 that has a square shape, for example, in a plan view and four side wall sections 92 that stands upwardly from the respective sides (edge sections) of the bottom section 91. In addition, the ink absorbing members 10 can be accommodated in the accommodation space 93 surrounded by the bottom section 91 and the four side wall sections 92.

Note that the container main body 9 is not limited to the container main body 9 has the bottom section 91 that has the square shape in a plan view, and a container main body 9 that has a bottom section 91 that has a circular shape in a plan view and that has a cylindrical shape as a whole, for example, may be employed.

When the volume of the container main body 9 (accommodation space 93) is assumed to be V1, and the total volume of the ink absorbing members 10 before absorbing the ink Q (before water absorption) is assumed to be V2, the ratio V2/V1 between V1 and V2 is preferably equal to or greater than 0.1 and equal to or less than 0.7 and is more preferably equal to or greater than 0.2 and equal to or less than 0.7 (see FIG. 1). In this manner, an air gap 95 is generated above the ink absorbing members 10 in the container main body 9. The ink absorbing members 10 are once expanded (swells) after absorbing the ink Q. The air gap 95 serves as a buffer when the ink absorbing members 10 are expanded, and the ink absorbing members 10 can thus sufficiently absorb the ink Q.

In the embodiment, the container main body 9 is hard, that is, the container main body 9 has shape retaining properties to such an extent that the volume V1 does not change by 10% or greater, for example, in a case in which an internal pressure or an external pressure acts on the container main body 9. In this manner, the container main body 9 can maintain the shape of the container main body 9 itself even if the ink absorbing members 10 are expanded after absorbing the ink Q and the container main body 9 receives, from the inside, force applied from the ink absorbing members 10. In this manner, the mounting state of the container main body 9 in the print apparatus 200 is stabilized, and the ink absorbing members 10 can stably absorb the ink Q.

A constituent material that forms the container main body 9 is not particularly limited as long as the container main body 9 is formed of a material that does not transmit the ink Q therethrough. As such a constituent material of the container main body 9, various resin materials such as cyclic polyolefin or polycarbonate, for example, can be used. In addition, various metal materials such as aluminum or stainless steel, for example, can be used in addition to the various resin materials as the constituent material of the container main body 9.

Note that the container main body 9 is not limited to a hard container main body, and the container main body 9 may be a container main body with flexibility (soft container main body), that is, the container main body 9 with the volume V1 that varies by 10% or greater may be used.

The container main body 9 may be either a transparent (including semi-transparent) container main body with inner visibility or a non-transparent container main body.

Although the plurality of ink absorbing members 10 are overlaid in a face down manner relative to the bottom section 91 in the accommodation space 93, the invention is not limited thereto. For example, the plurality of ink absorbing members 10 may stand up from the bottom section 91, or the ink absorbing members 10 that are placed in a face down manner and the standing ink absorbing members 10 may be present together.

As described above, the ink absorber 1 includes the cover member 8. As illustrated in FIG. 1, the cover member 8 has a plate shape and can be fitted (slightly fitted) into the upper opening section 94 of the container main body 9. It is possible to seal the upper opening section 94 in a liquid tight manner through the fitting. In this manner, it is possible to prevent the ink Q from flying outwardly even in a case in which the ink Q collides against the ink absorbing members 10 and jumps up when the ink Q is discharged from the tube 203 and falls. Therefore, it is possible to prevent the ink Q from adhering to and staining the surroundings of the ink absorber 1.

The tube 203 is connected to the center of the cover member 8, and the ink supply port (connection port) 81 that supplies the ink Q into the accommodation space 93 is formed. The ink supply port 81 is formed of a through-hole that penetrates through the cover member 8 in the thickness direction. Then, the end of the tube 203 on the downstream side (lower end) can be inserted into and connected to the ink supply port 81 (through-hole). At this time, the discharge port (opening section) 203*a* of the tube 203 faces a gravity direction (downward) along the side wall section of the ink absorbing structure 100. Note that the ink supply port 81 may be formed at a position deviating from the center of the cover member 8.

In addition, the cover member 8 may have absorbability with which the cover member 8 absorbs the ink Q or may have liquid repellency with which the cover member 8 repels the ink Q.

The thickness of the cover member 8 is not particularly limited, is preferably equal to or greater than 1 mm and equal to or less than 20 mm, and is more preferably equal to or greater than 8 mm and equal to or less than 10 mm. Note that the cover member 8 is not limited to the cover member with a plate shape within such a numerical range, and a cover member 8 with a thinner film shape (sheet shape) may also be used. In this case, the thickness of the cover member 8 is not particularly limited and is preferably equal to or greater than 10 μm and less than 1 mm, for example.

As described above, the container main body 9 (accommodation section) has a bottom section 91 and four side wall sections 92 that stand up from the bottom section 91. Also, inclined surfaces (tapered surfaces) 921 that are inclined relative to the bottom section 91 are formed inside the side wall sections 92. The distance (interval) between the inclined surfaces 921 of the facing side wall sections 92 gradually increases toward the upper side.

The ink absorber 1 includes a detachment structure section 7 that detaches the ink absorbing members 10 from the container main body 9. In the embodiment, the detachment structure section 7 is formed of these inclined surfaces 921. In this manner, it is possible to easily perform the replacement operation of the ink absorbing members 10, which will be described later, and thereby to improve operability thereof.

Note that although the inclination angle of each inclined surface 921 is constant in the upward-downward direction in the configuration illustrated in FIG. 1, the inclination angle is not limited thereto and may change in the upward-downward direction, for example.

Although the inclined surfaces 921 that serve as the detachment structure section 7 are preferably provided at all the side wall sections 92, the embodiment is not limited thereto, and the inclined surfaces 921 may be provided at a part of the side wall sections 92.

Next, a process of replacing the ink absorbing members 10 will be described with reference to FIGS. 1 to 5.

As illustrated in FIG. 1, if the ink absorber 1 is continuously used, that is, if the ink absorbing members 10 are caused to intermittently or continuously absorb the ink Q, the ink absorbing members 10 eventually reach an absorption limit of the ink Q. In this case, it is preferable to replace the ink absorbing members 10 after use with new unused ink absorbing members 10.

Figure 2:
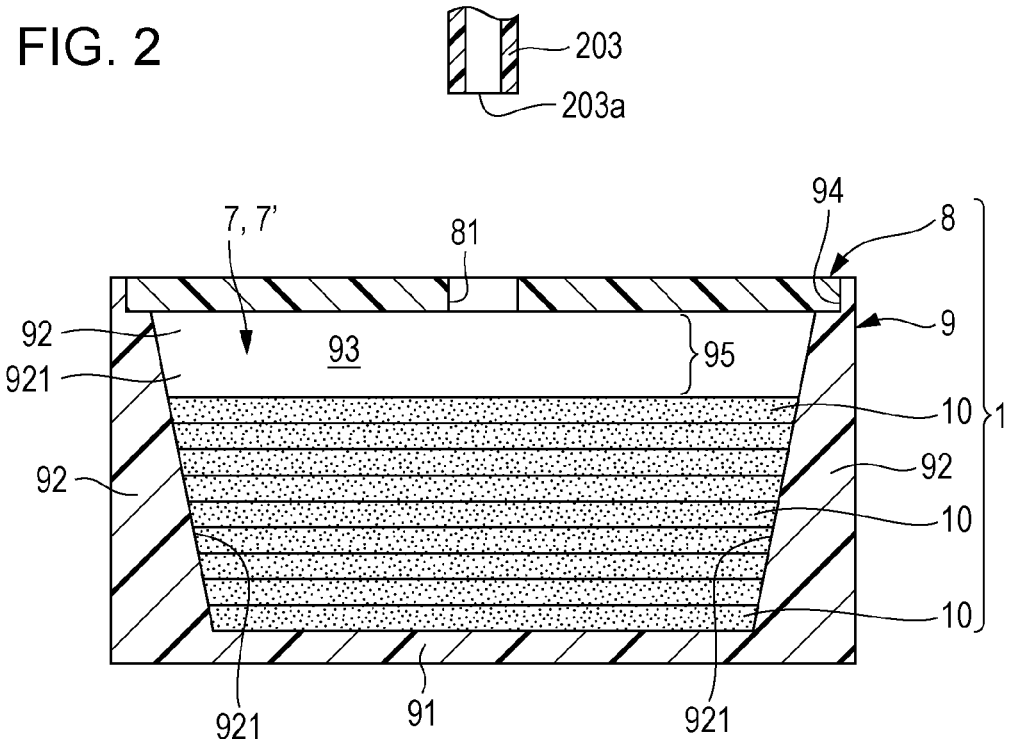
FIG. 2 is a vertical sectional view illustrating a process of replacing an ink absorbing member in the ink absorber illustrated in FIG. 1 in order.

When the replacement operation is performed, the tube 203 is pulled out of the ink supply port 81 of the ink absorber 1 first as illustrated in FIG. 2.

Figure 3:
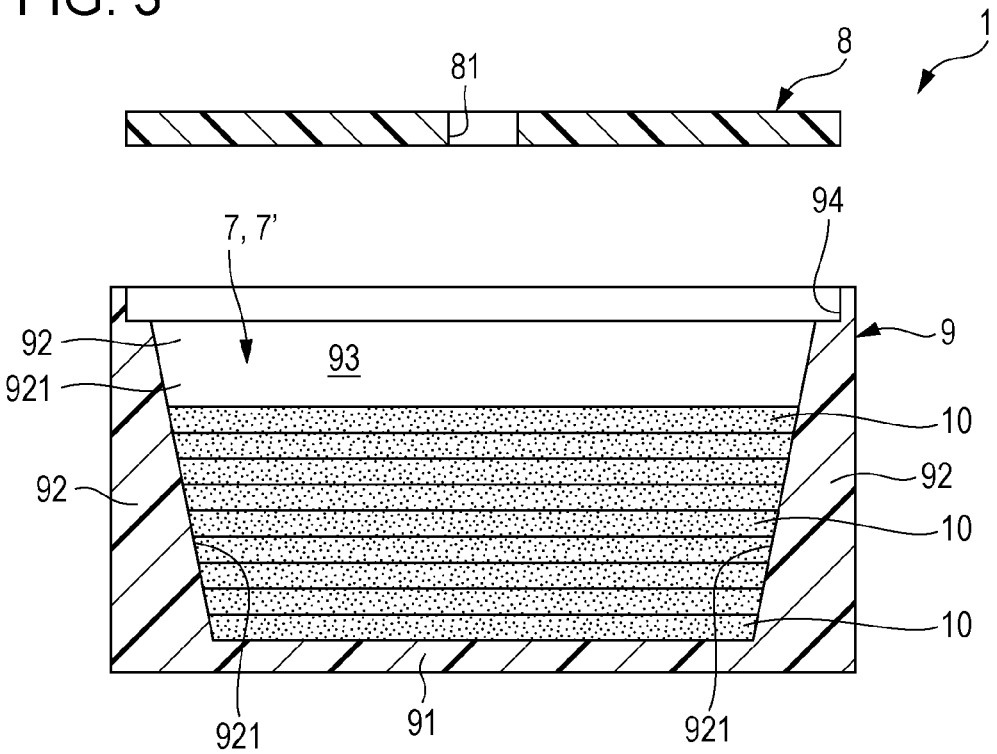
FIG. 3 is a vertical sectional view illustrating a process of replacing the ink absorbing member in the ink absorber illustrated in FIG. 1 in order.

Then, the cover member 8 is detached from the container main body 9 as illustrated in FIG. 3. Since the cover member 8 is in a state in which the cover member 8 is slightly inserted into the upper opening section 94 of the container main body 9 as described above, it is possible to easily perform the detachment operation from the container main body 9.

Figure 4:
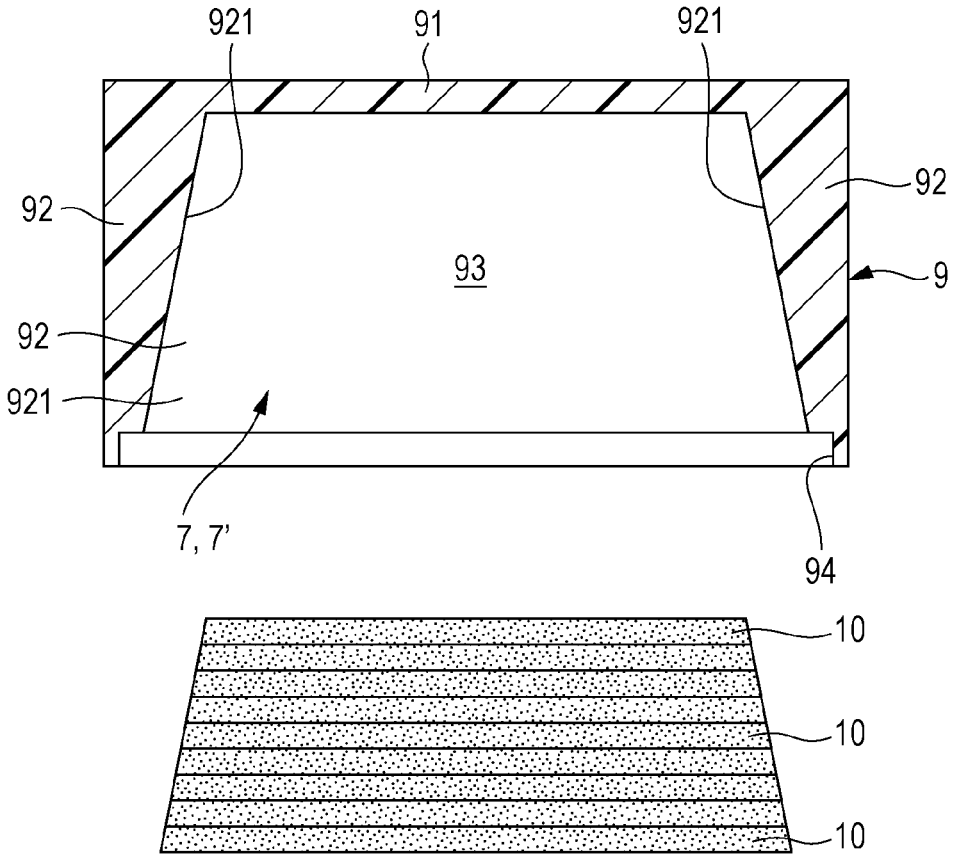
FIG. 4 is a vertical sectional view illustrating a process of replacing the ink absorbing member in the ink absorber illustrated in FIG. 1 in order.

Then, the container main body 9 is vertically inverted as illustrated in FIG. 4. In this manner, it is possible to detach the ink absorbing members 10 after use from the container main body 9. Also, the distance (interval) between the facing side wall sections 92 gradually increases toward the side of the upper opening section 94 due to the inclined surfaces 921 (detachment structure section 7) in the container main body 9. In this manner, the ink absorbing members 10 are easily detached from the container main body 9. Note that the detached ink absorbing members 10 are discarded.

Figure 5:
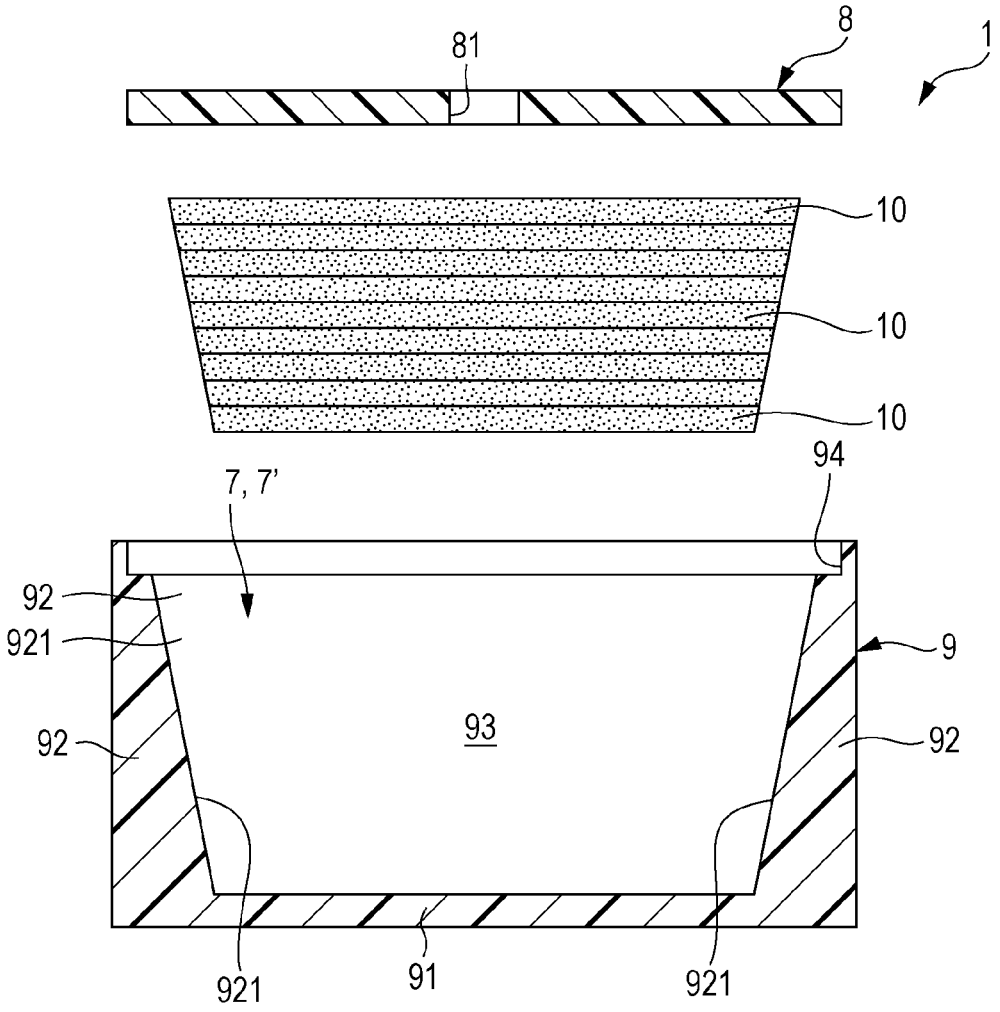
FIG. 5 is a vertical sectional view illustrating a process of replacing the ink absorbing member in the ink absorber illustrated in FIG. 1 in order.
Figure 6:
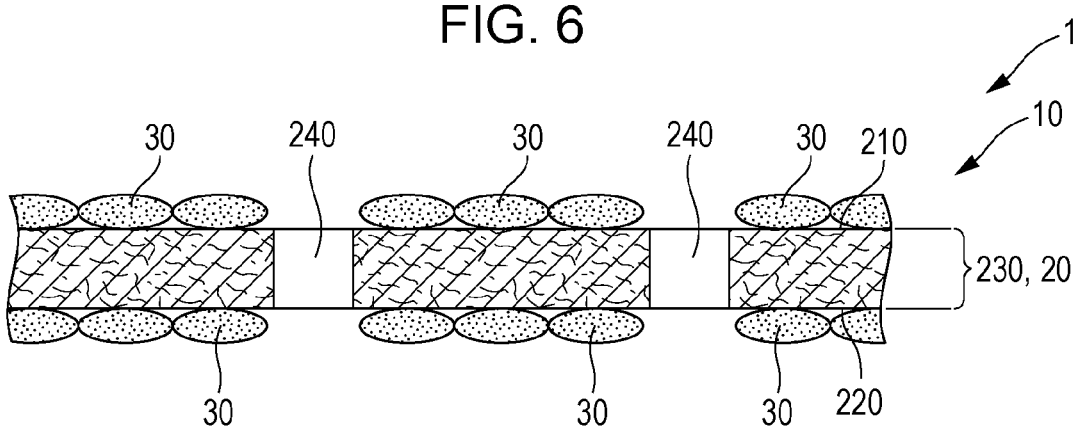
FIG. 6 is an enlarged detailed vertical sectional view of the ink absorbing member provided in the ink absorber illustrated in FIG. 1.

Then, new unused ink absorbing members 10 are prepared, and the ink absorbing members 10 are accommodated in the container main body 9, and the cover member 8 is attached to and assembled with the container main body 9 as illustrated in FIG. 5. In this manner, a reusable ink absorber 1 is obtained.

As described above, in a case in which it is desired to replace the ink absorbing members 10 after use that have reached the ink Q absorption limit with new unused ink absorbing members 10, it is possible to easily detach the ink absorbing members 10 after use from the container main body 9 with the detachment structure section 7 in the ink absorber 1. Then, the unused ink absorbing members 10 are accommodated in the vacant container main body 9, and the ink absorber 1 can be thus reused. In this manner, the ink absorber 1 is configured such that it is possible to easily to perform the replacement operation of the ink absorbing members 10 and thereby to improve operability thereof.

According to the invention (embodiment), it is also possible to state that the detachment structure section 7 is an "assist structure section 7'" that assists removal of the ink absorbing members 10 when the ink absorbing members 10 are removed (detached) from the container main body 9 (accommodation section). In this manner, it is possible to easily remove the ink absorbing members 10 after use and to replace the ink absorbing members 10 with new ink absorbing members 10 thereafter.

Second Embodiment

Figure 7:
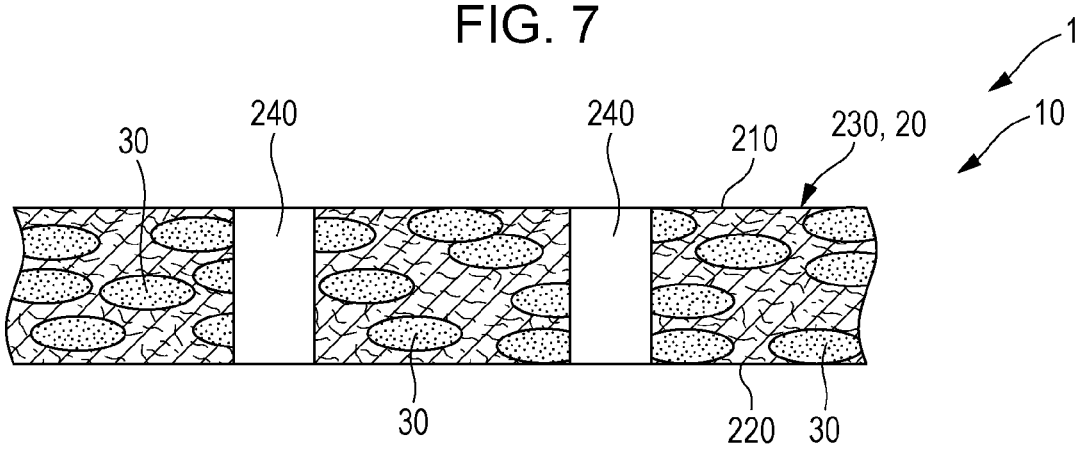
FIG. 7 is an enlarged detailed vertical sectional view of an ink absorbing member provided in an ink absorber (second embodiment) according to the invention.

FIG. 7 is an enlarged detailed vertical sectional view of an ink absorbing member included in an ink absorber (second embodiment) according to the invention.

The second embodiment of the ink absorber according to the invention will be described below with reference to the drawing, differences from the aforementioned embodiment will be mainly described, and description of similar matters will be omitted.

The embodiment is similar to the first embodiment other than that the configurations of the ink absorbing members differ from each other.

As illustrated in FIG. 7, the water-absorbable resin 30 is present in the midpoint of the fiber base material 230 in the thickness direction. That is, the water-absorbable resin 30 is present in the fiber base material 230 in a dispersed manner. In this manner, it is possible to hold (absorb) the ink Q on the center side of the ink absorbing member 10 in the thickness direction to the maximum extent and thereby to maintain the ink Q holding state for a long term. Also, it is possible to prevent the water-absorbable resin 30 from dropping out of (being detached from) the fiber base material 230.

Note that the water-absorbable resin 30 may be uniformly dispersed in the thickness direction or may be localized on the front surface 210 or the rear surface 220 of the fiber base material 230.

A combination with the configuration illustrated in FIG. 4 may be employed. That is, the water-absorbable resin 30 may also be present (adhere to) on a side of at least one surface (the front surface 210 or the rear surface 220) of the fiber base material 230.

Third Embodiment

Figure 8:
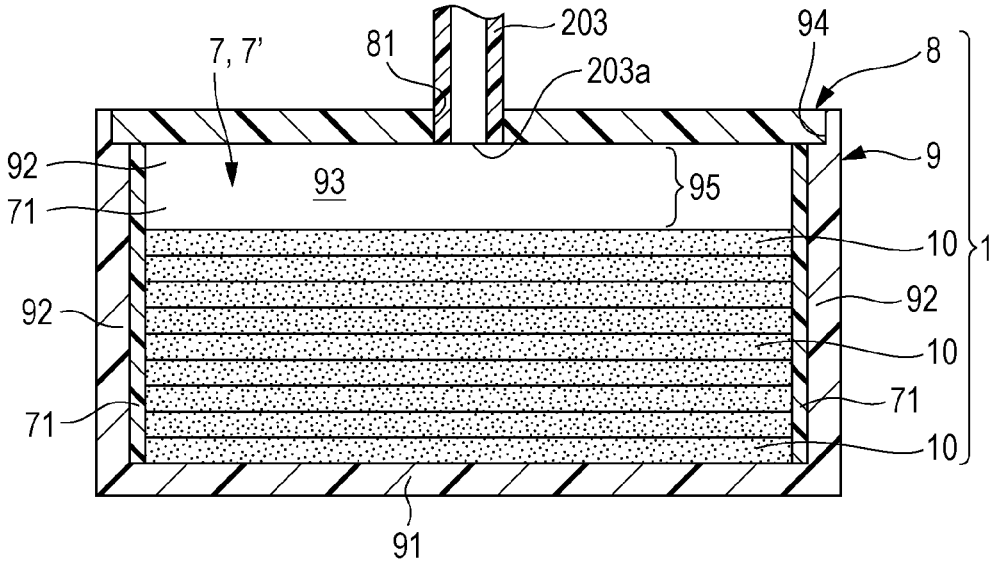
FIG. 8 is a vertical sectional view illustrating an ink absorber (third embodiment) according to the invention.

FIG. 8 is a vertical sectional view illustrating an ink absorber (third embodiment) according to the invention.

The third embodiment of the ink absorber according to the invention will be described below with reference to the drawing, differences from the aforementioned embodiment will be mainly described, and description of similar matters will be omitted.

The embodiment is similar to the first embodiment other than that the configurations of the detachment structure section (assist structure section) differ from each other.

As described above, the container main body 9 (accommodation section) has the bottom section 91 and the side wall sections 92 that stand up from the bottom section 91.

As illustrated in FIG. 8, the detachment structure section 7 (assist structure section 7') is formed of low friction layers 71 that are provided inside the respective side wall sections 92 of the container main body 9 and that reduce friction against the ink absorbing members 10 when the ink absorbing members 10 are detached from the container main body 9 (accommodation section) in the embodiment. In this manner, the ink absorbing members 10 are easily detached from the container main body 9, and it is thus possible to easily perform the replacement with the new ink absorbing members 10 thereafter.

Note that the low-friction material that forms the low friction layers 71 is not particularly limited, and various resin materials such as polytetrafluoroethylene, for example, can be used.

In addition, the low friction layers 71 may be formed of coated films obtained by applying the constituent material to the side wall sections 92 or may be formed by bonding films formed of the constituent material to the side wall sections 92.

Although the low friction layers 71 are preferably provided at all the side wall sections 92, the invention is not limited thereto, and the low friction layers 71 may be provided at a part of the side wall sections 92.

The inclined surfaces 921 described above in the first embodiment may be formed at the side wall sections 92. In this case, the low friction layers 71 are preferably formed on the inclined surfaces 921.

Fourth Embodiment

FIGS. 9 to 14 are vertical sectional views illustrating a process from a state in which an ink absorber (fourth embodiment) according to the invention is used to replacement of ink absorbing members, in order.

The fourth embodiment of the ink absorber according to the invention will be described with reference to these drawings, differences from the aforementioned embodiment will be mainly described, and description of similar matters will be described.

The embodiment is similar to the first embodiment other than the configurations of the detachment structure section (assist structure section) differ from each other.

As illustrated in FIGS. 9 to 14, the detachment structure section 7 (assist structure section 7') has a placement section 72 on which the plurality of ink absorbing members 10 are collectively placed in an overlaid manner and a gripping section 73 that is coupled to the placement section 72 and that is gripped when the ink absorbing members 10 are detached from the container main body 9 (accommodation section) in the embodiment.

The placement section 72 has a plate shape and is arranged such that the placement section 72 is overlaid on the bottom section 91 in the container main body 9. It is possible to collectively place the plurality of ink absorbing members 10 on the placement section 72 in an overlaid state.

The gripping section 73 is formed of a protrusion that is formed such that the protrusion projects upward from the center of the placement section 72. The gripping section 73 has a columnar shape with an outer diameter (cross sectional shape) that gradually decreases toward the upper side, that is, a conical shape in the embodiment. In this manner, the gripping section 73 is in a state in which the gripping section 73 sticks into the ink absorbing member 10 from the lower side, and engagement force against the ink absorbing members 10 increases. In this manner, positioning in the container main body 9 is performed. Also, the gripping section 73 is inserted into and passes through the plurality of ink absorbing members 10 in the overlaid state, and a top 731 is exposed from the ink absorbing members 10.

According to the detachment structure section 7 with such a configuration, it is possible to detach the gripping section 73 along with the ink absorbing members 10 from the container main body 9 (accommodation section) if the gripping section 73 is gripped and pulled out upward as it is when the ink absorbing members 10 are detached from the container main body 9 (accommodation section) as will be described later. In this manner, it is possible to easily replace the ink absorbing members 10.

Note that the gripping section 73 may be integrally formed with the placement section 72 or may be configured separately from the placement section 72 and may be obtained by bonding the separate body to the placement section 72.

In addition, although the number of formed protrusions that form the gripping section 73 is one in the embodiment, the number is not limited thereto and may be equal to or greater than two, for example.

Incidentally, the ink absorbing members 10 are once expanded after absorbing the ink Q and are then dried with time. Then, only the dried part of the ink absorbing member 10 contracts. At this time, the ink absorbing members 10 tend to contact from the portion in contact with the container main body 9, that is, from the side of the side wall sections 92 of the container main body 9 (see FIG. 10). The ink absorbing members 10 that have contracted cause a gap 101 between the ink absorbing members 10 and the side wall sections 92. There is a risk that the ink absorbing members 10 tend to move in the container main body 9 due to oscillation or the like during printing performed by the print apparatus 200, for example, depending on the size of the gap 101, and as a result, the ink absorbing members 10 are not located at the ink Q dropping locations. In this case, there is a concern that disadvantages that it is not possible to quickly absorb the ink Q with the ink absorbing members 10, that it is not possible to sufficiently absorb the ink Q, and the like occur.

Thus, the ink absorber 1 is configured to solve such disadvantages. Hereinafter, the configuration and effects will be described.

As described above, each ink absorbing member 10 contracts with a decrease in water content, that is, each ink absorbing member 10 contracts when the ink absorbing member 10 is dried after absorbing the ink Q.

In addition, the gripping section 73 is collectively inserted into the plurality of ink absorbing members 10, is brought into contact with the respective ink absorbing members 10, and is brought into a state in which the gripping section 73 is engaged with the respective ink absorbing members 10 (hereinafter, this state will be referred to as an "engaged state").

Then, although the gap 101 occurs between the ink absorbing members 10 that have contracted and the side wall sections 92, and the ink absorbing members 10 are considered to be likely to move in the container main body 9, the movement thereof in the container main body 9 is curbed (restricted) due to the gripping section 73 in the engaged state. The gripping section 73 has a function of curbing the movement of the ink absorbing members 10 in the container main body 9 (accommodation section) with the contraction of the ink absorbing members 10 in a state before the ink absorbing members 10 are detached from the container main body 9 (accommodation section). In this manner, the ink absorbing members 10 can continuously be located at the ink Q dropping locations even if the ink absorbing members 10 contract and can thus quickly and sufficiently absorb the ink Q.

Figure 9:
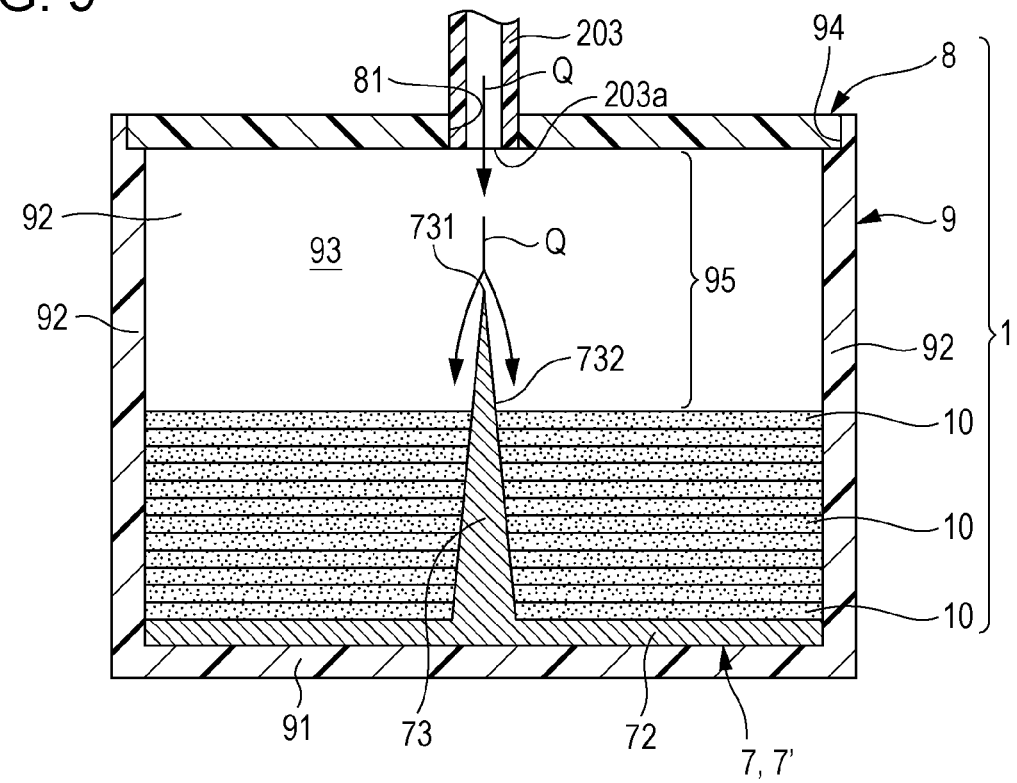
FIG. 9 is a vertical sectional view illustrating a process from a state in which an ink absorber (fourth embodiment) according to the invention is used to replacement of ink absorbing members in order.
Figure 10:
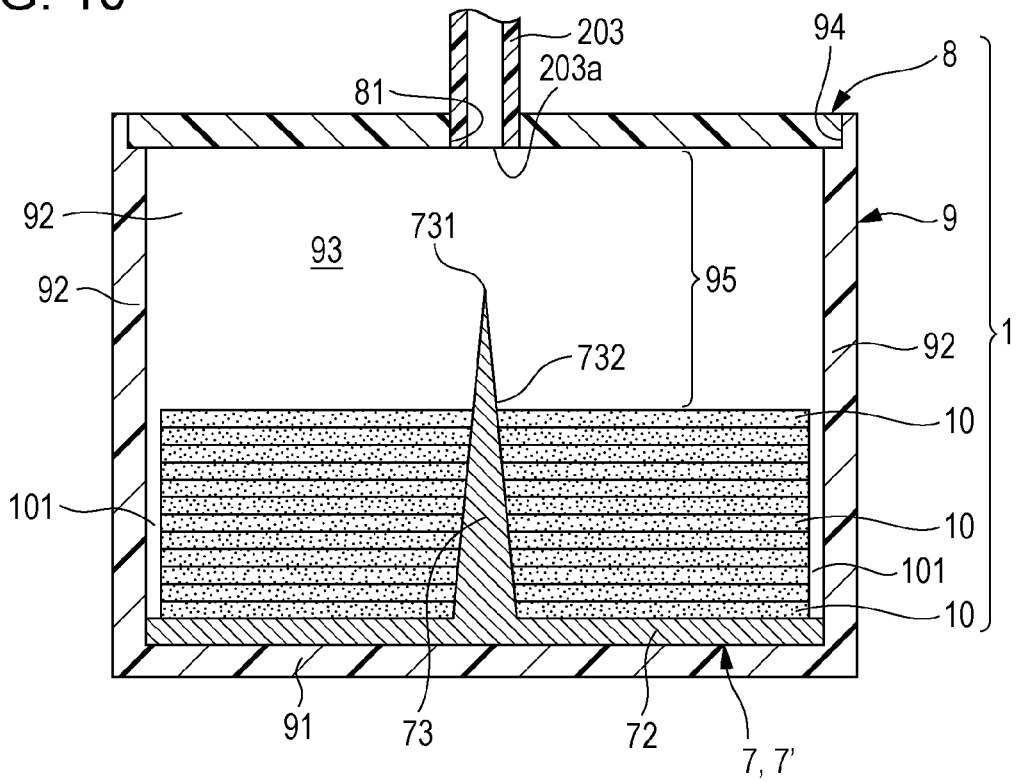
FIG. 10 is a vertical sectional view illustrating the process from the state in which the ink absorber (fourth embodiment) according to the invention is used to the replacement of the ink absorbing members in order.

As described above, the gripping section 73 is inserted into the ink absorbing members 10 and is brought into contact with the ink absorbing members 10. The gripping section 73 is located on the extension of the supply direction (dropping direction) in which the ink Q is supplied from the ink supply port 81. Also, the top 731 of the gripping section 73 is exposed from the ink absorbing member 10. In this manner, the ink Q supplied from the ink supply port 81 can be delivered through the outer peripheral section 732 of the gripping section 73 and can be guided to the furthest side of the ink absorbing member 10 as illustrated in FIG. 9. In this manner, the gripping section 73 has a liquid guiding function of guiding the ink Q to the ink absorbing members 10 in a state before the ink absorbing member 10 are detached from the container main body 9 (accommodation section). In this manner, it is possible to sufficiently absorb (impregnate) the ink Q up to the furthest side of the ink absorbing members 10 and thereby to exhibit the ink absorption function of the ink absorbing members 10 with neither excess nor deficiency for a long term.

Next, a process of replacing the ink absorbing members 10 will be described with reference to FIGS. 11 to 14.

Figure 11:
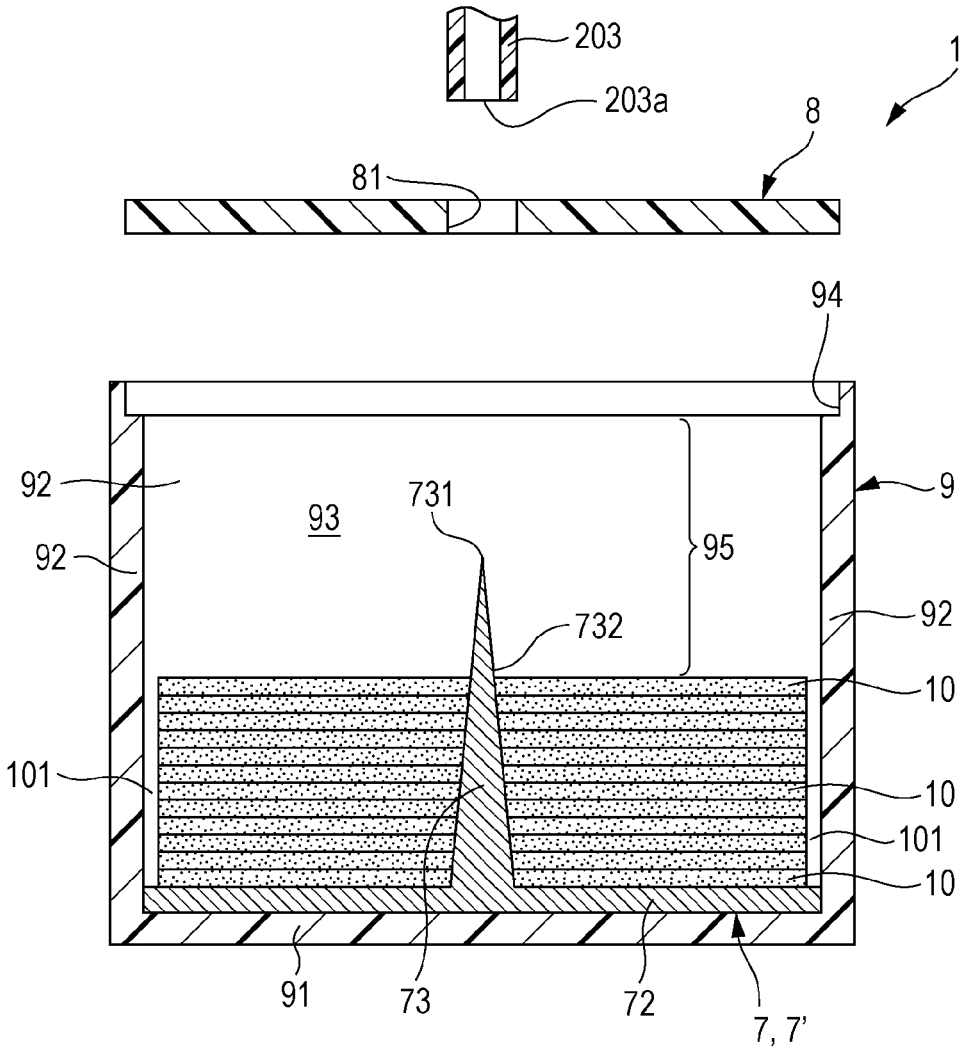
FIG. 11 is a vertical sectional view illustrating the process from the state in which the ink absorber (fourth embodiment) according to the invention is used to the replacement of the ink absorbing members in order.

As illustrated in FIG. 11, the tube 203 is pulled out of the ink supply port 81 of the ink absorber 1, and the cover member 8 is detached from the container main body 9.

Figure 12:
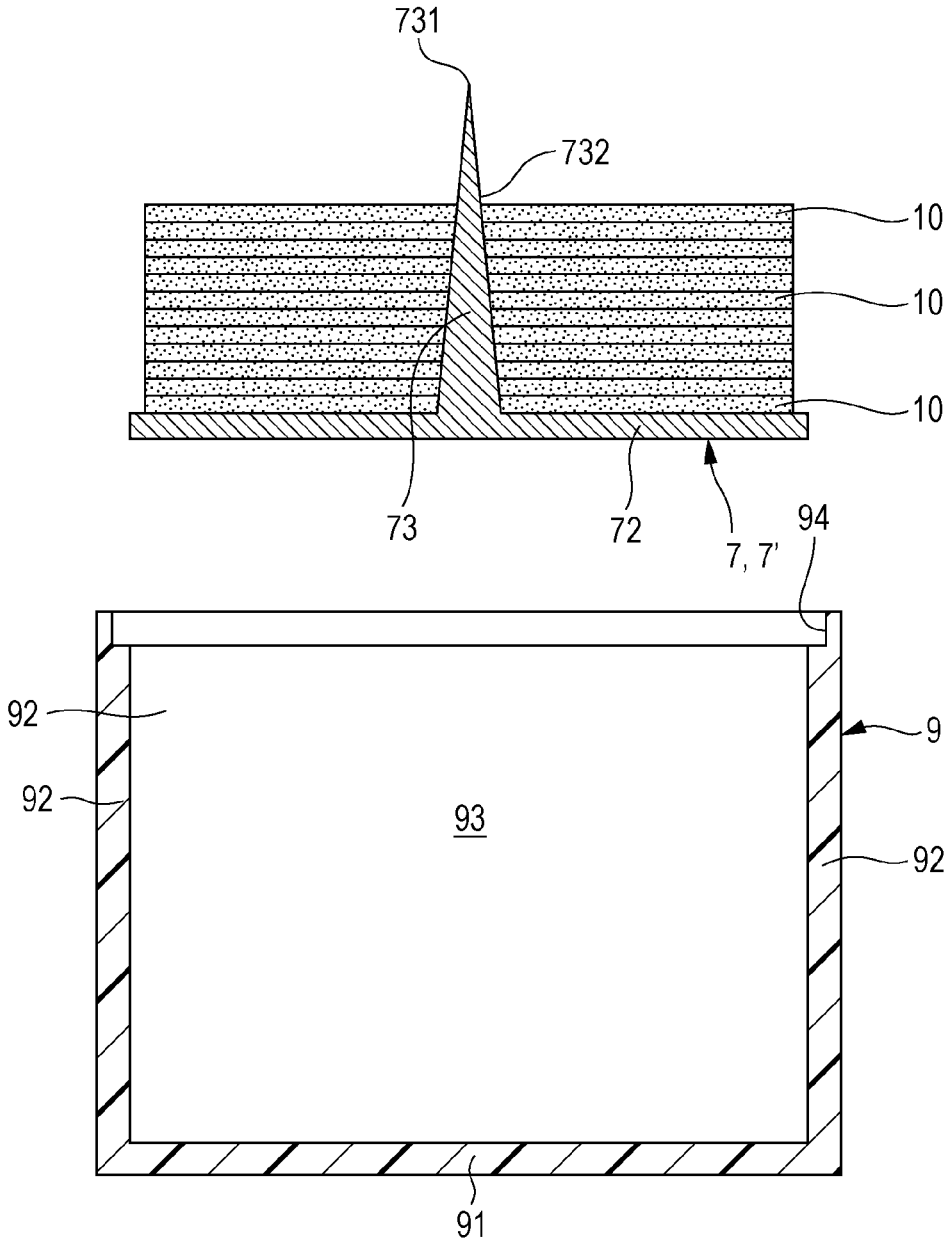
FIG. 12 is a vertical sectional view illustrating the process from the state in which the ink absorber (fourth embodiment) according to the invention is used to the replacement of the ink absorbing members in order.

Then the side of the top 731 of the gripping section 73 is gripped, and the gripping section 73 is pulled out upwardly as it is as illustrated in FIG. 12. In this manner, the detachment structure section 7 can be detached along with the ink absorbing member 10 from the container main body 9. At this time, since the gap 101 is formed between the ink absorbing member 10 and the side wall sections 92 of the container main body 9, it is possible to smoothly perform an operation of pulling out the detachment structure section 7.

Figure 13:
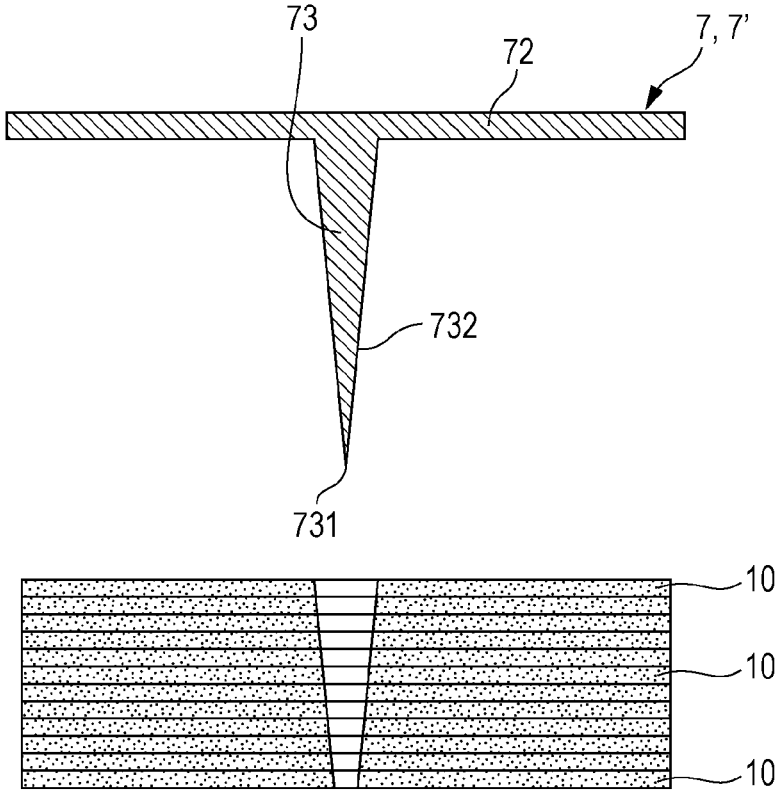
FIG. 13 is a vertical sectional view illustrating the process from the state in which the ink absorber (fourth embodiment) according to the invention is used to the replacement of the ink absorbing members in order.

Then, the detachment structure section 7 is vertically inverted as illustrated in FIG. 13. In this manner, it is possible to detach the ink absorbing members 10 after use from the detachment structure section 7.

Figure 14:
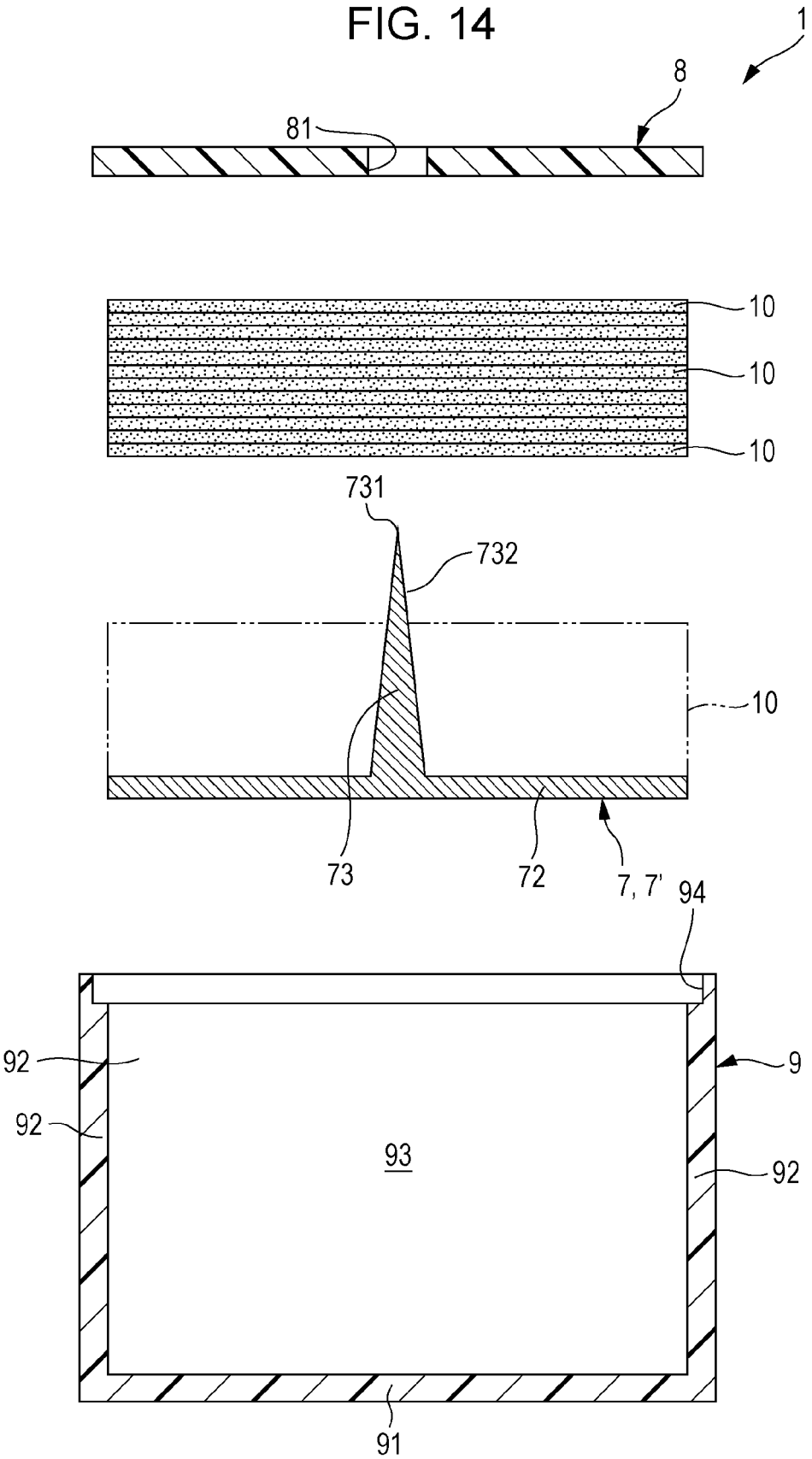
FIG. 14 is a vertical sectional view illustrating the process from the state in which the ink absorber (fourth embodiment) according to the invention is used to the replacement of the ink absorbing members in order.

Then, a plurality of new unused ink absorbing members 10 are prepared, these ink absorbing members 10 are caused to stick to the gripping section 73 and are placed on the placement section 72 as illustrated in FIG. 14. Then, the ink absorbing members 10 are accommodated along with the detachment structure section 7 in the container main body 9, and the cover member 8 is attached to and assembled with the container main body 9. In this manner, a reusable ink absorber 1 is obtained.

In this manner, the detachment structure section 7 is configured to be able to detach and collect (move) the ink absorbing members 10 from the container main body 9 (accommodation section) according to the embodiment. In this manner, in a case in which the container main body 9 is relatively heavy, and it is difficult to vertically invert the container main body 9 when the ink absorbing members 10 are detached as in the first embodiment, for example, it is possible to easily perform the operation of detaching the ink absorbing members 10 by employing the configuration as in the embodiment for the detachment structure section 7.

Although the ink absorbing members 10 after use are detached from the detachment structure section 7 and are then discarded in the embodiment, the invention is not limited thereto. For example, the ink absorbing members 10 may be discarded along with the detachment structure section 7 without being detached from the detachment structure section 7. In this case, it is preferable that the unused ink absorbing members 10 are placed on the detachment structure section 7 in advance and are accommodated in, that is, attached to the container main body 9 along with the detachment structure section 7.

The inclined surfaces 921 described above in the first embodiment may be formed at the side wall sections 92. In this case, the low friction layers 71 described above in the third embodiment may be formed on the inclined surfaces 921.

Fifth Embodiment

Figure 15:
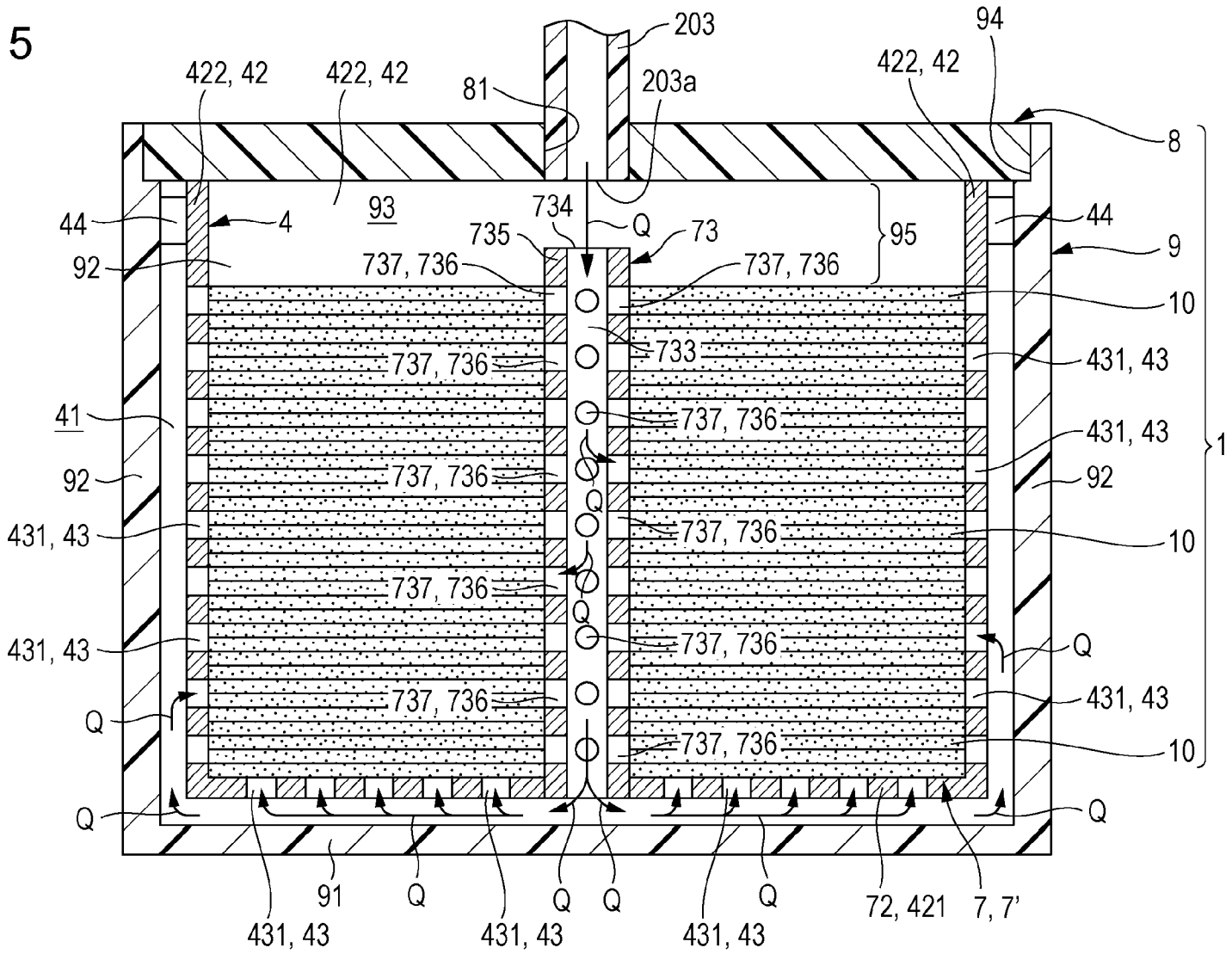
FIG. 15 is a vertical sectional view illustrating a process from a state in which an ink absorber (fifth embodiment) according to the invention is used to replacement of ink absorbing members in order.
Figure 16:
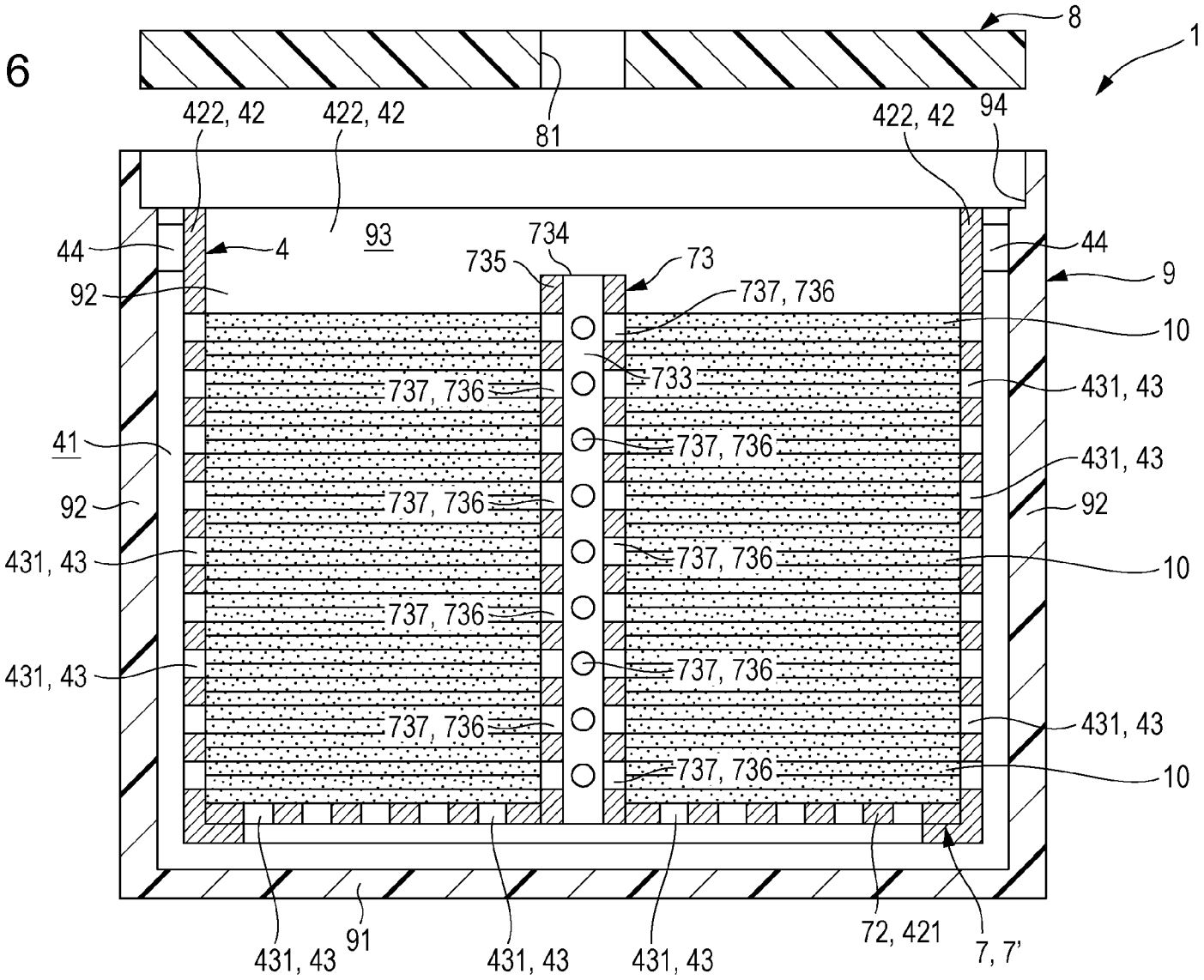
FIG. 16 is a vertical sectional view illustrating the process from the state in which the ink absorber (fifth embodiment) according to the invention is used to the replacement of the ink absorbing members in order.
Figure 17:
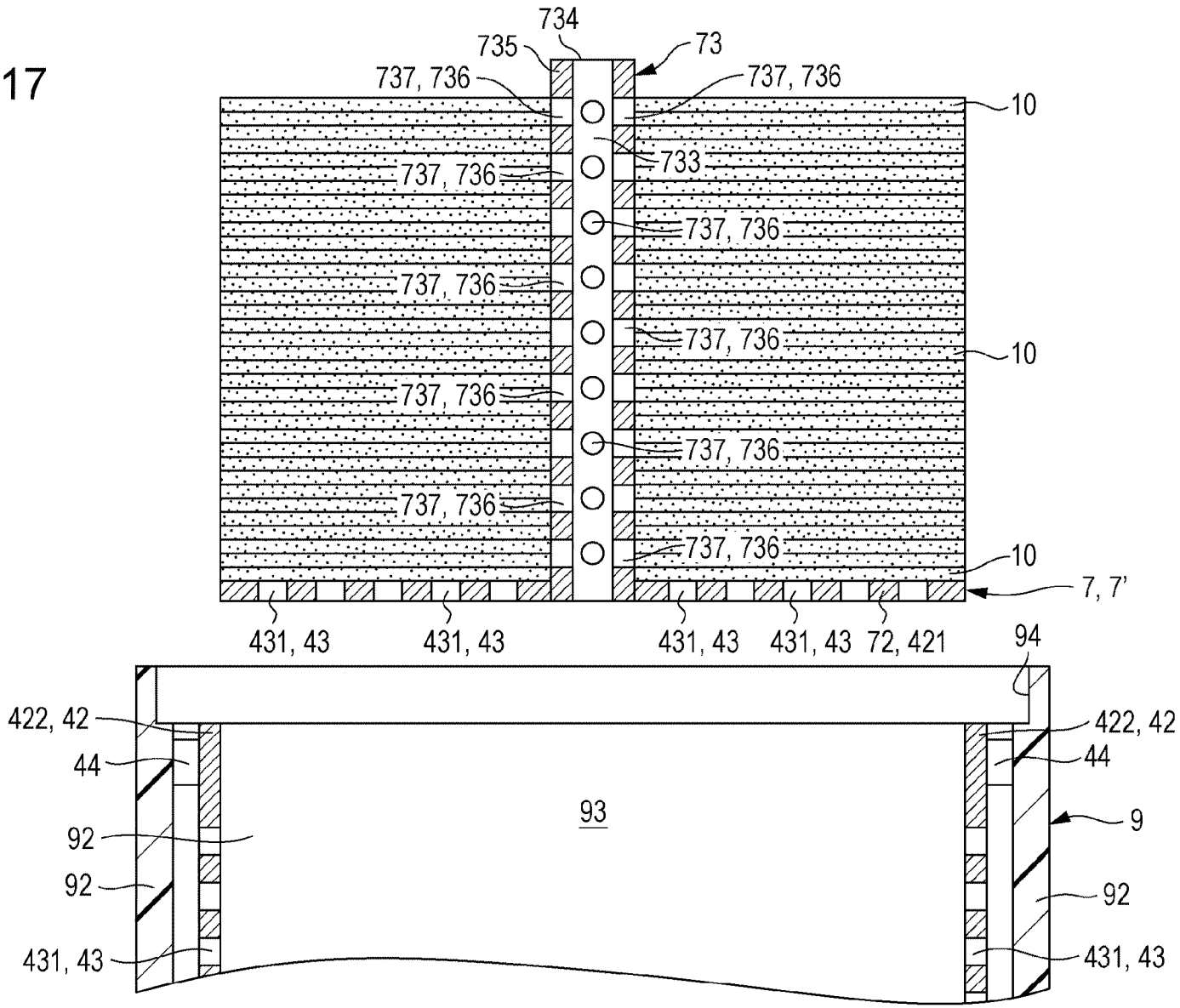
FIG. 17 is a vertical sectional view illustrating the process from the state in which the ink absorber (fifth embodiment) according to the invention is used to the replacement of the ink absorbing members in order.

FIGS. 15 to 17 each are vertical sectional views illustrating a process from a state in which an ink absorber (fifth embodiment) according to the invention is used to replacement of ink absorbing members.

The fifth embodiment of the ink absorber according to the invention will be described below with reference to these drawings, differences from the aforementioned embodiments will be mainly described, and description of similar matters will be omitted.

The embodiment is similar to the fourth embodiment other than that the configurations of the detachment structure section (assist structure section) differ from each other.

The cover member 8 that forms the accommodation section for accommodating the ink absorbing members 10 along with the container main body 9 has the ink supply port 81 that supplies the ink Q to the inside of the container main body 9 as described above.

As illustrated in FIGS. 15 to 17, the gripping section 73 has a tubular shape in the embodiment. In addition, the gripping section 73 is a liquid guiding pipe that forms a liquid guiding space 733 that is located in the accommodation space 93 and that guides the ink Q supplied to the inside of the accommodation space 93 to the bottom section 91 of the container main body 9 (accommodation section) in a state before the ink absorbing member 10 is detached from the container main body 9 (accommodation section). In addition, the gripping section 73 is located on the extension of the supply direction in which the ink Q is supplied from the ink supply port 81, and an upper opening section 734 is opened to face the ink supply port 81. With such a gripping section 73, the ink Q supplied from the ink supply port 81 passes through the inside of the gripping section 73, that is, the liquid guiding space 733 via the upper opening section 734 and is then quickly and smoothly guided to the side of the bottom section 91 of the container main body 9.

When the ink absorbing members 10 are caused to absorb the ink Q, it is preferable to cause the ink Q to reach the furthest side of the ink absorbing member 10 to the maximum extent, that is, the side of the bottom section 91 and to cause the ink Q to be absorbed therefrom. In this manner, it is possible to impregnate the ink Q into the plurality of ink absorbing member 10 in the container main body 9 as entirely as possible and thereby to use these ink absorbing members 10 without waste. Therefore, the configuration including the gripping section 73 that functions as the liquid guiding pipe is a configuration suitable for exhibiting such advantages.

In addition, the ink absorbing members 10 have properties that the ink absorbing members 10 are expanded when absorbing the ink and contract when being dried. The gripping section 73 has rigidity to such an extent that deformation thereof is prevented even if such expansion and contraction are repeated. In this manner, it is possible to stably guide the ink Q to the side of the bottom section 91 of the container main body 9 for a long term.

A communication section 736 that communicates the liquid guiding space 733 with the accommodation space 93 is formed at a pipe wall 735 of the gripping section 73 that is the liquid guiding pipe. In the embodiment, the communication section 736 is formed of a plurality of fine pores 737 that are formed such that the pores 737 penetrate through the pipe wall 735. These fine pores 737 are arranged at equal intervals in the circumferential direction of the gripping section 73 (pipe wall 735) and are also arranged at equal intervals in the central axis direction of the gripping section 73 (the upward-downward direction in FIGS. 2 and 3). Note that the intervals in the circumferential direction of the gripping section 73 and the intervals in the central axis direction of the gripping section 73 may be the same as each other or may be different from each other.

There is a case in which the ink Q temporarily stays in the liquid guiding space 733 in the process of further flowing downward (flowing into a diffusion space 41) via the liquid guiding space 733 depending on the amount of the ink Q supplied from the ink supply port 81 and the supply speed thereof, for example. In this case, the staying ink Q is absorbed by the ink absorbing member 10 via at least one fine pore 737 from among the plurality of fine pores 737. In this manner, it is possible to curb the staying of the ink Q in the liquid guiding space 733 and thereby to quickly and sufficiently absorb the ink Q.

The number of the fine pores 737 formed in the circumferential direction of the gripping section 73 is four in the embodiment. In this case, the four fine pores 737 preferably faces the side of the respective side wall sections 92 of the container main body 9.

Note that although the number of the fine pores 737 formed in the circumferential direction of the gripping section 73 is four in the embodiment, the number is not limited thereto and may be two, three, or five or more, for example.

Although the shape of each fine pore 737 is a circular shape in the embodiment, the shape is not limited thereto and may be an oval shape or a polygonal shape such as a square shape, for example.

The elements that form the communication section 736 are not limited to the fine pores 737 and may be slits, for example.

As illustrated in FIG. 15, the ink absorber 1 includes a diffusion section 4 that forms the diffusion space 41 that communicates with the liquid guiding space 733 and that diffuses the ink Q that has passed through the liquid guiding space 733 along the side wall sections 92 from the bottom section 91 of the container main body 9. In this manner, the ink can also flow into the liquid guiding space 733 from the sides of the bottom section 91 and the side wall sections 92 of the container main body 9, and it is thus possible to further quickly and sufficiently absorb the ink Q with the ink absorbing members 10. In this manner, the ink absorber 1 is configured to be able to absorb the ink Q from multiple directions.

The diffusion section 4 has a barrier section 42 that sections the diffusion space 41 and the accommodation space 93 and the support section 44 that supports the barrier section 42 relative to the container main body 9. The barrier section 42 is formed of a first barrier 421 that faces the bottom section 91 of the container main body 9 via a gap and second barriers 422 that face the respective side wall sections 92 via gaps. Note that the placement section 72 also serves as the first barrier 421 in the embodiment. In addition, the space between the bottom section 91 and the first barrier 421 communicates with the respective spaces between the side wall sections 92 and the second barriers 422, thereby forming the diffusion space 41.

In addition, a communication section (second communication section) 43 that communicates the diffusion space 41 with the accommodation space 93 is formed in the barrier section 42, that is, the first barrier 421 and the respective second barriers 422. The communication section 43 is formed of a plurality of fine pores 431 that are formed such that the fine pores penetrate through the barrier section 42. These fine pores 431 are uniformly arranged in the plane direction at the respective barriers. With the communication section 43 formed of such fine pores 431, the ink Q diffused in the diffusion space 41 flows into the liquid guiding space 733 from all the fine pores 431 and is then quickly absorbed by the ink absorbing members 10. Since it is possible to cause the ink absorbing members 10 to absorb the ink Q from the furthest side with priority to the maximum extent with the fine pores 431 formed in the first barrier 421, in particular, this configuration is preferable for absorbing the ink. Note that density at which the fine pores 431 are disposed in the first barrier 421 may be the same as or different from density at which the fine pores 431 are disposed in the respective second barriers 422.

The support section 44 is arranged between the side wall sections 92 and the second barrier 422 and couples the side wall sections 92 to the second barrier 422. In this manner, it is possible to support the barrier section 42 relative to the container main body 9 and thereby to secure the diffusion space 41.

Next, a process of detaching the ink absorbing members 10 will be described with reference to FIGS. 16 and 17.

The cover member 8 that has been pulled out of the tube 203 is detached from the container main body 9 as illustrated in FIG. 16.

Then, the gripping section 73 on the side of the upper opening section 734 is gripped and pulled out upwardly as it is as illustrated in FIG. 17. In this manner, it is possible to detach the detachment structure section 7 along with the ink absorbing member 10 from the container main body 9.

Thereafter, the ink absorbing members 10 after use are detached from the detachment structure section 7 and are replaced with unused ink absorbing members 10 as described above, thereby obtaining a reusable ink absorber 1.

Sixth Embodiment

Figure 18:
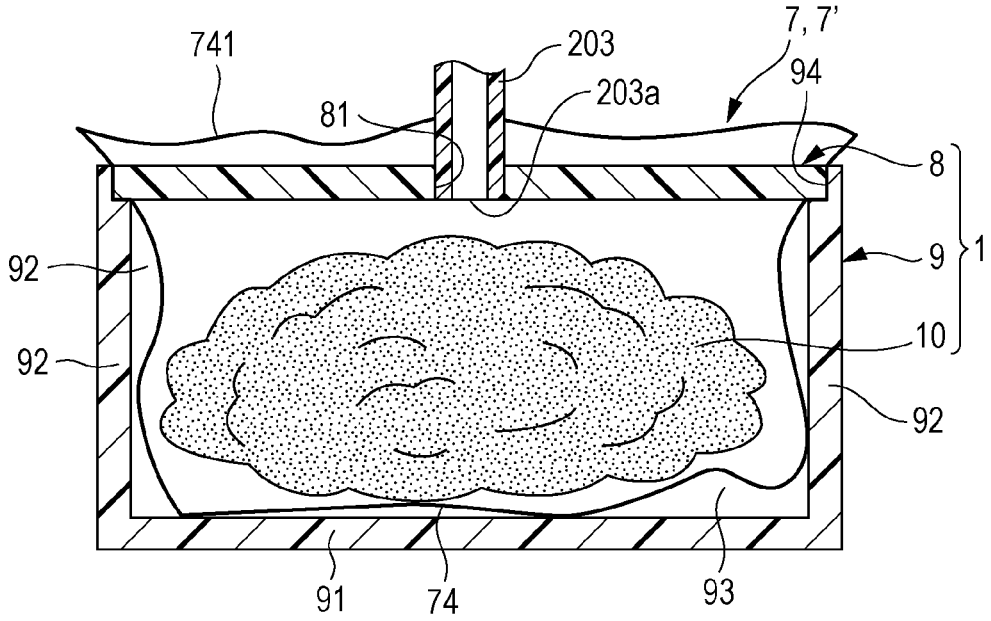
FIG. 18 is a vertical sectional view illustrating a process from a state in which an ink absorber (sixth embodiment) according to the invention is used to replacement of an ink absorbing members in order.
Figure 19:
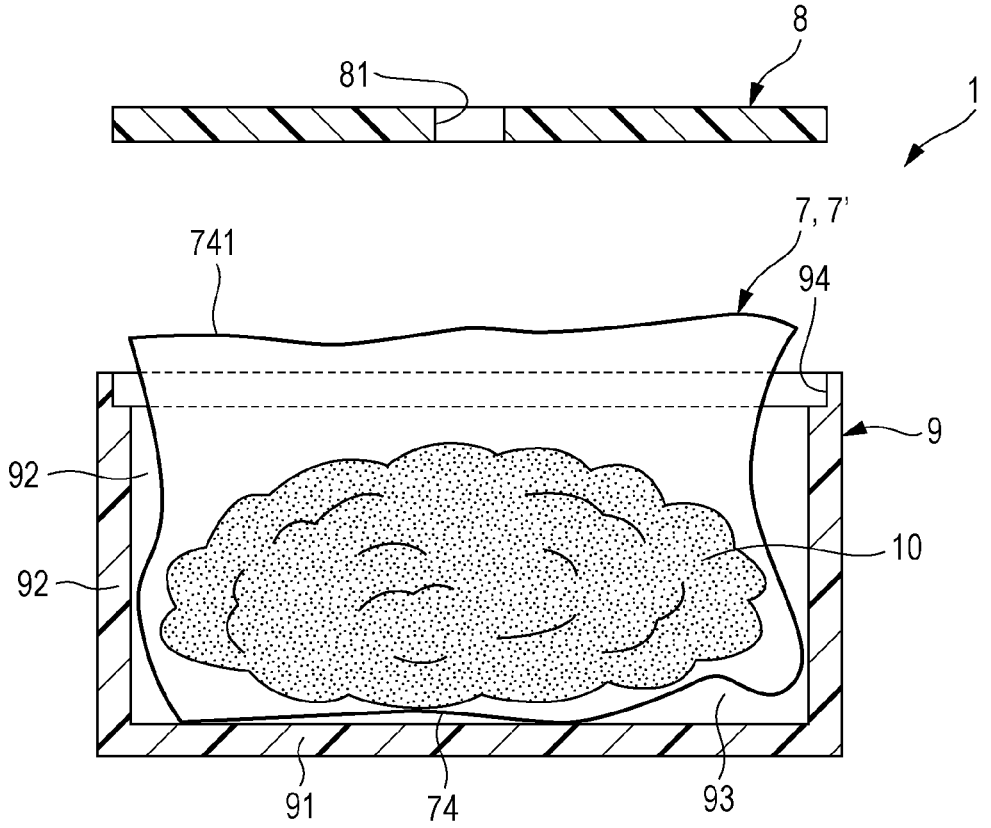
FIG. 19 is a vertical sectional view illustrating the process from the state in which the ink absorber (sixth embodiment) according to the invention is used to the replacement of the ink absorbing members in order.
Figure 20:
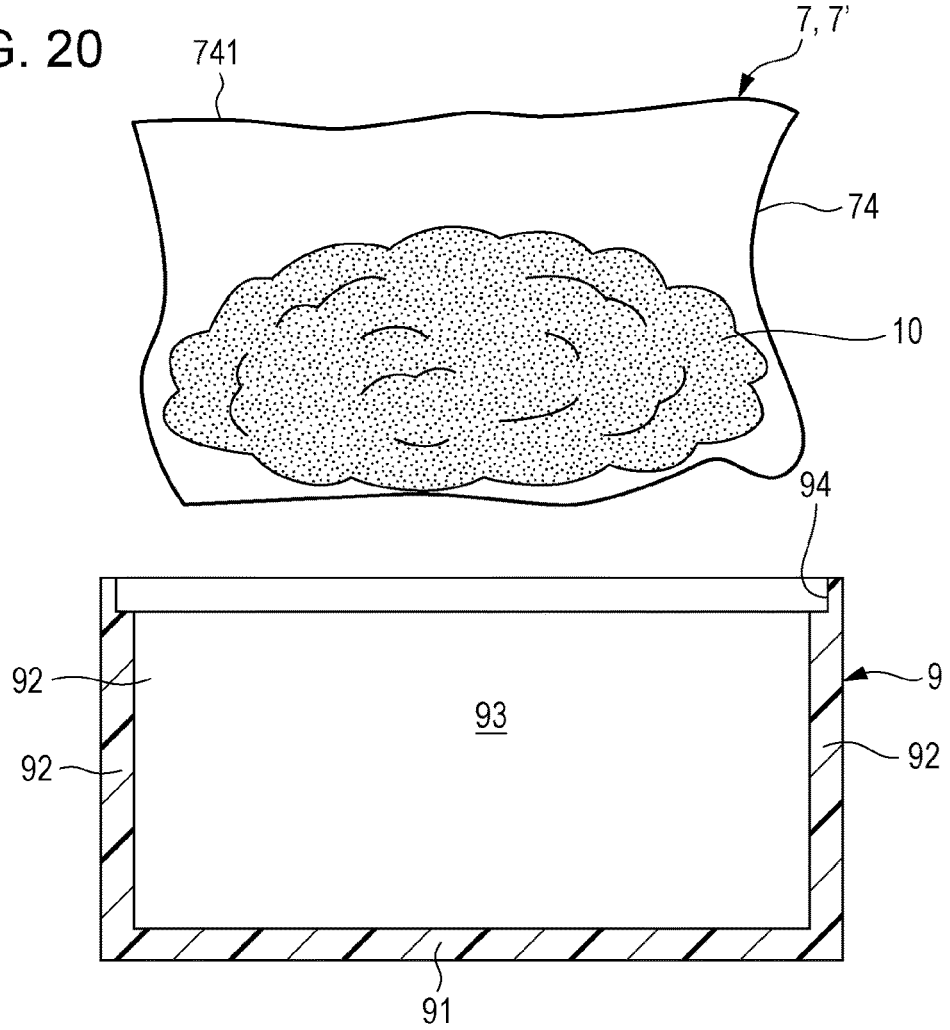
FIG. 20 is a vertical sectional view illustrating the process from the state in which the ink absorber (sixth embodiment) according to the invention is used from the replacement of the ink absorbing members in order.
Figure 21:
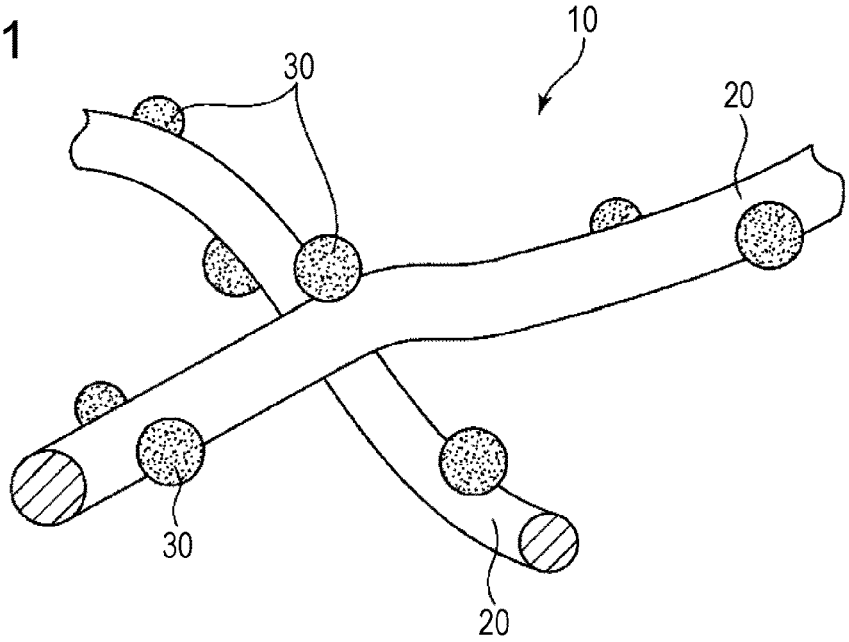
FIG. 21 is an enlarged detailed view of the ink absorbing member that is included in the ink absorber illustrated in FIGS. 18 to 20.

FIGS. 18 to 20 are vertical sectional views illustrating a process from a state in which an ink absorber (sixth embodiment) according to the invention is used to replacement of the ink absorbing members. FIG. 21 is an enlarged detailed view of the ink absorbing members included in the ink absorber illustrated in FIGS. 18 to 20.

Hereinafter, the sixth embodiment of the ink absorber according to the invention will be described with reference to these drawings, differences from the aforementioned embodiments will be mainly described, and description of similar matters will be omitted.

The embodiment is similar to the fourth embodiment other than that the configurations of the detachment structure section (assist structure section) differ from each other.

As illustrated in FIGS. 18 to 20, the ink absorbing members 10 are in a cotton form as a whole in the embodiment. As illustrated in FIG. 21, the ink absorbing members 10 include the fiber 20 that is mutually entangled and the water-absorbable resin 30 adhering to (retained by) the fiber 20 in an enlarged view of the ink absorbing member 10. Note that the fiber 20 is preferably bonded to each other via a binder (not illustrated). The ink absorbing members 10 in such a cotton form can enhance ink absorbability and promote absorption of the ink Q.

In the embodiment, the detachment structure section (assist structure section 7') has an inner accommodation section 74 that is accommodated along with the ink absorbing members 10 in the container main body 9 (accommodation section) in a state in which the ink absorbing members 10 are accommodated. As illustrated in FIG. 20, the inner accommodation section 74 can be detached along with the ink absorbing members 10 from the container main body 9 (accommodation section) when the ink absorbing members 10 are detached from the container main body 9 (accommodation section). In this manner, it is possible to easily replace the ink absorbing members 10.

Note that although the inner accommodation section 74 is formed of a bag that is softer than the container main body 9 in the embodiment, the inner accommodation section 74 is not limited thereto and may be formed of a hard box similarly to the container main body 9, for example.

Next, a process of detaching the ink absorbing members 10 will be described with reference to FIGS. 19 and 20.

The cover member 8 from which the tube 203 has been pulled out is detached from the container main body 9 as illustrated in FIG. 19.

Then, an edge section 741 at an upper portion of the inner accommodation section 74 (bag) is gripped and is then pulled out upwardly as it is as illustrated in FIG. 20. In this manner, it is possible to detach the inner accommodation section 74 along with the ink absorbing member 10 from the container main body 9.

Thereafter, the inner accommodation section 74 in which unused ink absorbing members 10 are accommodated in advance is accommodated in the container main body 9, thereby obtaining a reusable ink absorber 1.

Although the ink absorber according to the invention has been described above on the basis of the embodiments illustrated in the drawings, the invention is not limited thereto, and the respective parts that form the ink absorber can be replaced with any configurations capable of exhibiting similar functions. Also, any configurations may be added thereto.

In addition, the ink absorber according to the invention may be a combination of any two or more configurations (features) in the respective embodiments.

Although the ink absorbing members have sheet forms in the first to fifth embodiments, and the ink absorbing members have a cotton form in the sixth embodiment, the ink absorbing members are not limited thereto and may have a small piece shape (strip shape) that is smaller than the sheet shape described in the first to fifth embodiments, for example.

Seventh Embodiment

Figure 24:
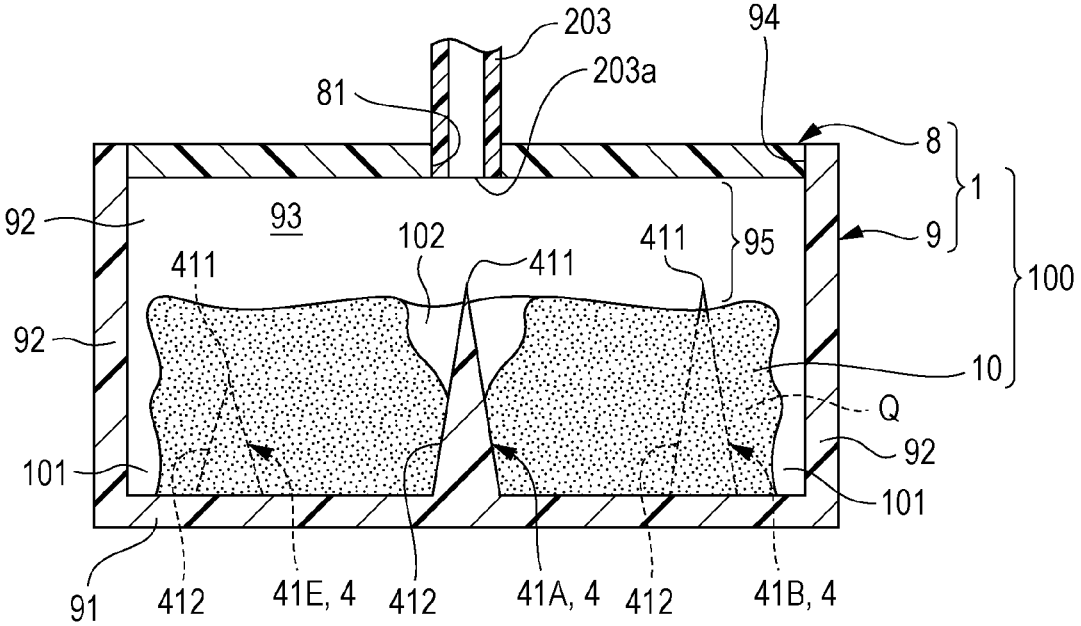
FIG. 24 is a partial vertical sectional view illustrating the state (example) in which the ink absorbing structure (ink absorbing member accommodation container) according to the seventh embodiment of the invention is used, in order.
Figure 25:
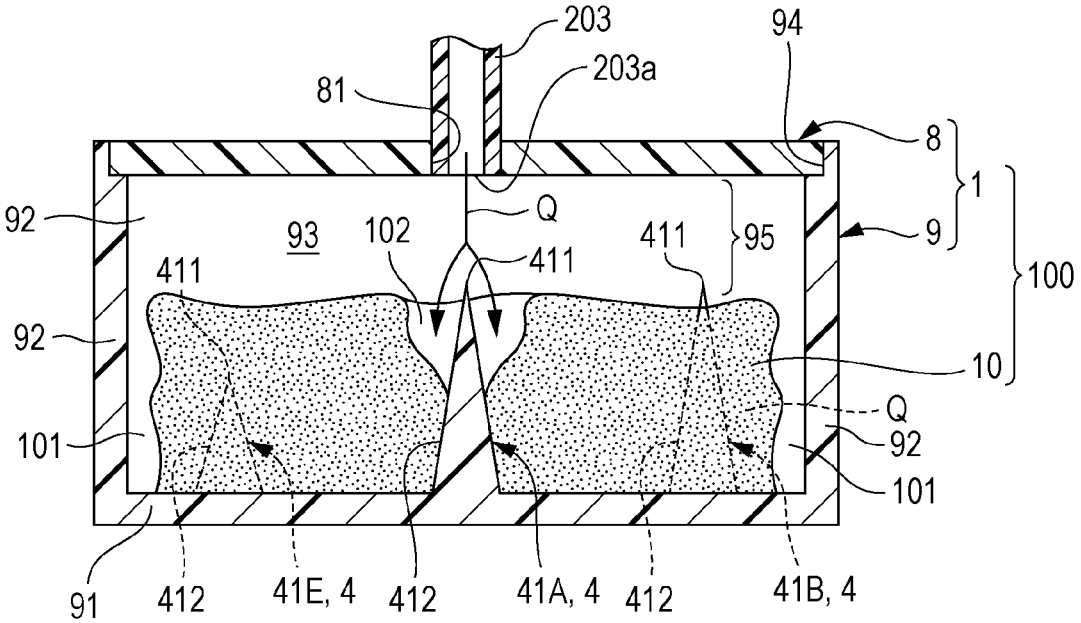
FIG. 25 is a partial vertical sectional view illustrating the state (example) in which the ink absorbing structure (ink absorbing member accommodation container) according to the seventh embodiment of the invention is used, in order.
Figure 26:
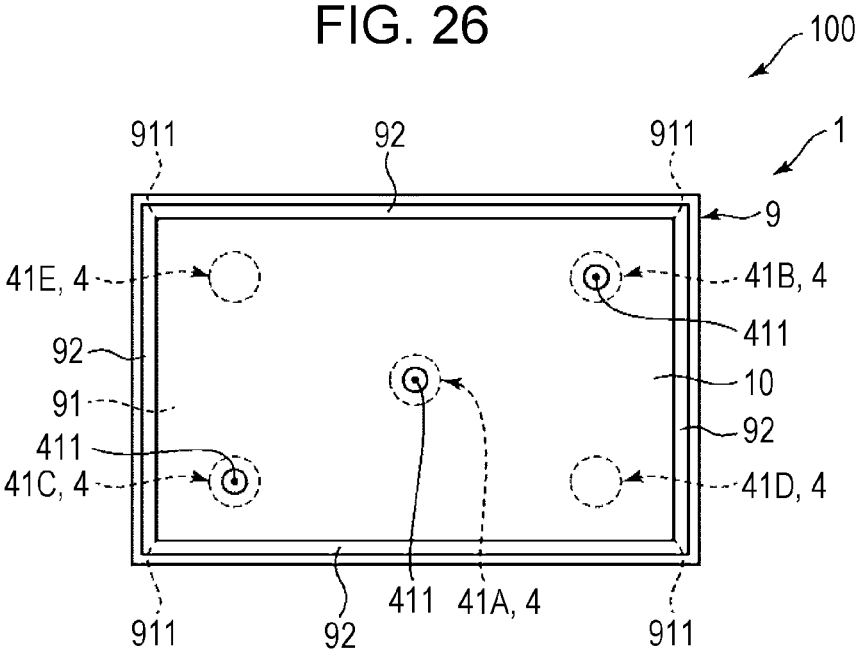
FIG. 26 is a diagram (planar view) when seen in the direction of the arrow A in FIG. 22.

FIGS. 22 to 25 are partial vertical sectional views illustrating, in order, a state in which the ink absorbing structure (ink absorbing member accommodation container) according to the seventh embodiment of the invention is used. FIG. 26 is a view (plan view) when seen in a direction in which the ink drops ((the direction of the arrow A) in FIG. 22. Note that the upper side in FIGS. 22 to 25 (the same applies to FIGS. 27, 29, and 31 to 35) will be referred to as "upward (or above)" and the lower side therein will be referred to as "downward (below)" for convenience of description. Note that matters that will not be described below are the same as those described in the aforementioned embodiment, and description thereof will be omitted.

Figure 22:
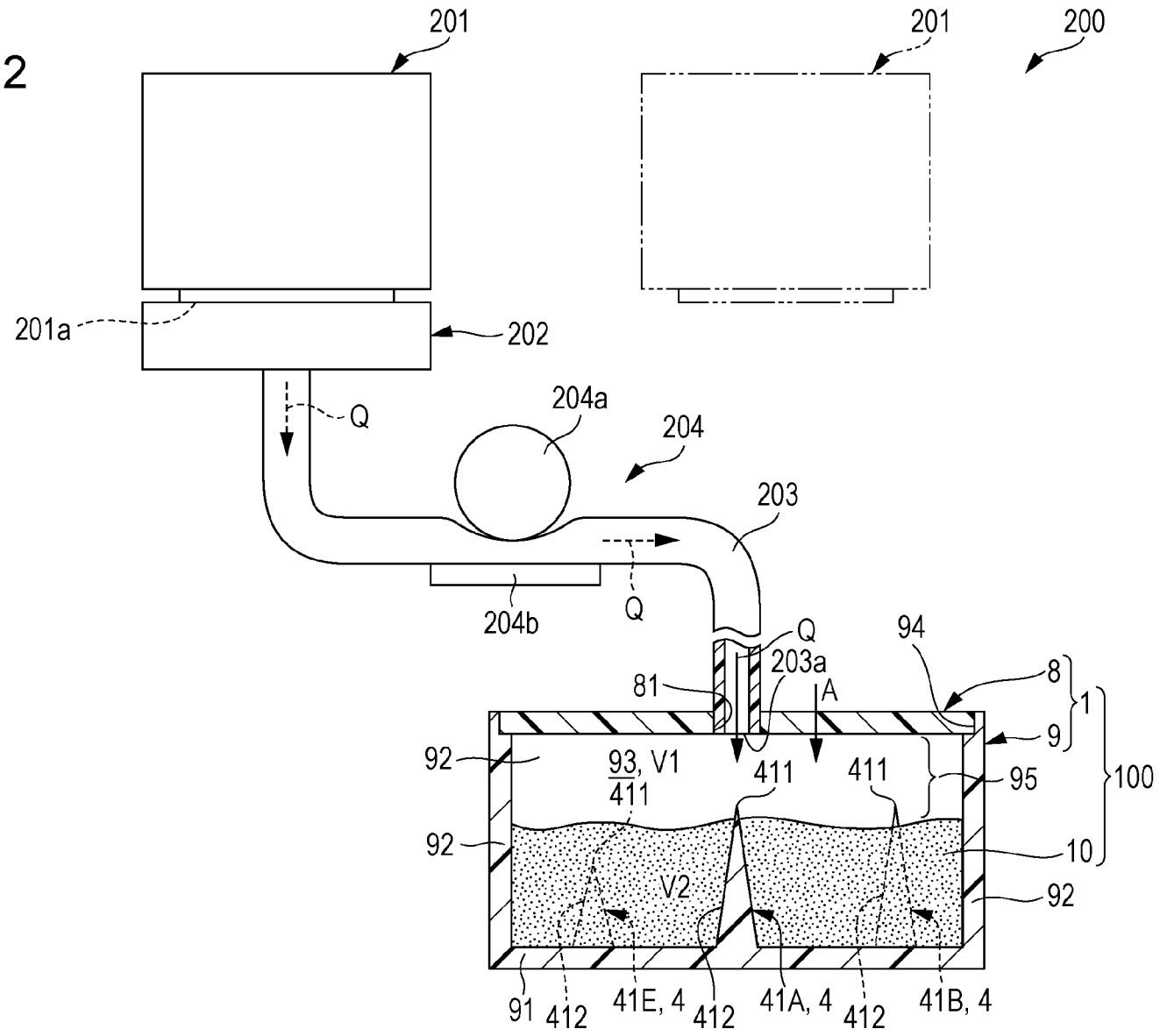
FIG. 22 is a partial vertical sectional view illustrating a state (example) in which an ink absorbing structure (ink absorbing member accommodation container) according to a seventh embodiment of the invention is used, in order.
Figure 23:
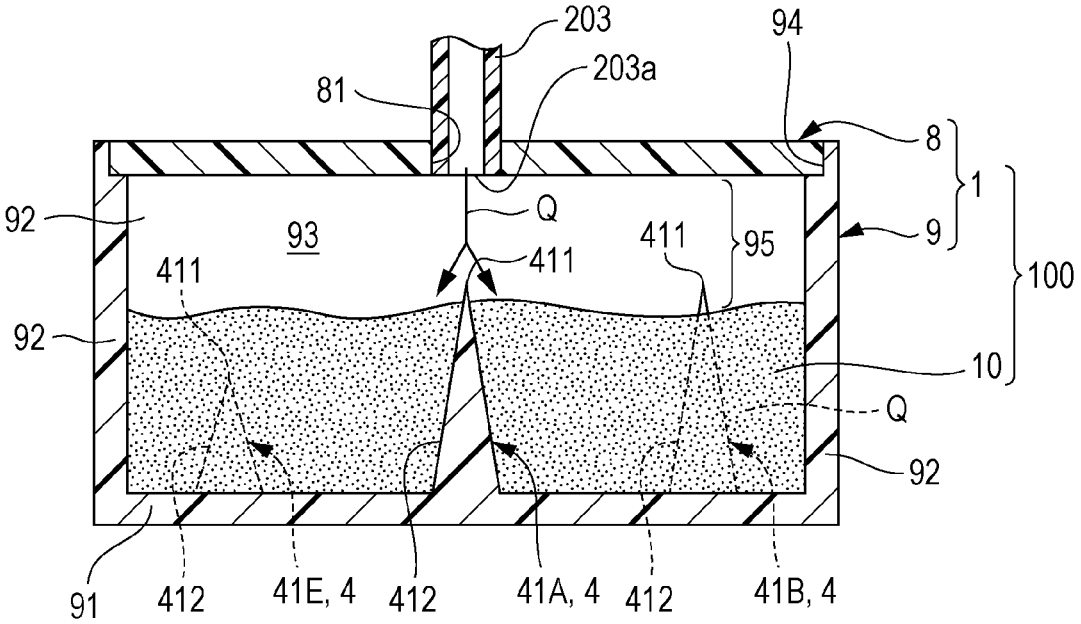
FIG. 23 is a partial vertical sectional view illustrating the state (example) in which the ink absorbing structure (ink absorbing member accommodation container) according to the seventh embodiment of the invention is used, in order.

As illustrated in FIG. 22, the ink absorbing member accommodation container 1 according to the invention includes the container main body 9 that has the accommodation space 93 for accommodating the ink absorbing members 10 that including the water-absorbable resin 30 (see FIG. 21) capable of absorbing the ink Q, the cover member 8 that is detachably attached to the container main body 9, and at least one insertion member 5 that is inserted into the ink absorbing members 10 and are in brought into contact with the ink absorbing members 10.

The ink absorbing structure 100 according to the invention includes the ink absorbing member accommodation container 1 and the ink absorbing members 10 that are accommodated in the accommodation space 93 and include includes the water-absorbable resin 30 capable of absorbing the ink Q.

According to the invention as described above, a protrusion 41A, for example, that forms the insertion member 5 is inserted and sticks into the ink absorbing members 10 from the lower side and is then brought into a state in which the protrusion 41A is in contact with and is engaged with the ink absorbing members 10. In such a state, movement of the ink absorbing member 10 in the container main body 9 (accommodation space 93) (in particular, movement in a direction that intersects with the protruding direction of the insertion member) is curbed even if the ink absorbing member 10 is dried and contracts after absorbing the ink Q. In this manner, the ink absorbing member 10 can be continuously located at the dropping locations of the ink Q and can thus quickly ad sufficiently absorb the ink Q.

The print apparatus 200, the ink ejection head 201, the capping unit 202, the tube 203, and the roller pump 204 illustrated in FIG. 22 are the same as those described in the first embodiment.

As illustrated in FIGS. 22 to 25, the ink absorbing structure 100 includes the ink absorbing member accommodation container 1 and the ink absorbing members 10 that are used to absorb the ink Q. The ink absorbing structure 100 is detachably attached to the print apparatus 200 and is used to absorb waste liquid of the ink Q as described above in the attached state. In this manner, the ink absorbing structure 100 can be used as a so-called "waste liquid tank (waste ink tank)". In addition, if the amount of the ink Q absorbed by the ink absorbing structure 100 reaches the limit, the ink absorbing structure 100 can be replaced with a new (unused) ink absorbing structure 100. Note that whether or not the amount of the ink Q absorbed by the ink absorbing structure 100 has reached the limit is detected by a detection unit (not illustrated) in the print apparatus 200. In a case in which the amount of the ink Q absorbed by the ink absorbing structure 100 has reached the limit, the fact is provided as a notification by a notification unit, such as a monitor, that is incorporated in the print apparatus 200, for example.

The ink absorbing member 10 is used to absorb the ink Q in the ink absorbing member accommodation container 1. As illustrated in FIG. 21, the ink absorbing member 10 includes the fiber 20 and the water-absorbable resin 30 that is mixed in (retained by) the fiber 20 and has a cotton form as a whole.

The container main body 9 has a box shape that has the bottom section (bottom plate) 91 that has a square shape, for example, and the four side wall sections 92 that stand upwardly from the respective sides (edge sections) of the bottom section 91 when seen from the direction in which the ink drops (plan view). In addition, the ink absorbing members 10 are accommodated in the accommodation space 93 surrounded by the bottom section 91 and the four side wall sections 92.

As described above, the ink absorbing structure 100 includes the cover member 8. As illustrated in FIG. 22, the cover member 8 has a plate shape and can be fitted to the upper opening section 94 of the container main body 9. It is possible to seal the upper opening section 94 in a liquid tight manner through the fitting. In this manner, it is possible to prevent the ink Q from flying outwardly even in a case in which the ink Q collides against the ink absorbing member 10 and jumps up when the ink Q is discharged and drops from the tube 203, for example. In addition, it is possible to curb flowing the ink Q out from the ink absorbing structure 100 even in a case in which the print apparatus 200 is placed upside down. Therefore, it is possible to prevent the ink Q from adhering and staining the surroundings of the ink absorbing structure 100.

Incidentally, although the ink absorbing member 10 is once expanded after absorbing the ink Q, the ink absorbing member 10 is then dried with time. Then, the ink absorbing members 10 contract by the amount corresponding to the dried part. At this time, the ink absorbing members 10 tend to contract from the part in contact with the container main body 9, that is, from the side of the side wall sections 92 of the container main body 9 toward the inner side (see FIG. 23). The gap 101 occurs between the ink absorbing members 10 that have contracted and the side wall sections 92. There is a risk that the ink absorbing members 10 tend to move in the container main body 9 due to oscillation or the like during printing performed by the print apparatus 200, for example, depending on the size of the gap 101, and as a result, the ink absorbing members 10 are not located at the ink Q dropping locations. In this case, there is a concern that disadvantages that it is not possible to quickly absorb the ink Q with the ink absorbing members 10, that it is not possible to sufficiently absorb the ink Q, and the like occur.

Thus, the ink absorbing structure 100 (ink absorbing member accommodation container 1) is configured to solve such disadvantages. Hereinafter, the configuration and effects will be described.

As illustrated in FIGS. 22 to 26, the insertion members 5 is arranged in the accommodation space 93 of the container main body 9. Although the number of the arranged insertion members 5 are five in the embodiment, the number is not limited thereto and may be one, two, three, four, or six or more.

As described above, the container main body 9 has the bottom section 91 and the side wall sections 92 that stand up from the bottom section 91. Also, the fiver insertion members 5 each are formed of at least one protrusion (a protrusion 41A, a protrusion 41B, a protrusion 41C, a protrusion 41D, and a protrusion 41E) that protrude from the bottom section 91 of the container main body 9 to the side of the upper opening section 94, that is, toward the upper side. In this manner, the protrusion 41A, the protrusion 41B, the protrusion 41C, the protrusion 41D, and the protrusion 41E are inserted into the ink absorbing members 10 from the side (lower side) of the bottom section 91 and are brought into a state in which the protrusion 41A, the protrusion 41B, the protrusion 41C, the protrusion 41D, and the protrusion 41E are in contact with and engaged with the ink absorbing members 10 (hereinafter, this state will be referred to as an "engaged state").

As described above, the ink absorbing members 10 contract with a decrease in water content. That is, the ink absorbing members 10 contract when the ink absorbing members 10 are dried after absorbing the ink Q. Although the gap 101 occurs between the ink absorbing members 10 that have contracted and the side wall sections 92, and the ink absorbing members 10 are considered to be likely to move in the container main body 9, the movement thereof in the direction along the bottom section 91 and the direction that intersects with the protruding direction of the insertion members in the container main body 9 is curbed (restricted) due to the protrusion 41A, the protrusion 41B, the protrusion 41C, the protrusion 41D, and the protrusion 41E in the engaged state. In this manner, the protrusion 41A, the protrusion 41B, the protrusion 41C, the protrusion 41D, and the protrusion 41E, that is, the respective insertion members 5 have a function of curbing the movement of the ink absorbing members 10 in the accommodation space 93 with the contraction of the ink absorbing members 10. In this manner, the ink absorbing members 10 can be continuously located at the ink Q dropping positions even if the ink absorbing members 10 contract and can thus quickly and sufficiently absorb the ink Q.

In the embodiment, the protrusion 41A, the protrusion 41B, and the protrusion 41C from among the protrusion 41A, the protrusion 41B, the protrusion 41C, the protrusion 41D, and the protrusion 41E have the same protrusion heights that are the maximum heights. Note that the protrusion heights of the protrusions 41A to 41C are not particularly limited, the heights are preferably equal to or greater than 1 time and equal to or less than 1.5 times and are more preferably equal to or greater than 1 time and equal to or less than 1.2 times of the height when the ink absorbing members 10 are expanded to the maximum extend.

The protrusion 41D and the protrusion 41E have the same protrusion heights that are lower than those of the protrusions 41A to 41C. Note that the protrusion heights of the protrusion 41D and the protrusion 41E are not particularly limited, the heights are preferably equal to or greater than 0.3 times and less than 1 time and are more preferably equal to or greater than 0.5 times and equal to or less than 0.8 times of the projection heights of the protrusions 41A to 41C, for example.

As illustrated in FIG. 26, the protrusion 41A from among the protrusion 41A, the protrusion 41B, the protrusion 41C, the protrusion 41D, and the protrusion 41E is arranged at the center of the bottom section 91 with the square shape, and the remaining protrusions 41B to 41E are localized and arranged on the side of the respective corner sections 911 of the bottom section 91 separately from the protrusion 41A. Also, the protrusion 41A, the protrusion 41B, and the protrusion 41C are arranged on diagonal lines of the bottom section 91. Note that the arrangement mode of the insertion members 5, that is, how the protrusions 41A to 41E are arranged on the bottom section 91 of the container main body 9 is not limited to the mode illustrated in FIG. 26.

As described above, the ink absorbing member accommodation container 1 includes the cover member 8 that is attached to the container main body 9 and that has the ink supply port 81 for supplying the ink Q into the accommodation space 93. As illustrated in FIGS. 22 to 25, the protrusion 41A (at least one protrusion) is located on the extension of the supply direction (falling direction) in which the ink Q is supplied from the ink supply port 81. Therefore, when seen from the supply direction (falling direction) in which the ink Q is supplied, the ink supply port 81 and the protrusion 41A that serves as the insertion member are in a state in which the ink supply port 81 and the protrusion 41A are arranged at an overlapping location in a plane. Also, the top 411 of the protrusion 41A (at least one protrusion) is exposed from the ink absorbing member 10. Note that the tops 411 of the protrusion 41B and the protrusion 41C are similarly exposed from the ink absorbing members 10.

The ink absorbing member 10 is in contact with the protrusions 41A to 41E in addition to the side wall sections 92 of the container main body 9 and tend to also contract from the side of the protrusion 41A (the same applies to the protrusion 41B and the protrusion 41C) with the exposed top 411 when the ink absorbing members 10 are dried (see FIG. 24). A gap 102 occurs between the ink absorbing members 10 and the protrusion 41A due to the contraction. When the ink Q is supplied from the ink supply port 81 as illustrated in FIG. 25 in this state, the ink Q is delivered along outer peripheral section 412 of the protrusion 41*a* in the gap 102 and is guided to the furthest side of the ink absorbing members 10. In this manner, the protrusion 41A (insertion member 5) has a liquid guiding function of guiding the ink Q to the ink absorbing members 10. In this manner, it is possible to sufficiently absorb (impregnate) the ink Q up to the furthest side of the ink absorbing members 10 and thereby to exhibit the ink absorption function of the ink absorbing member 10 with neither excess nor deficiency in a long term.

Note that the number of the protrusions that are located on the extension of the supply direction in which the ink Q is supplied from the ink supply port 81 is one (protrusion 41A) in the embodiment, the number is not limited thereto and may be two or more depending on the number of the ink supply ports 81, for example.

The protrusions 41A to 41E each have a columnar shape with an outer diameter (cross sectional shape) that gradually decreases toward the side of the ink supply port 81, that is, a conical shape in the embodiment. In this manner, the protrusions 41A to 41E are brought into a state in which the protrusions 41A to 41E stick to the ink absorbing members 10 from the lower side, and engagement force against the ink absorbing members 10 increases. In this manner, the ink absorbing members 10 are positioned in the container main body 9 regardless of expansion and contraction. If the ink absorbing members 10 are pushed in when the ink absorbing structure 100 is manufactured and the container main body 9 in a vacant state is filled with the ink absorbing members 10, for example, the protrusions 41A to 41E collectively stick to the ink absorbing members 10, and it is thus possible to easily perform the fitting operation.

Note that although the outer peripheral sections 412 of the protrusions 41A to 41E each have a tapered shape, and the tapered angle is constant in the upward-downward direction in the embodiment, the tapered angle is not limited thereto and may include a portion that change in the upward-downward direction.

Although the tops 411 of the protrusions 41A to 41C are exposed from the ink absorbing members 10 as described above, the tops 411 of the protrusion 41D and the protrusion 41E (at least one protrusion) are buried in the ink absorbing members 10. In this manner, the engagement force against the ink absorbing members 10 on the furthest side increases, and the function of curbing the movement of the ink absorbing members 10 in the container main body 9 is enhanced.

Note that the proportion of the insertion members 5, such as the protrusions 41A to 41C, exposed from the ink absorbing members 10 from among the plurality of insertion members 5 is preferably equal to or greater than 50% and equal to or less than 100% and is more preferably equal to or greater than 50% and equal to or less than 80%.

Although the cross sectional shape of each of the protrusions 41A to 41E is a circular shape, the cross sectional shape is not limited thereto and may be a polygonal shape such as a triangular shape, a square shape, or a star shape or may be an oval shape.

Also, although the cross sectional shapes of the respective protrusions 41A to 41E are the same shapes, the cross sectional shapes are not limited thereto and may differ from each other.

Although the outer diameter of each of the protrusions 41A to 41E gradually decreases toward the upper side, the outer diameter is not limited thereto and may be constant in the upward-downward direction.

Also, the top 411 of each of the protrusions 41A to 41E may be rounded.

In addition, the protrusions 41A to 41E may be formed integrally with the container main body 9 or may be formed separately from the container main body 9 and bonded to the container main body 9. In the former case, it is possible to collectively mold the protrusions 41A to 41E along with the container main body 9 when the container main body 9 is manufacture through molding using a mold, for example. In the latter case, it is possible to use materials that are suitable for molding the container main body 9 and the protrusions 41A to 41E.

Eighth Embodiment

Figure 27:
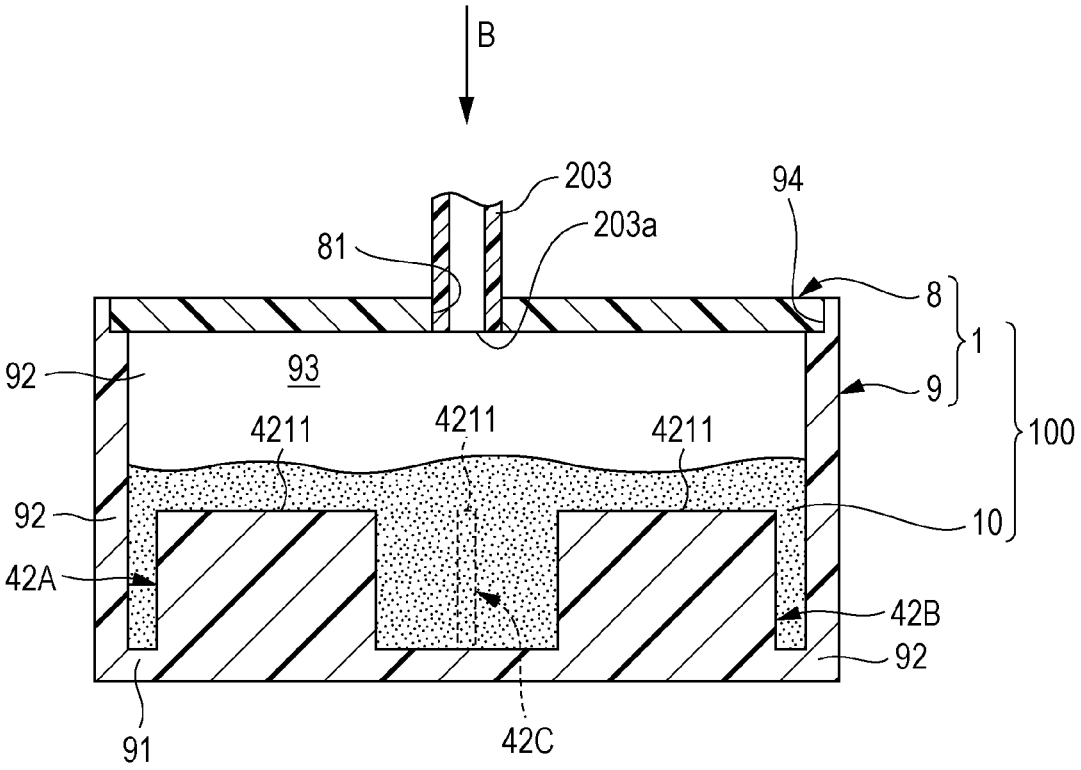
FIG. 27 is a partial vertical sectional view illustrating a state (example) in which an ink absorbing structure (ink absorbing member accommodation container) according to an eighth embodiment of the invention is used.
Figure 28:
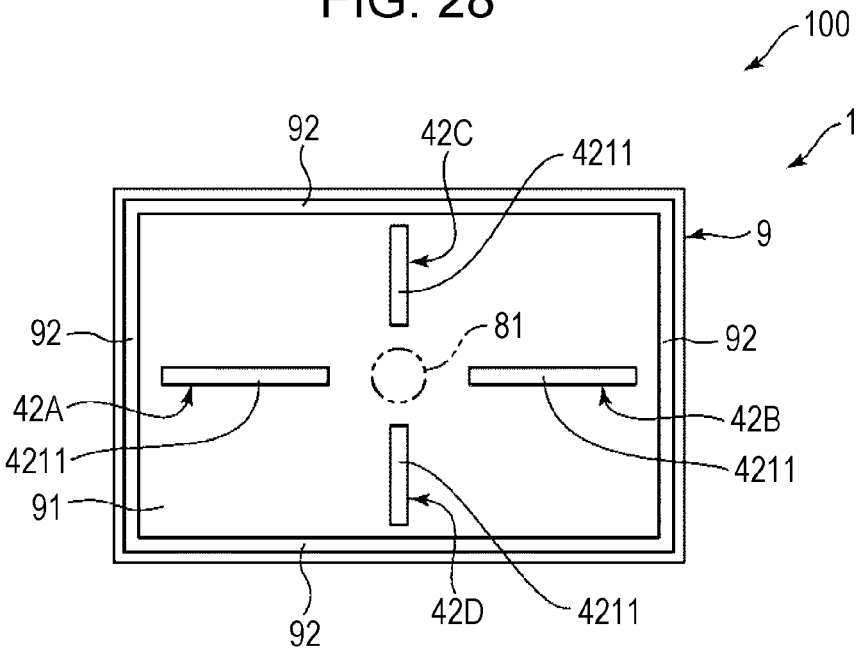
FIG. 28 is a diagram (planar view) when seen in the direction of the arrow B in FIG. 27.

FIG. 27 is a partial vertical sectional view illustrating a state (example) in which an ink absorbing structure (ink absorbing member accommodation container) according to an eighth embodiment of the invention is used. FIG. 28 is a diagram (plan view) when seen in the direction of the arrow B in FIG. 27. Note that the ink absorbing members are omitted in FIG. 28.

Hereinafter, the eighth embodiment of the ink absorbing member accommodation container and the ink absorbing structure according to the invention will be described with reference to these drawings, differences from the aforementioned embodiments will be mainly described, and description of similar matters will be omitted.

The embodiment is similar to the seventh embodiment other than that the configurations of the insertion members differ from each other.

As illustrated in FIG. 28, a protrusion 42A, a protrusion 42B, a protrusion 42C, and a protrusion 42D that serve as the insertion members 5 are arranged in the accommodation space 93 of the container main body 9 in the embodiment. Although the number of arranged insertion members 5 is four in the embodiment, the number is not limited thereto and may be three or five or more, for example. The protrusion 42A, the protrusion 42B, the protrusion 42C, and the protrusion 42D are formed such that the protrusion 42A, the protrusion 42B, the protrusion 42C, and the protrusion 42D protrude upwardly from the bottom section 91 of the container main body 9 in plate piece shapes.

As described above, the ink absorbing member accommodation container 1 includes a cover member 8 that is attached to the container main body 9 and that has the ink supply port 81 for supplying the ink Q into the accommodation space 93. In addition, the protrusions 42A to 42D (insertion members 5) are radially arranged (a plurality of protrusions are arranged) around the ink supply port 81 when seen from the side of the ink supply port 81, that is, in a plan view as illustrated in FIG. 28. In the embodiment, the protrusion 42A and the protrusion 42B are arranged in the long side direction (the left-right direction in FIG. 28) of the bottom section 91, and the protrusion 42C and the protrusion 42D are arranged in the short side direction (the upward-downward direction in FIG. 28) of the bottom section 91. With such arrangement, movement of the ink absorbing members 10 is curbed by the protrusion 42C and the protrusion 42D even if the ink absorbing members 10 are likely to move in the left-right direction in FIG. 28, for example, and movement of the ink absorbing member 10 is curbed by the protrusion 42A and the protrusion 42B even if the ink absorbing members 10 are likely to move in the upward-downward direction in FIG. 28. In this manner, it is possible to curb the movement of the ink absorbing member 10 in any direction. In this manner, the ink absorbing members 10 can continuously be located at the dropping locations of the ink Q and can thus quickly and sufficiently absorb the ink Q.

Note that although tops 4211 of the respective protrusions 42A to 42D (see FIG. 27) are buried in the ink absorbing members 10, the tops 4211 are not limited thereto and may be exposed from the ink absorbing members 10.

Although the protrusion heights of the protrusions 42A to 42D are the same, the protrusion heights may differ from each other.

Also, although the thicknesses of the protrusions 42A to 42D are the same, the thicknesses may differ from each other.

Ninth Embodiment

Figure 29:
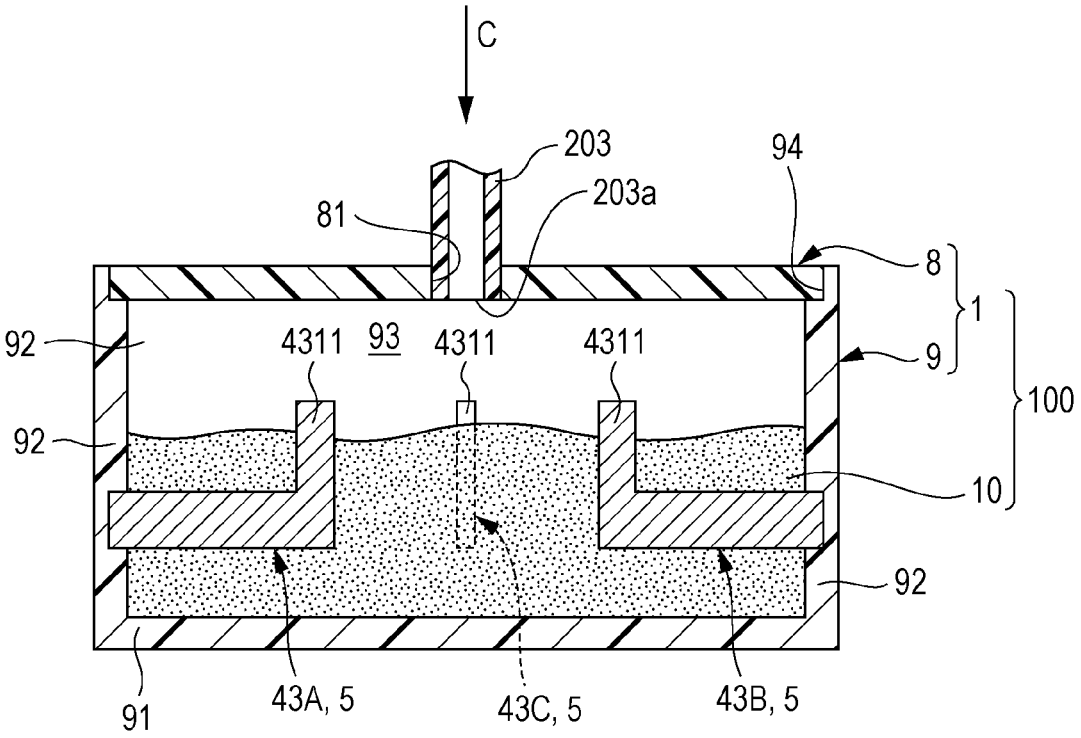
FIG. 29 is a partial vertical sectional view illustrating a state (example) in which an ink absorbing structure (ink absorbing member accommodation container) according to a ninth embodiment of the invention is used.
Figure 30:
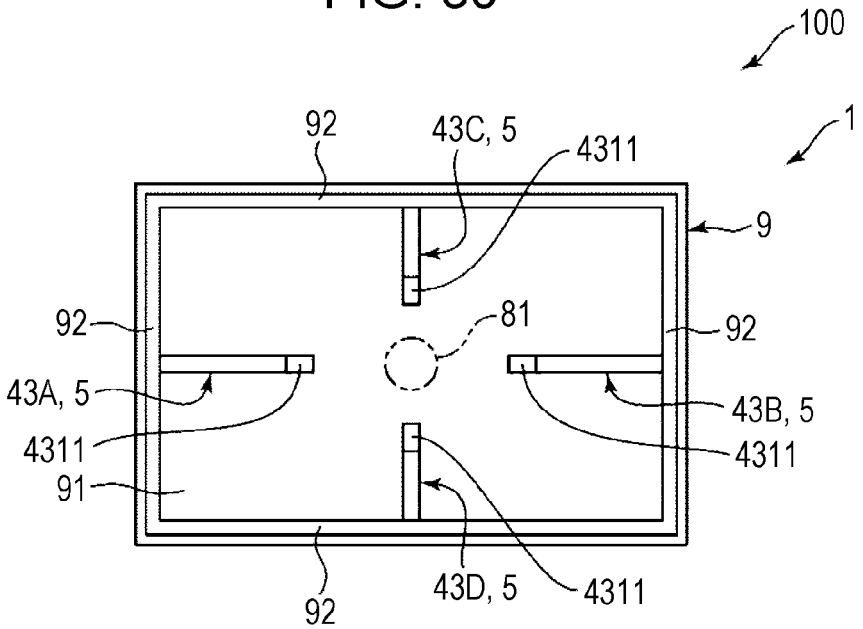
FIG. 30 is a view (planar view) when seen in the direction of the arrow C in FIG. 29.

FIG. 29 is a partial vertical sectional view illustrating a state (example) in which an ink absorbing structure (ink absorbing member accommodation container) according to a ninth embodiment of the invention is used. FIG. 30 is a diagram (plan view) when seen from the supply direction (the direction of the arrow C) in which the ink Q is supplied in FIG. 29. Note that the ink absorbing members are omitted in FIG. 30.

Hereinafter, the ninth embodiment of the ink absorbing member accommodation container and the ink absorbing structure according to the invention will be described with reference to these drawings, differences from the aforementioned embodiments will be mainly described, and description of similar matters will be omitted.

The embodiment is similar to the eighth embodiment other than that the configurations of the insertion members differ from each other.

As illustrated in FIG. 30, a protrusion 43A, a protrusion 43B, a protrusion 43C, and a protrusion 43D that serve as the insertion members 5 are radially arranged about the ink supply port 81 in the embodiment. As described above, the container main body 9 has the bottom section 91 and the side wall sections 92 that stand up from the bottom section 91. The protrusion 43A, the protrusion 43B, the protrusion 43C, and the protrusion 43D (insertion members 5) each are formed of protrusions that protrude from the respective side wall sections 92 in plate piece shapes. In other words, the respective protrusions 43A to 43D have plate piece shapes and are supported by the respective side wall sections 92 in a cantilever manner. In addition, the protrusions 43A to 43D have small protrusions 4311 (see FIG. 29) that protrude upward on a side of free ends. In this manner, engagement states of the protrusions 43A to 43D against the ink absorbing members 10 are enhanced.

In the embodiment, the protrusion 43A and the protrusion 43B are arranged in the long side direction (the left-right direction in FIG. 30) of the bottom section 91, and the protrusion 43C and the protrusion 43D are arranged in the short side direction (the upward-downward direction in FIG. 30) of the bottom section 91. With such arrangement, movement of the ink absorbing members 10 is curbed by the protrusion 43C and the protrusion 43D even if the ink absorbing members 10 are likely to move in the right-left direction in FIG. 30, for example, and movement of the ink absorbing members 10 is curbed by the protrusion 43A and the protrusion 43B even if the ink absorbing members 10 are likely to move in the upward-downward direction in FIG. 30. In this manner, it is possible to curb the movement of the ink absorbing members 10 in any direction. In this manner, the ink absorbing members 10 can continuously be located at the dropping locations of the ink Q and can thus quickly and sufficiently absorb the ink Q.

Tenth Embodiment

Figure 31:
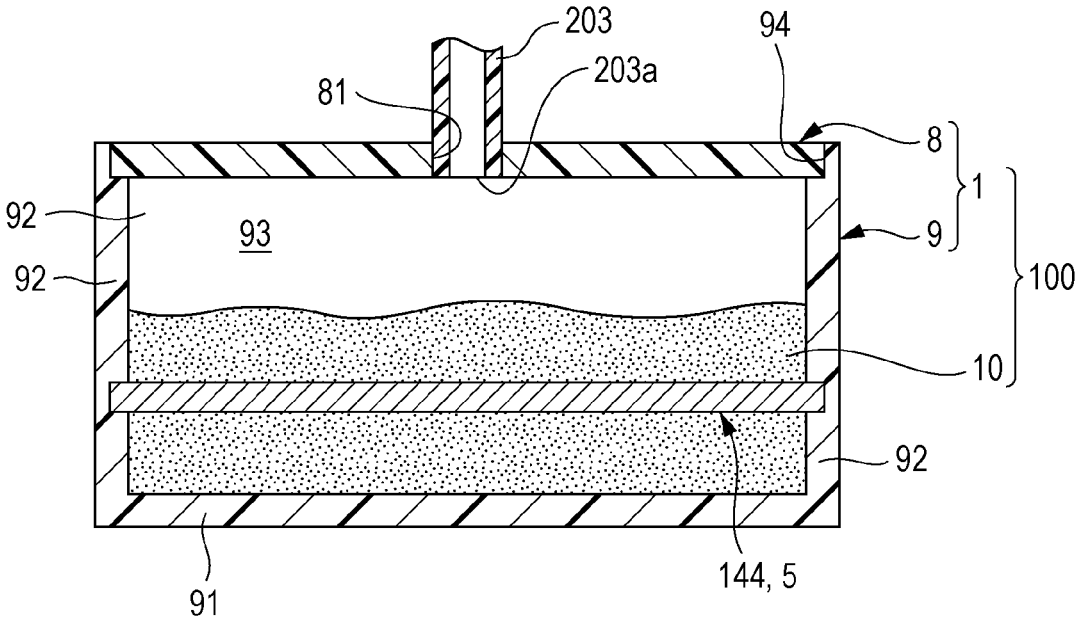
FIG. 31 is a partial vertical sectional view illustrating a state (example) in which an ink absorbing structure (ink absorbing member accommodation container) according to a tenth embodiment of the invention is used.
Figure 32:
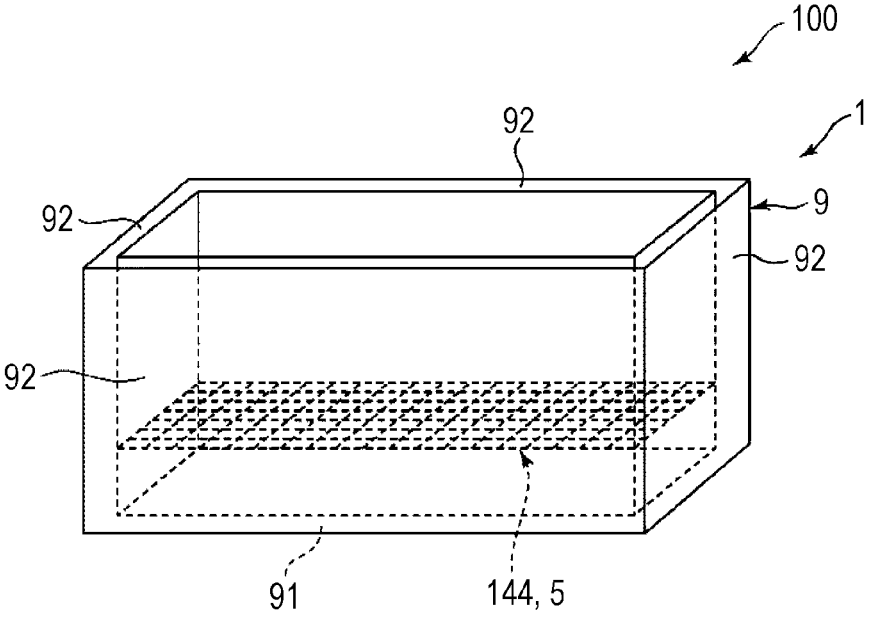
FIG. 32 is a perspective view of the ink absorbing structure illustrated in FIG. 31.

FIG. 31 is a partial vertical sectional view illustrating a state (example) in which an ink absorbing structure (ink absorbing member accommodation container) according to a tenth embodiment of the invention is used. FIG. 32 is a perspective view of the ink absorbing structure illustrated in FIG. 31. Note that the ink absorbing members are omitted in FIG. 32.

Hereinafter, the tenth embodiment of the ink absorbing member accommodation container and the ink absorbing structure according to the invention will be described with reference to these drawings, differences from the aforementioned embodiments will be mainly described, and description of similar matters will be omitted.

The embodiment is similar to the seventh embodiment other than that the configurations of the insertion members differ from each other.

As illustrated in FIGS. 31 and 32, the insertion members 5 are provided in midpoints of the container main body 9 in the depth direction and form a net shape (or a frame shape), that is, the insertion members 5 are formed of a net member 144 in the embodiment. The net member 144 is supported by the respective side wall sections 92 and are provided across the direction that intersects the depth direction of the container main body 9 in the container main body 9. In addition, the ink absorbing members 10 are caught by the mesh of the net of the net member 144 in the upward-downward direction. In this manner, movement of the ink absorbing member 10 is curbed even if the ink absorbing member 10 is likely to move in any direction in the container main body 9. In this manner, the ink absorbing members 10 can continuously be located at the dropping locations of the ink Q and can thus quickly and sufficiently absorb the ink Q.

Note that although the insertion members 5 have a net shape in the embodiment, the insertion members 5 are not limited thereto and may have a frame shape.

The number of arranged net members 144 is one in the embodiment, the number is not limited thereto, and a plurality of net members 144 may be arranged.

Eleventh Embodiment

Figure 33:
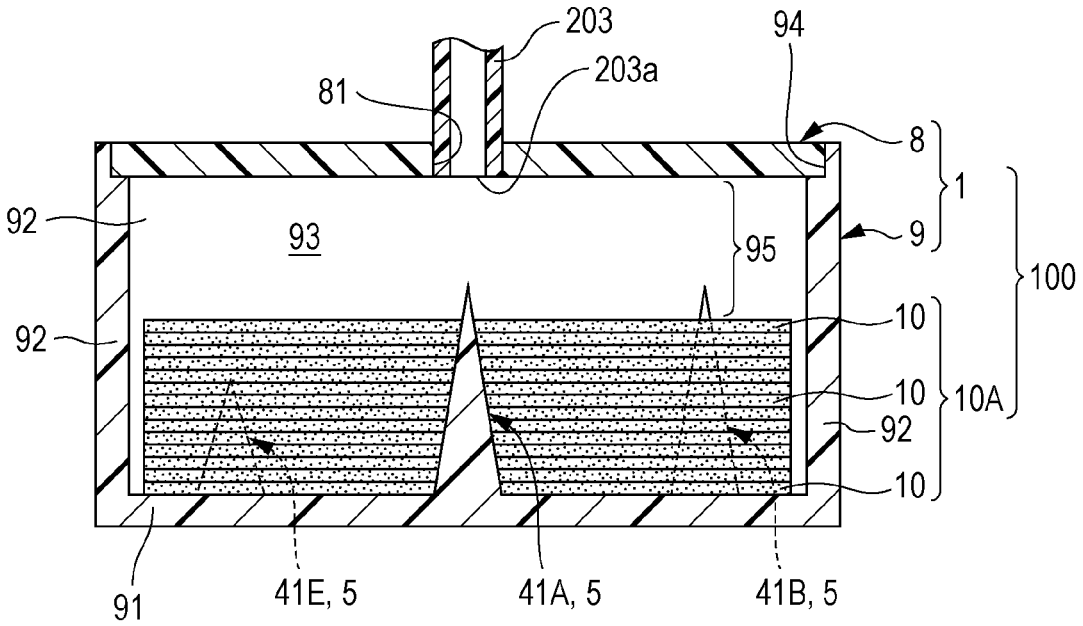
FIG. 33 is a partial vertical sectional view illustrating a state in which an ink absorbing structure (ink absorbing member accommodation container) according to an eleventh embodiment of the invention is used.
Figure 34:
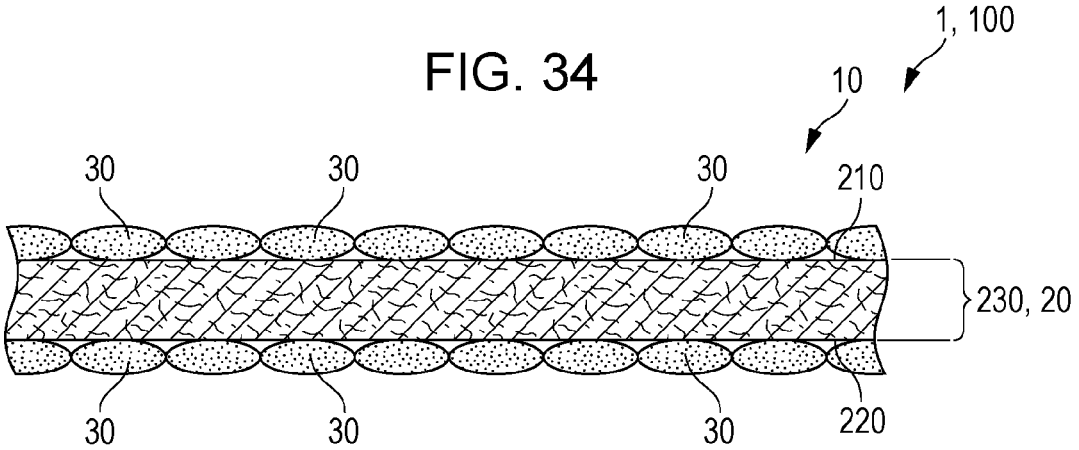
FIG. 34 is an enlarged detailed vertical sectional view of the ink absorbing member provided in the ink absorbing structure illustrated in FIG. 33.

FIG. 33 is a partial vertical sectional view illustrating a state (example) in which an ink absorbing structure (ink absorbing member accommodation container) according to an eleventh embodiment of the invention is used. FIG. 34 is an enlarged detailed vertical sectional view of the ink absorbing members included in the ink absorbing structure illustrated in FIG. 33.

Hereinafter, the eleventh embodiment of the ink absorbing member accommodation container and the ink absorbing structure according to the invention will be described with reference to these drawings, differences from the aforementioned embodiments will mainly be described, and description of similar matters will be omitted.

The embodiment is similar to the seventh embodiment other than that the configurations of the ink absorbing members differ from each other.

As illustrated in FIG. 33, the ink absorbing members 10 have sheet shapes and are accommodated in the accommodation space 93 of the container main body 9 as a sheet group 10A in which the plurality of ink absorbing members 10 are overlaid. In this manner, the absorption performance for absorbing the ink Q in the ink absorbing structure 100 increases by the number of the ink absorbing members 10.

The respective insertion members 5 stick to the plurality of ink absorbing members 10 by the protrusion heights and penetrate through these ink absorbing members 10. In this manner, movement of the respective ink absorbing members 10 in the accommodation space 93 is curbed when the ink absorbing members 10 contract, and it is possible to guide the ink Q to the ink absorbing members 10.

As illustrated in FIG. 34, the ink absorbing members 10 has sheet-shaped fiber base materials 230 that are formed of the fiber 20 and granular water-absorbable resin 30 that is retained by the fiber base materials 230. In addition, the water-absorbable resin 30 adheres to a side of at least one surface (the front surface 210 and the rear surface 220 in the configuration illustrated in FIG. 34) of each fiber base material 230. In this manner, it is possible to absorb the ink Q with the water-absorbable resin 30 even if the ink Q reaches any of the side of the front surface 210 and the side of the rear surface 220 of each of the ink absorbing members 10. Also, it is possible to quickly absorb the ink Q with the water-absorbable resin 30 since the water-absorbable resin 30 is brought into a state in which the water-absorbable resin 30 is exposed to the fiber base materials 230.

Note that although the ink absorbing members 10 are described as the sheet-shaped fiber base materials 230, the shape is not limited to the sheet shape, and the absorbable resin 30 may be retained in the fiber base materials 230 with strip shapes or small piece shapes.

Note that the water-absorbable resin 30 adheres to the front surface 210 and the rear surface 220 of each fiber base material 230 in the configuration illustrated in FIG. 34, the water-absorbable resin 30 is not limited thereto, and the water-absorbable resin 30 on one of the front surface 210 and the rear surface 220 may be omitted, for example.

Although the amounts of the water-absorbable resin 30 adhering to the side of the front surface 210 and the side of the rear surface 220 are preferably equal to each other, the amounts may differ from each other.

Although the water-absorbable resin 30 is preferably uniformly arranged and dispersed on both the side of the front surface 210 and the side of the rear surface 220, the degrees of dispersion may be sparse or dense.

Although the degree of the dispersion of the water-absorbable resin 30 on the side of the front surface 210 and the degree of the dispersion of the water-absorbable resin 30 on the side of the rear surface 220 are preferably the same as each other or may be different from each other.

Although the shapes of the ink absorbing members 10 in a plan view are preferably square shapes (for example, rectangular shapes) in the embodiment, the shapes are not limited thereto.

The ink absorbing members 10 may be ink absorbing members 10 with intermediate layers provided between the fiber base materials 230 and the water-absorbable resin 30.

Also, through-holes that penetrate through the ink absorbing members 10 in the thickness direction may be formed in the ink absorbing members 10.

Twelfth Embodiment

Figure 35:
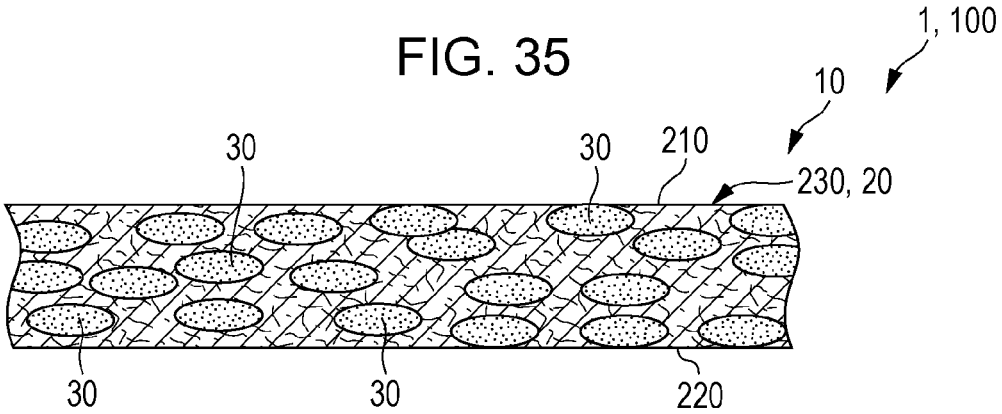
FIG. 35 is an enlarged detailed vertical sectional view of ink absorbing members provided in an ink absorbing structure (ink absorbing member accommodation container) according to a twelfth embodiment of the invention.

FIG. 35 is an enlarged detailed vertical sectional view of ink absorbing members included in the ink absorbing structure (ink absorbing member accommodation container) according to a twelfth embodiment of the invention.

Hereinafter, the eleventh embodiment of the ink absorbing member accommodation container and the ink absorbing structure according to the invention will be described with reference to the drawing, differences from the aforementioned embodiments will mainly be described, and description of similar matters will be omitted.

The embodiment is similar to the eleventh embodiment other than the configurations of the ink absorbing members differ from each other.

As illustrated in FIG. 35, the water-absorbable resin 30 is present at the midpoint of the fiber base material 230 in the thickness direction in the embodiment. In this manner, it is possible to retain (absorb) the ink Q on the furthest side of the ink absorbing members 10 to the maximum extent, that is, on the center side of the ink absorbing members 10 in the thickness direction and thereby to maintain the holding state of the ink Q for a long term. Also, it is possible to prevent dropping-off of the water-absorbable resin 30 from the fiber base materials 230.

Note that the water-absorbable resin 30 may be uniformly dispersed in the thickness direction and may be localized on the front surface 210 or the rear surface 220 of the fiber base material 230.

A combination of the configuration illustrated in FIG. 34 may be employed. That is, the water-absorbable resin 30 may be present (adhere to) on the side of at least one surface (the front surface 210 and the rear surface 220) of each fiber base material 230.

Although the ink absorbing member accommodation container and the ink absorbing structure according to the invention have been described above on the basis of the embodiments illustrated in the drawings, the invention is not limited thereto, and the respective parts that form the ink absorbing member accommodation container and the ink absorbing structure can be replaced with any configurations that can exhibit similar functions. Also, any configurations may be added thereto.

The ink absorbing member accommodation container and the ink absorbing structure according to the invention may be combinations of any two or more configurations (features) in the respective embodiments.

Although the ink absorbing members are in the cotton form in the seventh to tenth embodiments and have sheet shapes in the eleventh and twelfth embodiments, the ink absorbing members are not limited thereto and may have small piece shapes (strip shapes) that are smaller than the sheet shapes described in the eleventh and twelfth embodiments, for example.

Thirteenth Embodiment

Figure 36:
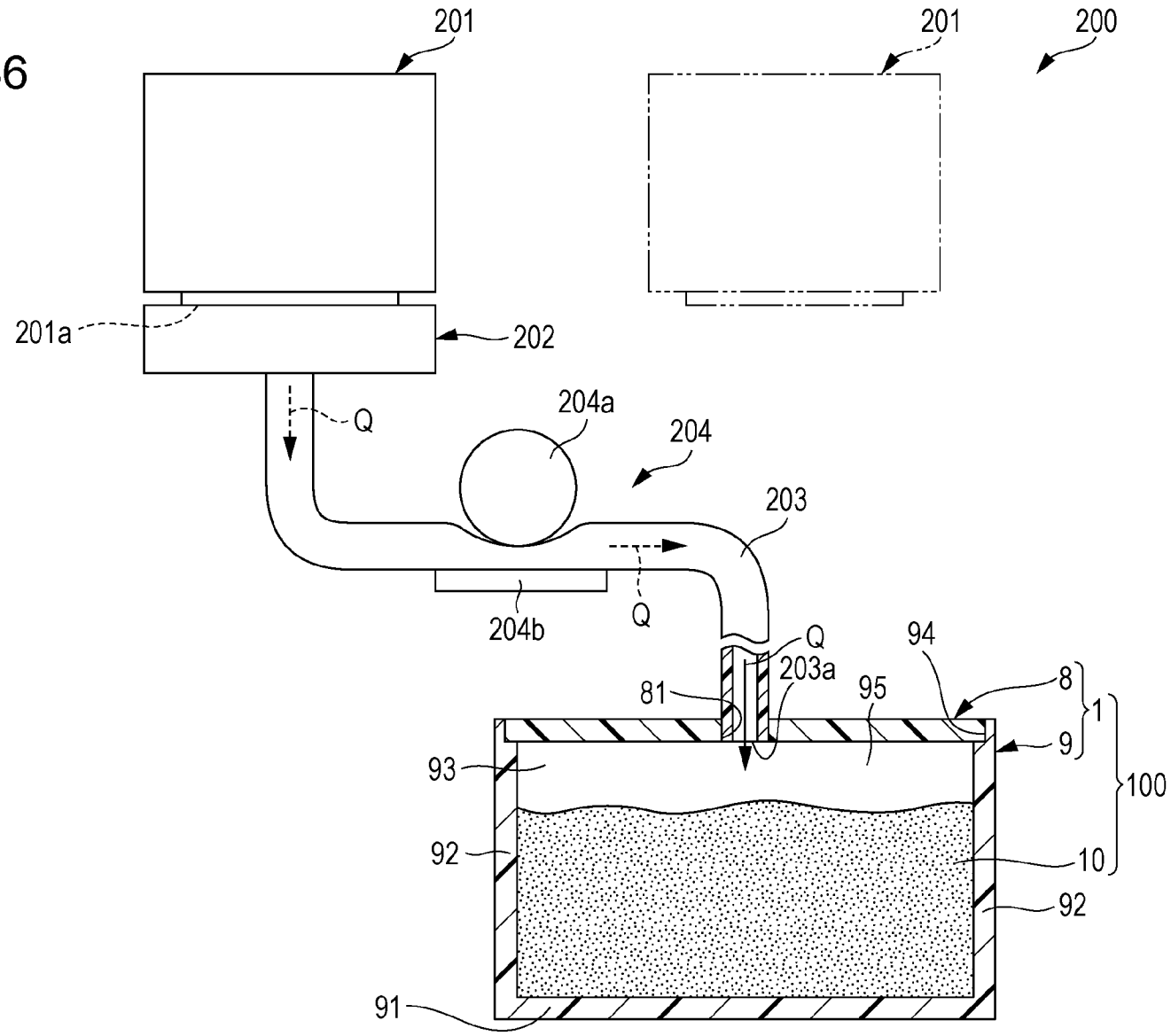
FIG. 36 is a partial vertical sectional view illustrating a state (example) in which an ink absorbing structure (ink absorbing member accommodation container) according to a thirteenth embodiment of the invention is used.

FIG. 36 is a partial vertical sectional view illustrating a state (example) in which an ink absorbing structure (ink absorbing member accommodation container) according to a thirteenth embodiment of the invention.

Note that the upper side in FIG. 36 (the same also applies to FIGS. 37 to 39) will be referred to as "upward (or above)" and the lower side will be referred to as "downward (or below)" in the following description for convenience of explanation. Since matters that will not be described below are the same as the content described above in the first embodiment, description thereof will be omitted.

As illustrated in FIG. 36, the ink absorbing member accommodation container 1 according to the invention is an ink absorbing member accommodation container that accommodates the ink absorbing members 10 including the water-absorbable resin 30 capable of absorbing the ink, and at least a part of the ink absorbing member accommodation container 1 has ultraviolet screening properties.

The ink absorbing structure 100 according to the invention includes the ink absorbing member accommodation container 1 and the ink absorbing members 10 that are accommodated in the ink absorbing member accommodation container 1 and that include the water-absorbable resin 30 capable of absorbing the ink Q.

According to the invention, it is possible to prevent or curb irradiation of the ink absorbing member 10 accommodated in the ink absorbing member accommodation container 1 with ultraviolet rays. Therefore, it is possible to prevent the ink absorbing members 10 in the ink absorbing member accommodation container 1 from being irradiated with the ultraviolet rays. As a result, it is possible to maintain excellent water absorption performance and water retention performance of the ink absorbing members 10.

The print apparatus 200 illustrated in FIG. 36 includes the ink ejection head 201, the capping unit 202, the tube 203, and the roller pump 204 that are similar to those described in the first embodiment.

As illustrated in FIG. 36, the ink absorbing structure 100 includes the ink absorbing member accommodation container 1 and the ink absorbing members 10 used to absorb the ink Q. The ink absorbing structure 100 is detachably attached to the print apparatus 200 and is used to absorb waste liquid of the ink Q as described above in the attached state. In this manner, it is possible to use the ink absorbing structure 100 as a so-called "waste liquid tank (waste ink tank)". If the amount of the ink Q absorbed by the ink absorbing structure 100 reaches the limit, it is possible to replace the ink absorbing structure 100 with a new (unused) ink absorbing structure 100. Note that whether or not the amount of the ink Q absorbed by the ink absorbing structure 100 has reached the limit is detected by a detection unit (not illustrated) in the print apparatus 200. In the case in which the amount of the ink Q absorbed by the ink absorbing structure 100 has reached the limit, the fact is provided as a notification by a notification unit, such as a monitor, incorporated in the print apparatus 200, for example.

The ink absorbing members 10 are used to absorb the ink Q in the ink absorbing member accommodation container 1. As illustrated in FIG. 21, the ink absorbing members 10 include the fiber 20 and the water-absorbable resin 30 adhering to (retained by) the fiber 20 and are in the cotton form as a whole in the embodiment. Note that the fiber 20 is preferably bonded to each other via a binder (not illustrated).

As illustrated in FIG. 36, the ink absorbing member accommodation container 1 includes the container main body 9 that has the accommodation space 93 for accommodating the ink absorbing members 10 and the cover member 8 that is detachably attached to the container main body 9.

Although the container main body 9 may be either a transparent (including semi-transparent) container main body with inner visibility or a non-transparent container main body, at least a part of the container main body 9 and the cover member 8, which will be described later, preferably have inner visibility.

As described above, the ink absorbing structure 100 includes the cover member 8. As illustrated in FIG. 36, the cover member 8 has a plate shape and can be fitted to the upper opening section 94 of the container main body 9. It is possible to seal the upper opening section 94 in a liquid tight manner through the fitting. In this manner, it is possible to prevent the ink Q from flying outwardly even in a case in which the ink Q collides against the ink absorbing members 10 and jumps up when the ink Q is discharged and drops from the tube 203, for example. Therefore, it is possible to prevent the ink Q from adhering to and staining the surroundings of the ink absorbing structure 100.

The cover member 8 preferably has water vapor permeability. In this manner, it is possible to allow moisture evaporated from the absorbed ink Q to penetrate therethrough to the outside. Therefore, it is possible to secure a larger amount by which the ink absorbing members 10 can absorb the ink Q.

The water vapor permeability of the cover member 8 is preferably equal to or greater than 1.0 $g/m^2 \cdot day$ (40° C.90% RH) and equal to or less than 120 $g/m^2 \cdot day$ (40° C.90% RH) and is more preferably equal to or greater than 2.0 $g/m^2 \cdot day$ (40° C.90% RH) and equal to or less than 100 $g/m^2 \cdot day$ (40° C.90% RH). In this manner, it is possible to more reliably exhibit the aforementioned advantages.

Constituent materials of the container main body 9 and the cover member 8 as described above are not particularly limited, and various resin materials can be suitably used, for example. Examples of the resin materials include various kinds of thermoplastic resin and various kinds of curable resin such as thermosetting resin and photocurable resin. Specific examples thereof include polyolefin such as polyethylene, polypropylene, and an ethylene-propylene copolymer, polyester such as polyvinyl chloride, polystyrene, polyamide, polyimide, polycarbonate, poly-(4-methylpentene-1), ionomer, acrylic resin, polymethyl methacrylate, an acrylonitrile butadiene-styrene copolymer (ABS resin), an acrylonitrile styrene copolymer (AS resin), a butadiene-styrene copolymer, polyethylene terephthalate (PET), and polybutylene terephthalate (PBT), polyether, polyetherketone (PEK), polyether ether ketone (PEEK), polyetherimide, polyacetal (POM), polyphenylene oxide, polysulfone, polyether sulfone, polyphenylene sulfide, polyarylate, aromatic polyester (liquid crystal polymer), polytetrafluoroethylene, polyvinylidene difluoride, other fluorine-based resin, epoxy resin, phenol resin, urea resin, melamine resin, silicone resin, polyurethane resin, copolymers, blends, polymer alloys, and the like containing them as main constituents, and it is possible to use one kind or two or more kinds among them in combination.

Here, the ink absorbing member accommodation container is placed at a location at which the ink absorbing member accommodation container is irradiated with ultraviolet rays derived from external light or the like depending on the apparatus configuration of the print apparatus 200, for example. In this case, the ultraviolet rays (UV) penetrate through the ink absorbing member accommodation container in the related art, and the ink absorbing member in the ink absorbing member accommodation container is irradiated with the ultraviolet rays. If the water-absorbable resin of the ink absorbing members is irradiated with the ultraviolet rays, there is a risk that a part of a common bond in a molecular structure of highly water-absorbable resin may be cut and the highly water-absorbable resin may deteriorate. That is, there is a risk that the water absorption performance and the water retention performance of the ink absorbing members may be degraded.

Thus, the invention employs a configuration in which at least a part of the ink absorbing member accommodation container 1 has ultraviolet screening properties (UV cutting properties). In this manner, it is possible to prevent or curb irradiation of the ink absorbing members 10 accommodated in the ink absorbing member accommodation container 1 with the ultraviolet rays. Therefore, it is possible to prevent the ink absorbing members 10 in the ink absorbing member accommodation container 1 from deteriorating due to the irradiation with the ultraviolet rays. As a result, it is possible to maintain excellent water absorption performance and water retention performance of the ink absorbing members.

The ultraviolet screening properties in the specification mean properties of inhibiting penetration of ultraviolet rays therethrough by absorbing or reflecting the ultraviolet rays, and specifically, the ultraviolet screening properties means that the permeability of the ultraviolet rays (light with a wavelength of equal to or less than 400 nm) is equal to or less than 5%.

In addition, a part with the ultraviolet screening properties in the area of the outer surface of the ink absorbing member accommodation container 1 is preferably equal to or greater than 50% and equal to or less than 100%, is more preferably equal to or greater than 70% and equal to or less than 100%, and is further preferably equal to or greater than 85% and equal to or less than 100%.

In a case in which an external light irradiation orientation is known in a state in which the ink absorbing members 10 are placed in the print apparatus 200, it is possible to apply the ultraviolet screening properties only to the part.

In the embodiment, the entire ink absorbing member accommodation container 1, that is, the container main body 9 (the bottom section 91 and the respective side wall sections 92) and the cover member 8 have the ultraviolet screening properties in the embodiment. In this manner, it is possible to more reliably prevent irradiation of the ink absorbing members 10 accommodated in the ink absorbing member accommodation container 1 with ultraviolet rays.

Note that the invention is not limited to the configuration, and the aforementioned advantages can be exhibited as long as at least a part of the ink absorbing member accommodation container 1 has ultraviolet screening properties. That is, it is possible to prevent or curb irradiation of the ink absorbing members 10 accommodated in the ink absorbing member accommodation container 1 with ultraviolet rays as long as the configuration in which at least one of the container main body 9 and the cover member 8 has ultraviolet screening properties is employed.

In the embodiment, the container main body 9 (the bottom section 91 and the respective side wall sections 92) and the cover member 8 are molded articles obtained by molding a material that has ultraviolet screening properties. That is, the container main body 9 and the cover member 8 are molded articles obtained by molding a material that includes an ultraviolet screener, which will be described later. In this manner, it is possible to omit a laminating operation as compared with the configuration in which the ultraviolet screening layer (ultraviolet blocking film) is laminated on the surface of the container main body 9 or the cover member 8. Therefore, it is possible to more easily obtain the advantages of the invention. Note that it is possible to obtain the aforementioned advantages as long as at least one of the container main body 9 and the cover member 8 is a molded article obtained by molding a material that includes an ultraviolet screener that blocks ultraviolet rays by absorbing or reflecting the ultraviolet rays.

Examples of the ultraviolet screener include an ultraviolet absorbing agent that absorbs ultraviolet rays and an ultraviolet reflecting agent that reflects ultraviolet rays, and it is possible to use one or both of them.

If the ultraviolet screener is an ultraviolet absorbing agent, it is possible to sufficiently enhance visible light permeability of the ink absorbing member accommodation container 1, and inner visibility of the ink absorbing member accommodation container 1 is enhanced as compared with a case in which an ultraviolet reflecting agent that has a trend that visible light permeability is relatively low is used. There is also an advantage that a degree of blocking ultraviolet rays is easily controlled.

Although the ultraviolet absorbing agent is not particularly limited, and it is possible to use one kind or two or more kinds selected from a triazine-based ultraviolet absorbing agent, a benzophenone-based ultraviolet absorbing agent, a benzotriazole-based ultraviolet absorbing agent, a cyanoacrylate-based ultraviolet absorbing agent, a salicylate-based ultraviolet absorbing agent, an avobenzone-based ultraviolet absorbing agent, a hindered amine-based ultraviolet absorbing agent, a benzoylmethane-based ultraviolet absorbing agent, an oxybenzone-based ultraviolet absorbing agent, cerium oxide, zinc oxide, and titanium oxide in combination. Among them, a triazine-based ultraviolet absorbing agent is particularly preferably used, and a hydroxyphenyl triazine-based ultraviolet absorbing agent is more preferably used in the triazine-based ultraviolet absorbing agent.

Examples of the ultraviolet reflecting agent include carbon black, iron oxide, chromium oxide, lead oxide, zinc oxide, magnesium oxide, titanium oxide, calcium carbonate, and barium sulfate, and one kind or a plurality of kinds of thereof can be used in combination.

In a case in which the cover member 8 has ultraviolet screening properties, the content of the ultraviolet absorbing agent in the cover member 8 is preferably equal to or greater than 0.1 mg/cm$^2$ and equal to or less than 10 mg/cm$^2$ and is more preferably equal to or greater than 0.2 mg/cm$^2$ and equal to or less than 1.0 mg/cm$^2$ in terms of an area ratio. In this manner, it is possible to sufficiently secure strength of the cover member 8 and to exhibit sufficient ultraviolet screening properties.

In a case in which the container main body 9 (the bottom section 91 and the respective side wall sections 92) has ultraviolet screening properties, the content of the ultraviolet absorbing agent in the container main body 9 is preferably equal to or greater than 0.1 mg/cm$^2$ and equal to or less than 10 mg/cm$^2$ and is more preferably equal to or greater than 0.2 mg/cm$^2$ and equal to or less than 1.0 mg/cm$^2$. In this manner, it is possible to sufficiently secure strength of the container main body 9 (the bottom section 91 and the respective side wall sections 92) and to exhibit sufficient ultraviolet screening properties.

Fourteenth Embodiment

Figure 37:
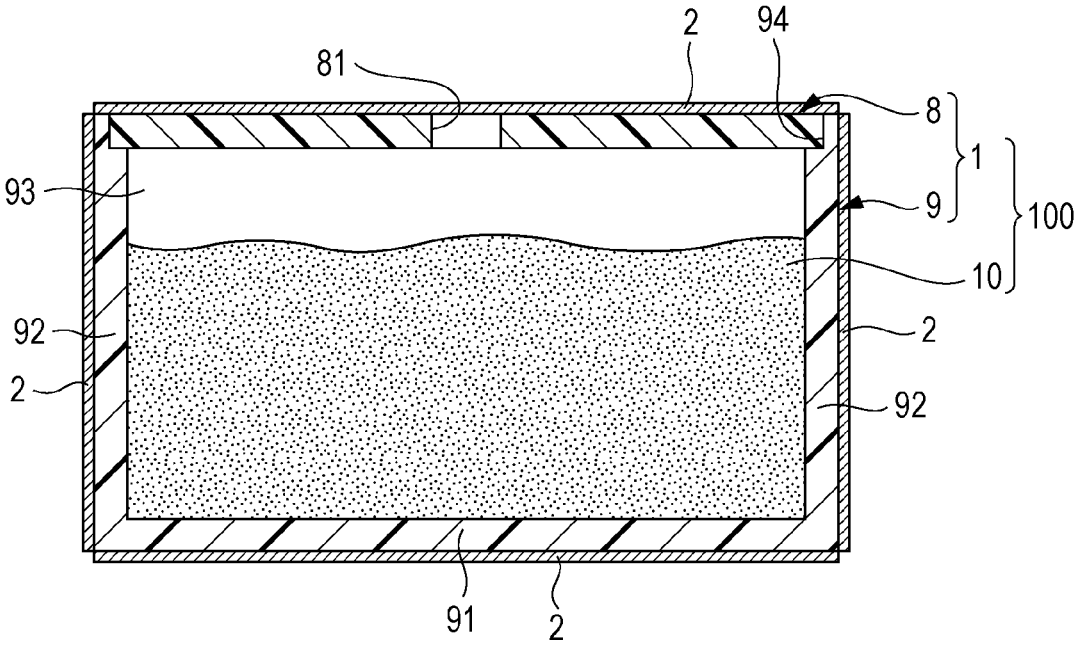
FIG. 37 is a partial vertical sectional view illustrating a state (example) in which an ink absorbing structure (ink absorbing member accommodation container) according to a fourteenth embodiment of the invention is used.

FIG. 37 is a partial vertical sectional view illustrating a state (example) in which an ink absorbing structure (ink absorbing member accommodation container) according to a fourteenth embodiment of the invention is used.

Hereinafter, the thirteenth embodiment of the ink absorbing member accommodation container and the ink absorbing structure according to the invention will be described with reference to the drawings, differences from the aforementioned embodiments will be mainly described, and description of similar matters will be omitted.

The embodiment is similar to the thirteenth embodiment other than that an ultraviolet screening layer is provided.

As illustrated in FIG. 37, the ink absorbing member accommodation container 1 according to the embodiment has an ultraviolet screening layer 2 that is provided on at a surface of at least one of the container main body 9 and the cover member 8 (outer surfaces of the bottom section 91, the respective side wall sections 92, and the cover member 8 in the embodiment) and that includes an ultraviolet screener that blocks ultraviolet rays by absorbing or reflecting the ultraviolet rays. In this manner, it is possible to provide the ultraviolet screening layer 2 at a desired location and to apply ultraviolet screening properties to a desired portion in accordance with the apparatus configuration of the print apparatus 200. In a case in which the print apparatus 200 is configured to be irradiated with the ultraviolet rays from the upper side, that is, the side of the cover member 8, it is possible to provide the ultraviolet screening layer 2 only at the cover member 8.

In addition, although the ultraviolet screening layer 2 may be exposed to the outside of the absorbing member accommodation container 1 of the ink absorbing member accommodation container 1 or may be located inside, the ultraviolet screening layer 2 is preferably exposed to the outside. In this manner, it is possible to prevent the container main body 9 or the cover member 8 from deteriorating due to ultraviolet rays. Further, it is possible to prevent the ultraviolet screening layer 2 from being brought into contact with the ink Q. As a result, it is possible to prevent quality of the ultraviolet screening layer 2 from changing due to contact with the ink Q although it depends on the constituent material of the ultraviolet screening layer 2.

The thickness of the ultraviolet screening layer 2 is preferably equal to or greater than 0.1 mm and equal to or less than 5 mm and is more preferably equal to or greater than 0.5 mm and equal to or less than 2 mm.

The content of the ultraviolet absorbing agent in the ultraviolet screening layer 2 is preferably equal to or greater than 0.1 mg/cm$^2$ and equal to or less than 10 mg/cm$^2$ and is more preferably equal to or greater than 0.2 mg/cm$^2$ and equal to or less than 1.0 mg/cm$^2$ in terms of an area ratio. In this manner, it is possible to exhibit sufficient ultraviolet screening properties.

Examples of a method of forming the ultraviolet screening layer 2 include a method of applying and hardening a composition that includes the ultraviolet absorbing agent and a method of attaching a film that includes the ultraviolet absorbing agent.

Fifteenth Embodiment

Figure 38:
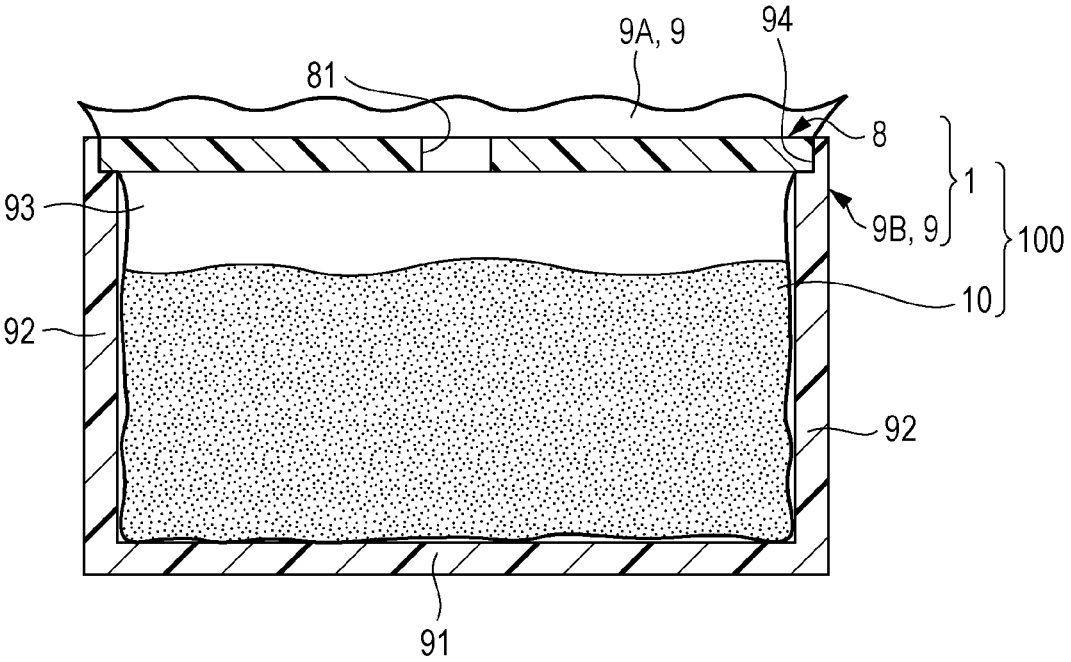
FIG. 38 is a partial vertical sectional view illustrating a state (example) in which an ink absorbing structure (ink absorbing member accommodation container) according to a fifteenth embodiment of the invention is used.
Figure 39:
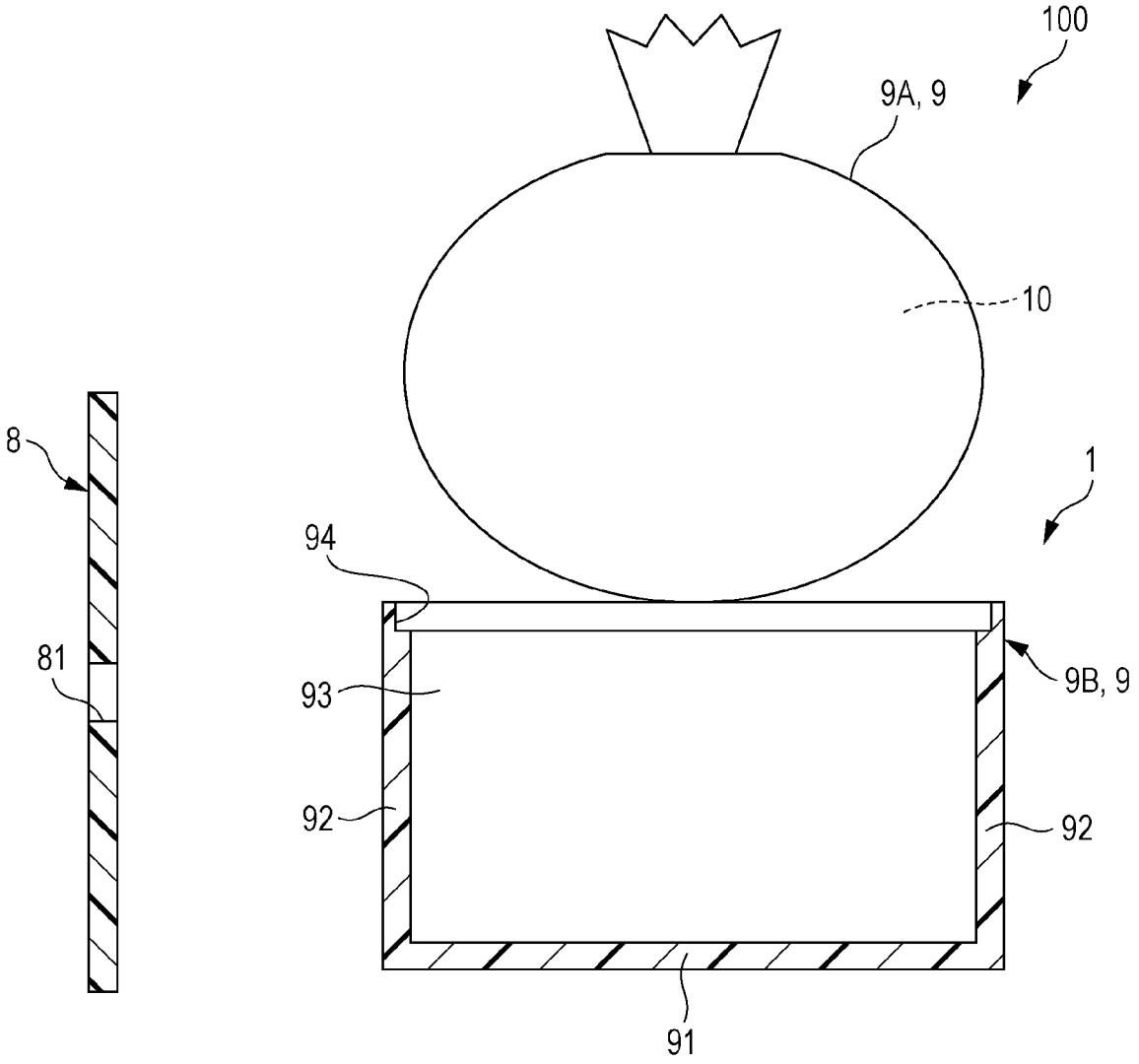
FIG. 39 is a partial vertical sectional view illustrating the state (example) in which the ink absorbing structure (ink absorbing member accommodation container) according to the fifteenth embodiment of the invention is used.

FIGS. 38 and 39 are partial vertical sectional views illustrating a state (example) in which an ink absorbing structure (ink absorbing member accommodation container) according to a fifteenth embodiment of the invention is used.

Hereinafter, the fifteenth embodiment of the ink absorbing member accommodation container and the ink absorbing structure according to the invention will be described with reference to these drawings, differences from the aforementioned embodiments will be mainly described, and description of similar matters will be omitted.

The embodiment is similar to the fourteenth embodiment other than that the configurations of the container main body differ from each other.

As illustrated in FIGS. 38 and 39, the container main body 9 has an inner container 9A with flexibility and a hard outer container 9B that is located outside the inner container 9A. The inner container 9A has a bag shape, and the ink absorbing members 10 are accommodated therein. Also, the outer container 9B has a box shape that has the bottom section 91 and the respective side wall sections 92 as described above.

When the ink absorbing members 10 are replaced, the ink absorbing member accommodation container 1 is removed from the print apparatus 200 (not illustrated) first, and the cover member 8 is detached from the container main body 9. Then, the opening of the inner container 9A is closed, and the inner container 9A is removed from the outer container 9B while the ink absorbing members 10 are accommodated therein as illustrated in FIG. 39. In this manner, it is possible to easily replace the ink absorbing members 10.

The embodiment is configured in which the inner container 9A has ultraviolet screening properties. In this manner, it is possible to prevent the ink absorbing members 10 from deteriorating due to irradiation of the ink absorbing members 10 with the ultraviolet rays in a state in which the ink absorbing members 10 are attached to the print apparatus 200 similarly to the aforementioned respective embodiments. Further, it is possible to remove the inner container 9A while the ink absorbing members 10 are accommodated therein and to prevent the ink absorbing members 10 from being irradiated with ultraviolet rays until the ink absorbing members 10 accommodated therein are discarded as illustrated in FIG. 39.

Note that the inner container 9A may be configured such that the ultraviolet screening layer is formed on the surface of the bag or may be configured such that the ultraviolet screener is kneaded into the constituent material of the bag. Also, the cover member 9 may have ultraviolet screening properties regardless of presence of the ultraviolet screening properties of the inner container 9A.

Although the configuration in which the inner container 9A has ultraviolet screening properties has been described in the embodiment, a configuration in which only the outer container 9B has the ultraviolet screening properties may be employed, or a configuration in which both the inner container 9A and the outer container 9B have the ultraviolet screening properties may be employed.

Although the ink absorbing member accommodation container and the ink absorbing structure according to the invention have been described above on the basis of the embodiments illustrated in the drawings, the invention is not limited thereto, and the respective parts that form the ink absorbing member accommodation container and the ink absorbing structure can be replaced with any configurations that can exhibit similar functions. Also, any configurations may be added thereto.

The ink absorbing member accommodation container and the ink absorbing structure may be combinations of any two or more configurations (features) in the aforementioned respective embodiments.

Although the ink absorbing members are in the cotton form in the aforementioned respective embodiments, the ink absorbing members are not limited thereto and may have sheet shapes or small piece shapes (strip shapes) that are smaller than the sheet shapes. Also, the water-absorbable resin may be used alone.

The entire disclosures of Japanese Patent Application Nos. 2018-059711, 2018-059713 and 2018-059714 all filed Mar. 27, 2018 are expressly incorporated herein by reference.

What is claimed is:

1. An ink absorber comprising:

an ink absorbing member that is capable of absorbing ink; and an accommodation section that accommodates the ink absorbing member and includes;

a detachment structure section that detaches the ink absorbing member from the accommodation section, wherein the accommodation section has a bottom section and side wall sections standing up from the bottom section, and the detachment structure section is configured with a low friction layer that is provided inside the side wall sections and that reduces friction against the ink absorbing member when the ink absorbing member is detached from the accommodation section.

2. The ink absorber according to claim 1, wherein the detachment structure section is configured with inclined surfaces that are inclined relative to the bottom section and are formed inside the side wall sections.

3. The ink absorber according to claim 1, wherein the ink absorbing member includes water-absorbable resin.

4. An ink absorber comprising:

an ink absorbing member that is capable of absorbing ink; and an accommodation section that accommodates the ink absorbing member and includes a detachment structure section that detaches the ink absorbing member from the accommodation section, wherein the detachment structure section is configured to allow the absorbing member to be detached and collected from the accommodation section.

5. The ink absorber according to claim 4, wherein the detachment structure section has a placement section on which the ink absorbing member is placed and a gripping section that is coupled to the placement section and that is gripped when the ink absorbing member is detached from the accommodation section, and the detachment structure section is detached from the accommodation section along with the ink absorbing member when the ink absorbing member is detached from the accommodation section.

6. The ink absorber according to claim 5, wherein the ink absorbing member contracts with a decrease in water content, and the gripping section is brought into contact with the ink absorbing member by being inserted into the ink absorbing member and has a function of curbing movement in the accommodation section with the contraction of the ink absorbing member in a state before the ink absorbing member is detached from the accommodation section.

7. The ink absorber according to claim 5, wherein the gripping section is brought into contact with the ink absorbing member by being inserted into the ink absorbing member and has a liquid guiding function of guiding the ink to the ink absorbing member in a state before the ink absorbing member is detached from the accommodation section.

8. The ink absorber according to claim 5, wherein the accommodation section has an ink supply port supplying the ink to an inside, and the gripping section has a tubular shape and serves as a liquid guiding pipe that is located in the accommodation space and that forms a liquid guiding space guiding the ink supplied into the accommodation space to a bottom section of the accommodation section in a state before the ink absorbing member is detached from the accommodation section.

9. The ink absorber according to claim 8, wherein a communication section that communicates the liquid guiding space with the accommodation space is formed at a pipe wall of the liquid guiding pipe.

10. The ink absorber according to claim 4, wherein the detachment structure section has an inner accommodation section that is accommodated in the accommodation section along with the ink absorbing member in a state in which the ink absorbing member is accommodated, and the inner accommodation section is detached from the accommodation section along with the ink absorbing member when the ink absorbing member is detached from the accommodation section.

* * * * *